US007616126B2

(12) United States Patent
Kadwell et al.

(10) Patent No.: US 7,616,126 B2
(45) Date of Patent: Nov. 10, 2009

(54) OPTICAL PARTICLE DETECTORS

(75) Inventors: Brian J. Kadwell, West Olive, MI (US); Christopher D. Stirling, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 205 days.

(21) Appl. No.: 11/488,315

(22) Filed: Jul. 18, 2006

(65) Prior Publication Data

US 2008/0018485 A1 Jan. 24, 2008

(51) Int. Cl.
*G08B 17/10* (2006.01)

(52) U.S. Cl. ..... 340/630; 340/628

(58) Field of Classification Search ..... 340/628, 340/629, 630

See application file for complete search history.

(56) References Cited

U.S. PATENT DOCUMENTS 3,968,379 A 7/1976 Crane
3,980,997 A 9/1976 Berns et al.
3,982,130 A 9/1976 Trumble
4,001,800 A 1/1977 Franks
4,063,227 A 12/1977 Peterson
4,104,619 A 8/1978 Hesler
4,131,888 A 12/1978 Galvin
4,185,278 A 1/1980 Lintelmann et al.
4,241,282 A 12/1980 Tresch et al.
4,249,169 A 2/1981 Malinowski
4,305,069 A * 12/1981 Machen et al. ..... 340/628
4,319,234 A 3/1982 Rice
4,420,746 A 12/1983 Malinowski
4,469,953 A 9/1984 Fujisawa et al.
4,539,556 A 9/1985 Dederich et al.
4,614,968 A 9/1986 Rattman et al.
4,647,785 A 3/1987 Morita
4,678,921 A 7/1987 Nakamura et al.
4,680,576 A 7/1987 Bauer
4,758,733 A 7/1988 Mochizuki
4,769,550 A 9/1988 Dolnick
4,851,819 A 7/1989 Kawai et al.
4,857,895 A 8/1989 Kaprelian
4,870,394 A 9/1989 Corl et al.
4,901,056 A 2/1990 Belavia
5,053,754 A 10/1991 Wong
5,103,096 A 4/1992 Wong
5,117,219 A 5/1992 Tice et al.
5,138,562 A 8/1992 Shaw et al.
5,247,283 A 9/1993 Kobayashi et al.
5,341,214 A 8/1994 Wong
5,369,397 A 11/1994 Wong
5,400,014 A * 3/1995 Behlke et al. ..... 340/630
5,473,314 A 12/1995 Mochizuki et al.
5,523,743 A 6/1996 Rattman et al.
5,546,074 A 8/1996 Bernal et al.
5,552,765 A 9/1996 Vane et al.
5,576,697 A 11/1996 Nagashima et al.
5,592,147 A 1/1997 Wong
5,629,671 A 5/1997 Morita
5,673,020 A 9/1997 Okayama
5,691,704 A 11/1997 Wong (Continued)

*Primary Examiner*—Jeffery Hofsass
(74) *Attorney, Agent, or Firm*—James E. Shultz, Jr.

(57) ABSTRACT

A particle sensor is provided that includes a light source, an optical transducer, and a controller, wherein the controller is in communication with the light source and the optical transducer. The controller is configured to reject substantially all signals except those contributed by the light source.

76 Claims, 51 Drawing Sheets

U.S. PATENT DOCUMENTS 5,705,988 A 1/1998 McMaster
5,708,414 A 1/1998 Peltier et al.
5,719,557 A 2/1998 Rattman et al.
5,721,529 A 2/1998 Vane et al.
5,726,633 A 3/1998 Wiemeyer
5,751,218 A 5/1998 Winterble et al.
5,767,776 A 6/1998 Wong
5,896,088 A 4/1999 Brooks, Jr.
5,898,377 A 4/1999 Adachi
6,049,446 A 4/2000 Ha et al.
6,967,582 B2 * 11/2005 Tice et al. ..... 340/630

* cited by examiner

Fig. 10a
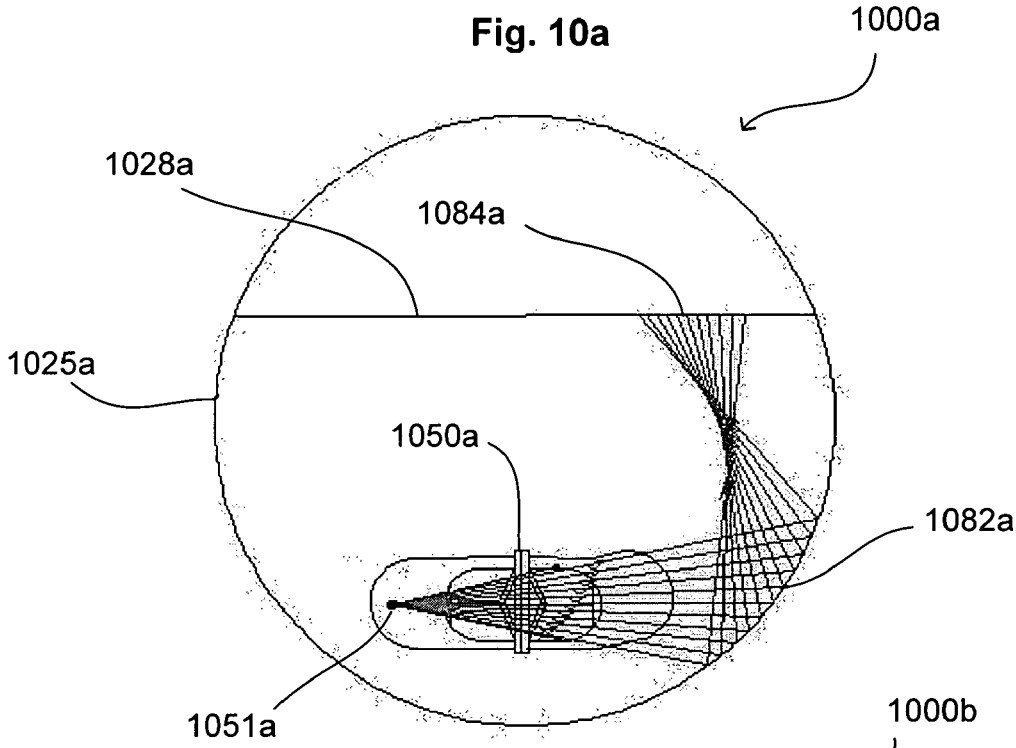
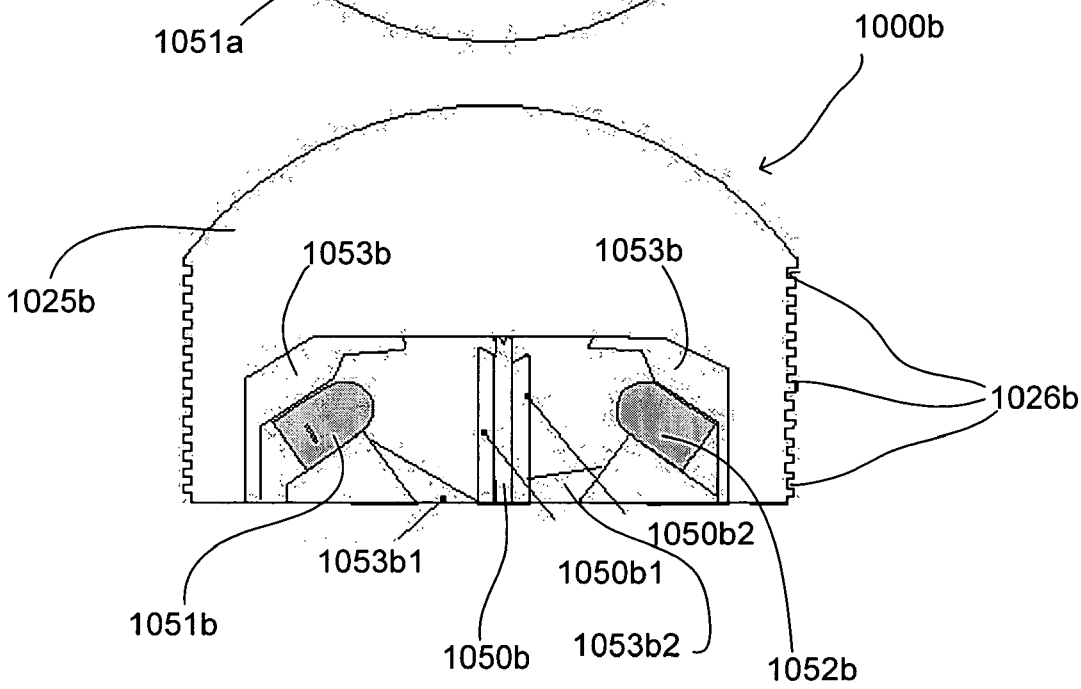
Fig. 10b

OPTICAL PARTICLE DETECTORS

BACKGROUND OF THE INVENTION

The present disclosure relates to particle detection. In at least one embodiment, light scattering principles are employed to detect particles within a test chamber. The present disclosure contains at least one embodiment which may be particularly applicable to smoke detectors having a fixed smoke sensing threshold.

SUMMARY OF THE INVENTION

According to an aspect of the present invention, a particle sensor is provided that includes a light source, an optical transducer, and a controller, wherein the controller is in communication with the light source and the optical transducer. The controller is configured to reject substantially all signals except those contributed by the light source.

According to another aspect of the present invention, a particle sensor is provided that is configured to be mounted to a substantially planar surface including an aesthetic cover, a chimney, and at least one additional component, wherein at least a portion of the aesthetic cover, at least a portion of the chimney, and at least a portion of the at least one additional component at least partially defines a smoke cage, wherein airflow through the smoke cage flows substantially perpendicular to the substantially planar mounting surface.

According to yet another aspect of the present invention, a particle sensor is provided that includes an aesthetic cover having a perimeter, a printed circuit board, a smoke cage, and at least two thermal sensors, wherein the thermal sensors are positioned near the perimeter of the aesthetic cover and spaced about 120 degrees apart from each other.

BRIEF DESCRIPTION OF THE DRAWINGS

FIG. 10*a* depicts a plan view of light ray tracings within a smoke cage with the light source modeled as a point source;

FIG. 10*b* depicts a profile view of an optics block positioned within an associated smoke cage;

DETAIL DESCRIPTION OF THE INVENTION

In the case of an optical smoke detector based on the light scatter principle that must also generate an audible alarm in response to a fire condition, two separate and rather large components were previously required. One is the smoke cage, typically a molded plastic or similar material device, which shields the smoke sensor from ambient light and insect intrusion, yet allows free ingress and egress of ambient airflow. The smoke cage also serves to direct and dissipate the light internally generated by the light source. Often times smoke cages are complex structures which makes them difficult and/or expensive to manufacture. For example, in order to block ambient light some manufacturers choose a complex labyrinth design. The second required device is a sounder, typically a molded plastic device containing an audio element and associated electrical connections.

Figure 1:
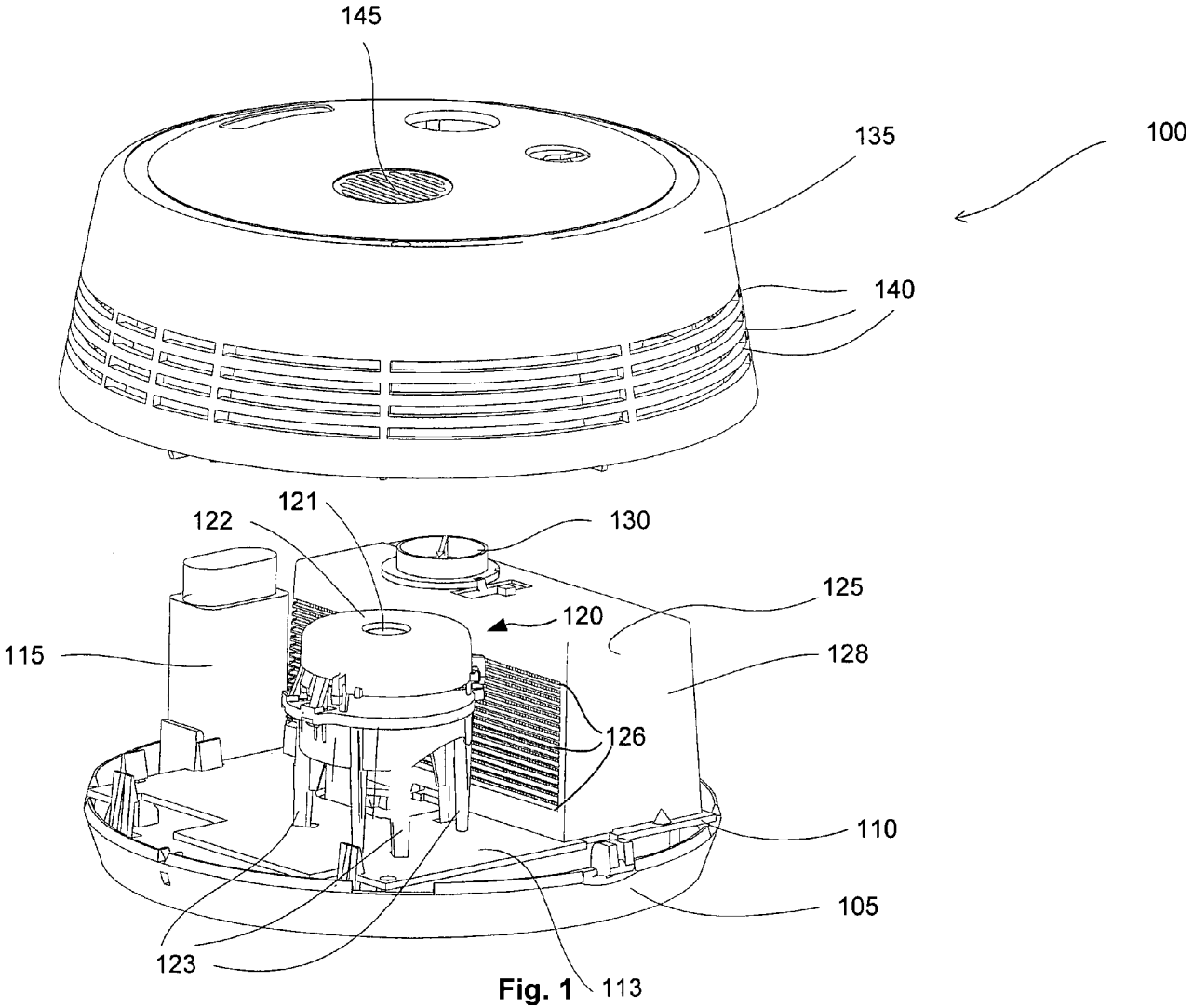
FIG. 1 depicts a particle sensor embodiment.

Turning initially to FIG. 1, an embodiment of a particle sensor 100 is depicted. Often, a pre-packaged sounder assembly 120 is used in a device such as a smoke detector as shown in FIG. 1. The sounder is typically separate and distinct from the smoke cage. Often, the sounder assembly 120 is mounted to a printed circuit board (hereinafter PCB) 110 as a separate component.

Pre-packaged sounders typically consist of an outer acoustic housing 122, a base plate 123 with electrical pins, an audio element 121, such as a piezoelectric element, glue to seal the housing (not shown) and electrical wiring(not shown) that is soldered, or attached by spring contacts, to the audio element and/or printed circuit board and extending there between.

Typically, in order to achieve a "low profile" sounder e.g., having a decreased height, the sounder assembly 120 is positioned beside the smoke cage 125 on a printed circuit board

110. It is also typical to position the battery 115, and/or a transformer or battery charger beside the smoke cage. As can be seen in FIG. 1, positioning these components as described, results in at least portions of the bug screen 126 being partially blocked from airflow parallel to surface 113 of the printed circuit board 110. An optics block (not shown in FIG. 1) is typically attached to the printed circuit board within the smoke cage. Often, a manually operable test switch 130 is incorporated to simulate detection of particles. In one embodiment the test switch is configured to alter the optical properties of the smoke cage to simulate particles inside the smoke cage.

With further reference to FIG. 1, an aesthetic cover 135 is shown to include louvers 140 and a sound grill 145. The sound grill functions to allow sound waves emanating from the sounder to pass through the cover substantially non-attenuated. The louvers provide at least two functions, 1) to block ambient light rays from entering the smoke cage and 2) to allow substantially free airflow through the aesthetic cover substantially parallel to the surface 113.

The printed circuit board is often times "snapped" within a bracket 105 that mates with a mount (not shown in FIG. 1) for attaching to the desired support. The aesthetic cover is frequently configured to snap to the bracket as well.

In at least one embodiment, a particle sensor is provided that is competitively priced for the residential market. Preferably, a "smokeless" method of producing a "calibrated" product is employed. At least one feature of the above described sensor is included in many of the various embodiments individually or in combination with other features.

Figure 2A:
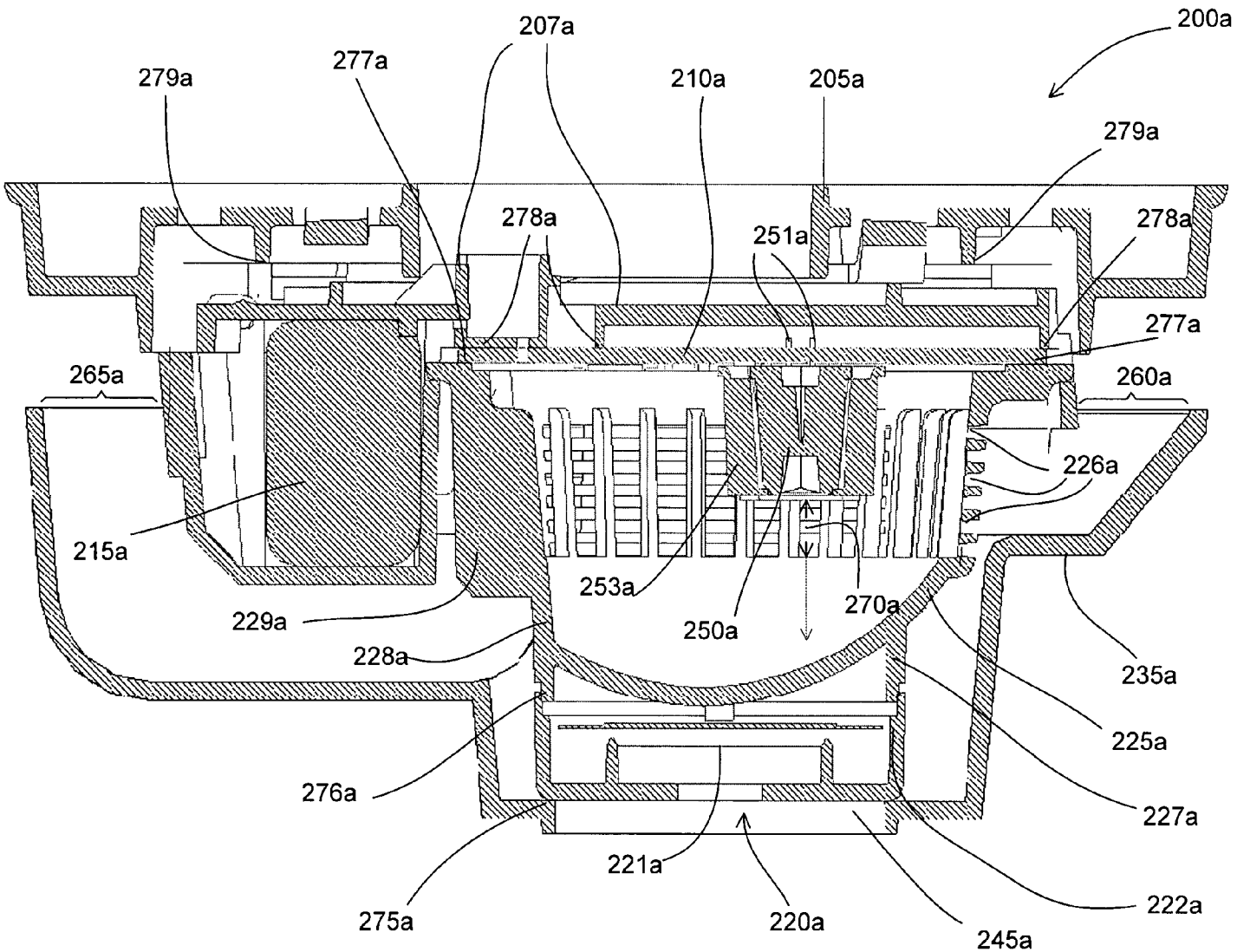
FIG. 2*a* depicts a particle sensor embodiment.
Figure 2B:
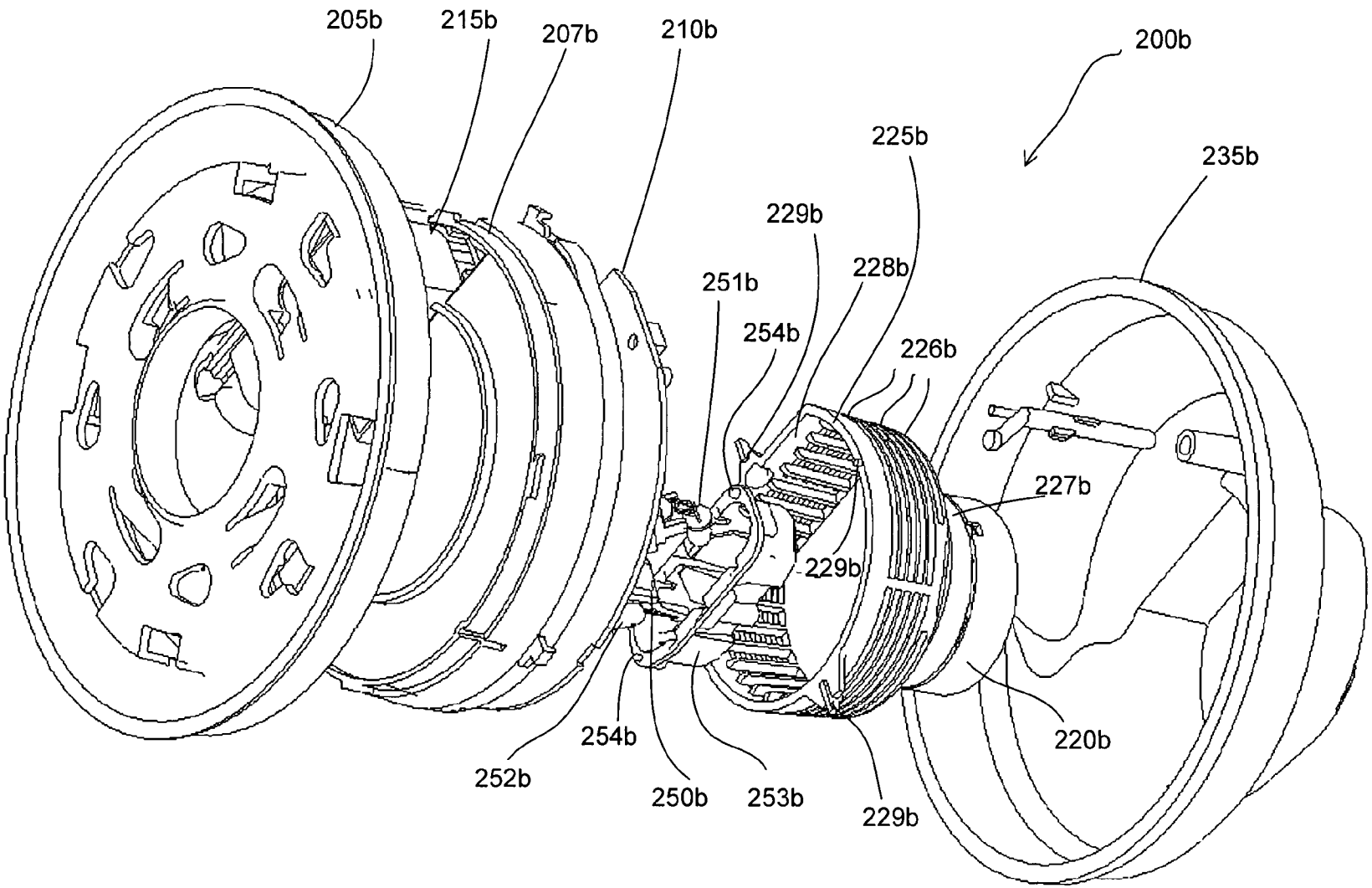
FIG. 2*b* depicts an exploded, perspective, view of a particle sensor embodiment of FIG. 2*a;*

FIGS. 2*a* and 2*b* depict one embodiment of a particle sensor 200*a*, 200*b*. Positioning the sounder assembly 220*a*, 220*b*, preferably comprising a piezoelectric audio element, on top of the smoke cage 225*a*, 225*b* results in improved audio output distribution and, or, sound pressure levels in various embodiments. Alternative particle sensor designs place the audio element underneath the smoke cage. The audio exits through the smoke cage interior and out the bug screen. This creates a very compact, low profile final assembly. However, this arrangement is labor intensive to manufacture and the audio output is attenuated. Audio attenuation often causes the device to fail Underwriter's Laboratory (UL) testing for minimum sound pressure levels. In at least one embodiment, having the sounder mounted on top of the smoke cage, in lieu of being beside the smoke cage, results in a particle with low sensitivity variations with respect to mounting orientation. Positioning the sounder on top of the smoke cage may also result in a savings of printed circuit board 210*a*, 210*b* surface area. By providing an attachment means 227*a*, 227*b* to the smoke cage, the base plate 123 is eliminated. A portion of the smoke cage may function as the base plate and, or, a conduit for electrical connections. These connections may be pins or sockets integral to the smoke cage and, or, sounder or may comprise flexible wiring and, or, a connector.

As a sub-assembly, the mechanical steps to assemble the dual function sounder and smoke cage are similar as for the formerly distinct pre-packaged sounder alone. This results in little to no additional labor cost to assemble the particle sensor having the combined functions. At the system level, at least five advantages are realized: First, there is now one component instead of two to source and install, the cost associated with the new integrated component is less than the previously separate ones; Two, the printed circuit board space formerly required by a separate sounder has been eliminated; Three, the sounder will not interfere with smoke flow due to its position atop the smoke cage; Four, the sound pressure level will be high enough to easily meet or exceed the UL 217 requirements. Finally, future designs using this device should require less time to develop as many common mistakes in physical layout will be avoided because the package prevents them.

With further reference to FIGS. 2*a* and 2*b*, the particle sensor 200*a*, 200*b* is shown to include an optics block 250*a*, 250*b* and a optic block cover 253*a*, 253*b* mounted to the printed circuit board within the smoke cage. Preferably, the optics block is positioned off center with respect to the smoke cage. The optics block is shown to include a light source 251*b*, having electrical leads 251*a*, and an optical transducer 252*b*, having electrical leads (not shown). In at least one embodiment, the light source is either selected from known light sources or those taught in commonly assigned U.S. Pat. Nos. 5,803,579, 6,335,548, 6,521,916 and 6,550,949 and U.S. patent application Ser. Nos. 09/723,675 and 10/078,906, the entire disclosures of which are incorporated herein by reference. In at least one embodiment, the optical transducer is selected from known transducers or those taught in commonly assigned U.S. Pat. Nos. 6,313,457, 6,359,274, 6,374,013 and 6,469,291 and U.S. patent application Ser. Nos. 10/043,977 and 10/068,540, the entire disclosures of which are incorporated herein by reference. In embodiments that so require, additional leads 351*b*, 352*b* and, or, corresponding printed circuit board receptacles 311*b*, 312*b* are provided.

In a preferred embodiment, the smoke cage is a domed smoke cage having alignment pins and, or, stakes 229*b*. In a related embodiment, the optic block cover comprises posts 254*b*. The printed circuit board 210*a*, 210*b* is configured with mating receptacles for each of the pins, stakes and posts. These features provide for precision alignment of the printed circuit board, the optics block, the optic block cover and the smoke cage relative one another. This enhances the repeatability of the particle sensors operationally with respect to one another, in turn, reducing the need to individually calibrate a given sensor assembly.

The printed circuit board 210*a*, 210*b* is positioned along with battery 215*a*, 215*b* in a bracket 207*a*, 207*b*. The bracket is depicted in functional relationship with a mount 205*a*, 205*b*. Preferably, the mount is configured to be attached to a support structure (not shown) using a somewhat fixed attachment means as known in the art. The bracket is preferably configured for quick mounting and removal of the particle sensor.

An aesthetic cover 235*a*, 235*b* is provided with a sound grill 245*a* substantially aligned with the sounder assembly 220*a*, 220*b*. The aesthetic cover preferably cooperates with the bracket and, or, the smoke cage at 260*a* and 265*a* to function as ductwork directing airflow through the bug screen 226*a*, 226*b* and through the smoke cage. A substantially flat portion 228*a*, 228*b* is provided in the otherwise substantially cylindrically shaped bug screen to encourage airflow over the power supply and through the smoke cage. In a preferred embodiment, the corresponding airflow is substantially aligned with the "sweet spot" 270*a* (the ductwork and sweet spot are described in more detail in at least FIG. 8 and its related discussion). It should be understood that the sweet spot may extend as shown with the dashed line extending near 270*a*.

In a preferred embodiment, a sounder 220*a*, 220*b* having an audio element 221*a* is positioned atop the smoke cage and engaged at 276*a*. The sounder may be permanently or removably engaged with the smoke cage. Preferably, the sounder and smoke cage is secured to the printed circuit board, again either permanently or removably. Preferably, when the printed circuit board is engaged within the bracket and the aesthetic cover 235*a*, 235*b* is put in place, the aesthetic cover presses upon the sounder at 275*a*, the sounder is pressed upon the smoke cage at 276*a*, the smoke cage is pressed upon the printed circuit board at 277*a* and the printed circuit board is pressed upon the bracket at 278*a*. When the bracket is engaged with the mount, pressure is exerted at 279*a*. In at least one embodiment, these features cooperate to facilitate a snap together particle sensor. Additionally, the soldered wire connections to the sounder may be replaced by spring tension contacts, or the like, when the sounder is positioned on top of the smoke cage.

Low profile particle sensors are popular, however, from a functional standpoint; a tall aesthetic cover is often times functionally superior to a low cover with respect to encouraging particles to enter the smoke cage. This is especially true at low airspeeds.

FIGS. 3*a*, 3*b*, 3*c*, and 3*d* depict another embodiment of a particle sensor 300*a*, 300*b*, 300*c*, 300*d*. Positioning the sounder 320*b*, 320*c*, preferably comprising a piezoelectric audio element, toward the aesthetic cover 335*a*, 335*b*, 335*c*, from the sweet spot results in a low profile particle sensor retaining improved audio output distribution and, or, sound pressure levels in various embodiments. In at least one embodiment, having the sounder mounted on the aesthetic cover in lieu of being within the path of airflow through the detector, results in a sensor with low sensitivity variations with respect to mounting orientation. Positioning the sounder on the opposite side of the optics block and, or, printed circuit board from the smoke cage may also result in a savings of printed circuit board 310*a*, 310*b*, 310*c* surface area. Providing an attachment means directly to the printed circuit board eliminates the need for a base plate. A portion of the printed circuit board becomes the base plate and/or a connection for associated electrical connections. These connections may be pins or sockets integral to the printed circuit board and, or, sounder or may comprise flexible wiring and, or, a connector. Optionally, the electrical connections between the sounder and printed circuit board may be via conductors and, or, connectors integrally molded into either the printed circuit board, smoke cage, sounder, or a combination of these individual elements.

As a sub-assembly, the mechanical steps to assemble the sounder on the printed circuit board are similar as for the formerly distinct pre-packaged sounder alone. Thus, there is also no additional labor cost to assemble the particle sensor having the combined functions. At the system level, at least six advantages are realized: First, there is now one component instead of two to source and install, the combined cost of the new component is much less than the previously separate ones; Two, the printed circuit board space formerly required by a sounder on the same side of the printed circuit board as the smoke cage is eliminated; Three, the sounder will not interfere with smoke flow due to its position outside the sweet spot; Four, the sound pressure level will be high enough to meet or exceed UL 217 requirements, unlike previous designs that place the sounder low in the assembly; fifth, by not soldering the leads, heat provisions necessary for mass soldering can be disregarded at least partially; Finally, future designs using this device should require less time to develop, many common mistakes in physical layout will be avoided because the package prevents them.

With further reference to FIGS. 3*a*, 3*b*, 3*c*, and 3*d*, the particle sensor 300*a*, 300*b*, 300*c*, 300*d* is shown to include an optics block 350*a*, 350*b*, 350*c* and a optic block cover 353*a*, 353*b*, 353*c* mounted to the printed circuit board within the smoke cage. Preferably, the optics block is positioned off center with respect to the smoke cage. The optics block is shown to include a light source 351*a*, having electrical leads 351*b*, 351*c*, and an optical transducer 352*a*, having electrical leads 352*b*, 352*c*. In at least one embodiment, the light source is either selected from known light sources or as taught in commonly assigned U.S. Pat. Nos. 5,803,579, 6,335,548, 6,521,916 and 6,550,949 and U.S. patent application Ser. Nos. 09/723,675 and 10/078,906, the disclosures of which are incorporated in their entirety herein. In at least one embodiment, the optical transducer is selected from known transducers or as taught in commonly assigned U.S. Pat. Nos. 6,313,457, 6,359,274, 6,374,013 and 6,469,291 and U.S. patent application Ser. Nos. 10/043,977 and 10/068,540, the disclosures of which are incorporated in their entirety herein. In embodiments that so require, additional leads (similar to 351*b*, 351*c*, 352*b*, 352*c*) and, or, corresponding printed circuit board receptacles (similar to 311*b*, 312*b*) are provided.

Figure 6:
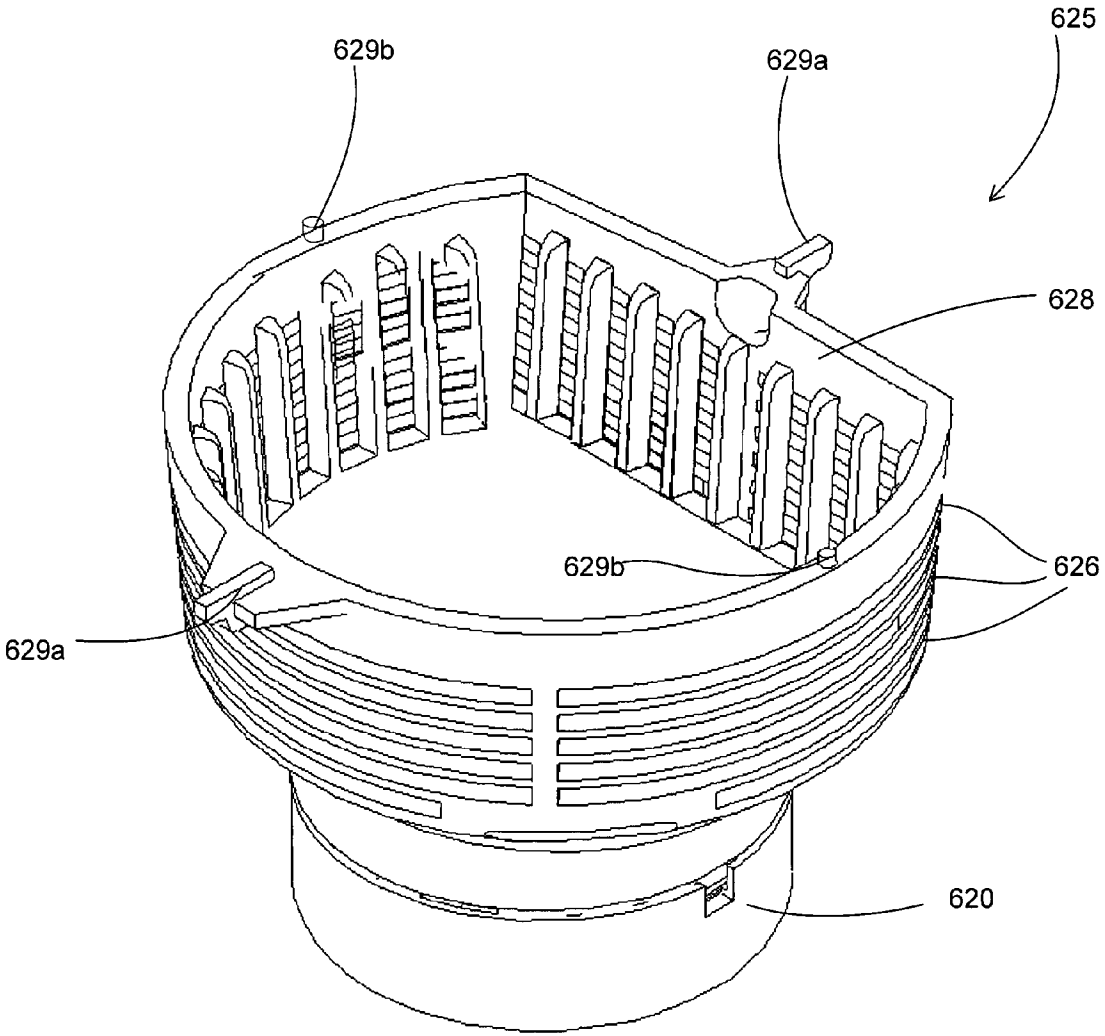
FIG. 6 depicts a perspective view of the smoke cage of the particle sensor embodiment of FIGS. 2*a* and 2*b;*

In a preferred embodiment, the smoke cage is a domed smoke cage, shown in detail in FIG. 6, having alignment pins 329*b*, 329*c*. In a related embodiment, the optic block cover comprises posts 354*b*, 354*c*. The printed circuit board 310*a*, 310*b*, 310*c* is configured with mating receptacles 314*b* for each of the pins and, or, posts 354*b*, 354*c*. These features provide for precision alignment of the printed circuit board, the optics block, the optic block cover and the smoke cage relative to one another. This enhances the repeatability of the sensor assemblies operationally with respect to one another, in turn, reducing the need to individually calibrate a given sensor assembly.

The printed circuit board 310*a*, 310*b*, 310*c* is positioned along with battery 315*a*, 315*b*, 315*c*, 315*d* in a bracket 307*b*, 307*c*. The bracket is depicted in functional relationship with a mount 305*a*, 305*b*, 305*c*. Preferably, the mount is configured to be attached to a support structure (not shown) using a somewhat fixed attachment means as known in the art. The bracket is configured to engage the mount.

An aesthetic cover 335*a*, 335*b*, 335*c* is provided with a sound grill 345*b*, 345*c* substantially aligned with the sounder 320*b*, 320*c*. The aesthetic cover preferably cooperates with the bracket and, or, the smoke cage at 360*a* and 365*a* to function as ductwork directing airflow through the bug screen 326*a*, 326*b*, 326*c* and through the smoke cage. A substantially flat portion 328*b* is provided in the otherwise substantially cylindrically shaped bug screen to encourage airflow over the sounder and through the smoke cage. In a preferred embodiment, the corresponding airflow is substantially aligned with the "sweet spot" 370*a* (the ductwork and sweet spot are described in more detail, at least in connection with FIG. 8). It should be understood that the sweet spot may extend as shown with the dashed line extending near 370*a*.

In a preferred embodiment, the sounder and smoke cage are secured to the printed circuit board, again either permanently or removably. Preferably, when the printed circuit board is engaged within the bracket and the aesthetic cover 335*a*, 335*b*, 335*c* is put in place, the aesthetic cover presses upon the printed circuit board at 377*a*, the printed circuit board is pressed upon the smoke cage at 376*a* and the smoke cage is pressed upon the bracket at 375*a*. In at least one embodiment, these features cooperate to facilitate a snap together particle sensor.

In at least one embodiment, the battery 315*a*, 315*b*, 315*c*, 315*d* is held in a battery access case 363*c*, 363*d* which may or may not be completely removable. This battery access case facilitates changing batteries, especially in that the owner does not have to remove the particle sensor from it's mounting to change the battery. The battery access case is configured to prevent access to any energized circuitry.

In at least one embodiment the battery access case comprises a tray 361*c*, 361*d* into which a power supply can be inserted. When the battery is a 9V battery the battery access case can be keyed with a large diameter hole 364*d* and a small diameter hole 365*d* to prevent the battery from being inserted backwards. Preferably the small diameter hole 365*d* is large enough to admit the small battery contact and yet small enough to deny the large battery contact. When the small diameter hole is properly sized, the large diameter hole need not be a hole at all as long as the battery terminal is capable of electrical connection with the contact 360*d*. However, it may be preferable to provide both holes as a guide to the user of the correct polarity.

Electrical contacts 360*d* are coupled to circuit board 310*a*, 310*b*, 310*c* to provide power from battery 315*a*, 315*b*, 315*c*, 315*d* when the battery access case is in the closed position. Contacts 360*d* may be formed from flexible conductive material which functions like a spring to ensure physical contact between itself and the associated printed circuit board pads. This feature overcomes a common safety concern associated with battery backup devices in that the action of sliding and/or pivoting the door away from the housing 335*a*, 335*b*, 335*c* simultaneously severs the electrical connection with the battery 315*a*, 315*b*, 315*c*, thereby keeping the operator safe from touching any energized circuitry while changing the battery 315*a*, 315*b*, 315*c*, 315*d*. Hole 362*c*, 362*d* can be configured for use as a finger pull to allow a user to easily open the access case. Optionally, a tamper pin (not shown), can be placed through hole 362*c*, 362*d* and further connected through bracket 307*a*, 307*b*, 307*c* to prevent the battery access case from accidentally or unintentionally opening. In at least one embodiment, the particle sensor comprises at least one indicator 347*b*, 348*b* and, or, at least one actuator 346*b*, 346*c*. The indicators may be employed as status enunciators. The manually operable actuator or actuators may facilitate testing and, or, calibration.

In at least one embodiment, sensitivity of the particle sensor is improved. In a related embodiment a particle sensor having airflow in a direction substantially perpendicular to a planar surface of the printed circuit board is provided. In at least one embodiment, the associated time and labor costs of design are lowered by allowing the components to be placed in areas that would previously have adversely effected airflow into or out of the smoke cage. In at least one embodiment a particle sensor is provided with little to no change in sensitivity with respect to a change in mounting position. In doing so other advantages including ease of part placement and clean-ability of the smoke cage are achieved.

According to another embodiment, a smoke cage is an arrangement of elements configured to direct the airflow substantially perpendicular to a planar surface of the printed circuit board, as depicted in FIGS. 4, 4*b*, 4*c*, 4*d*, 4*h*, and 4*i*. In one embodiment a smoke cage is an arrangement including a portion of the PCB, a portion of the aesthetic cover, a chimney and an optics block. Modifying and, or, adding components to the typical particle sensor may help to direct the airflow. The airflow may thus be directed through the plane of the printed circuit board, chimney, and out the aesthetic cover into the ambient surroundings or vice versa.

Figure 4A:
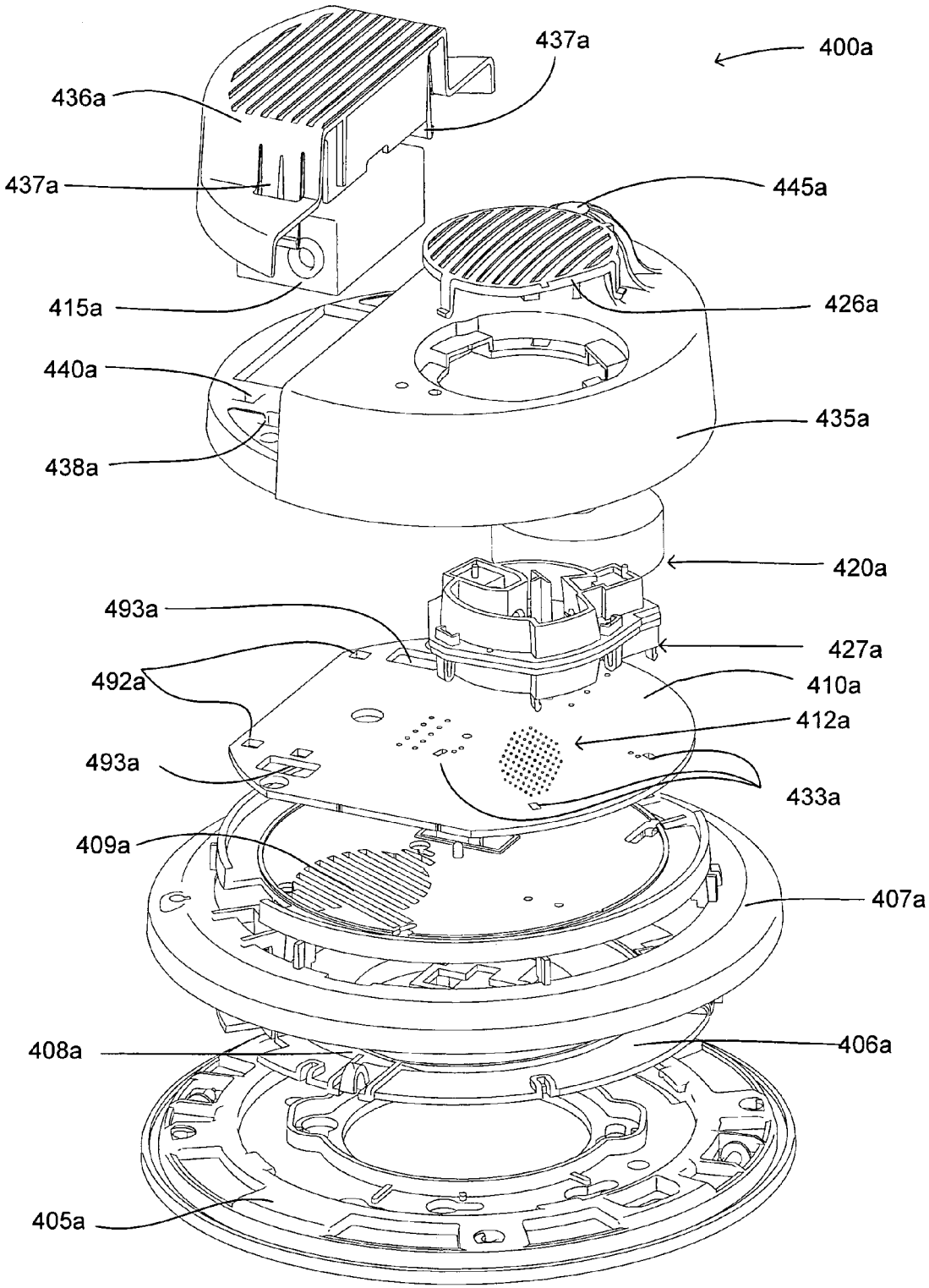
FIG. 4*a* depicts an exploded, perspective, view of a particle sensor.
Figure 4B:
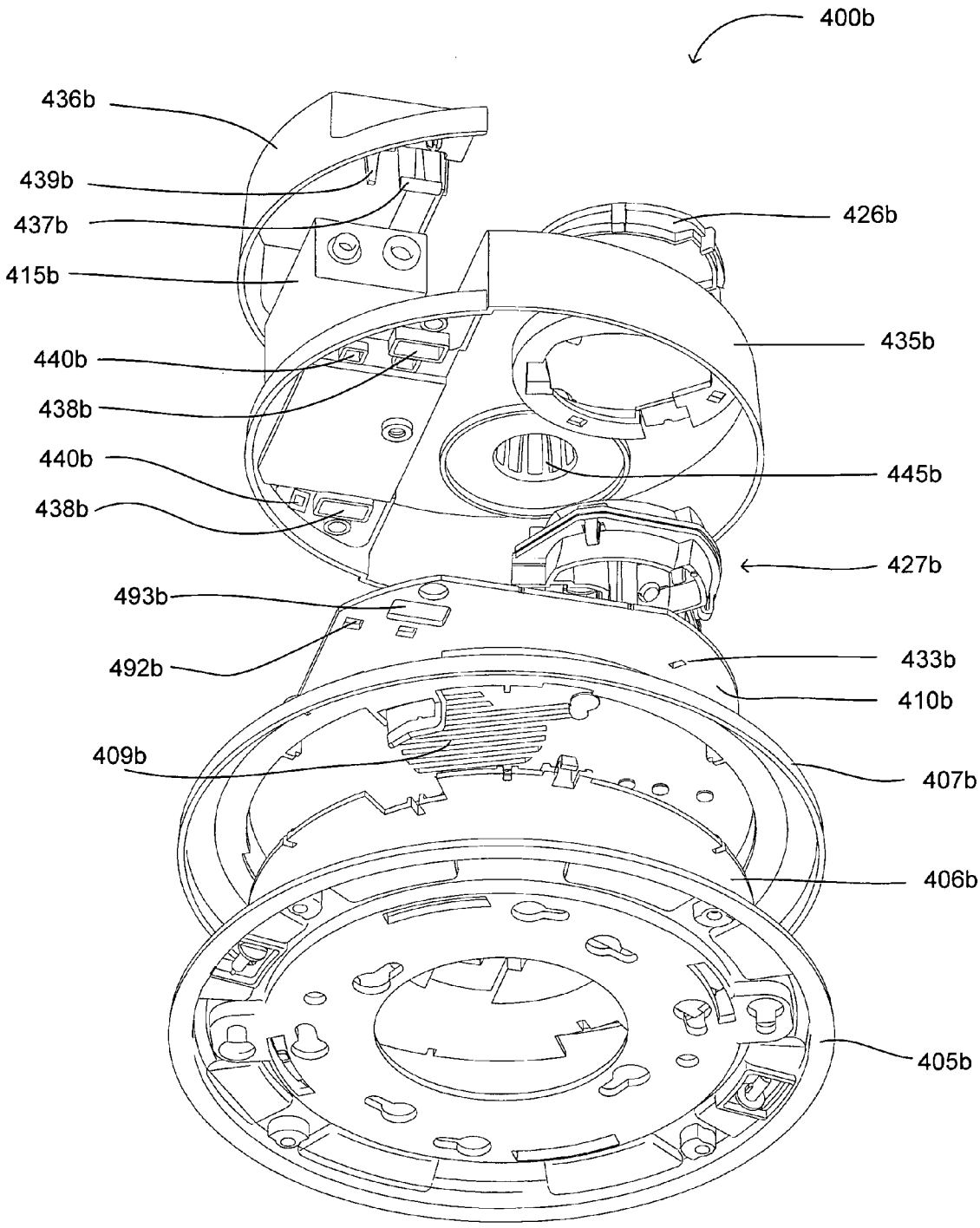
FIG. 4*b* depicts an exploded, perspective, view of a particle sensor.
Figure 4C:
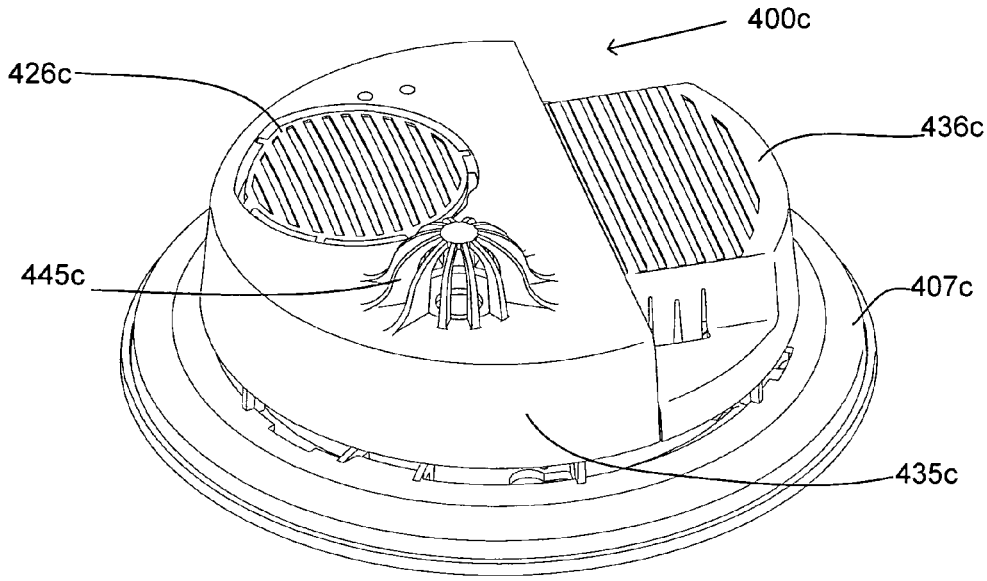
FIG. 4*c* depicts a perspective view of a particle sensor.
Figure 4D:
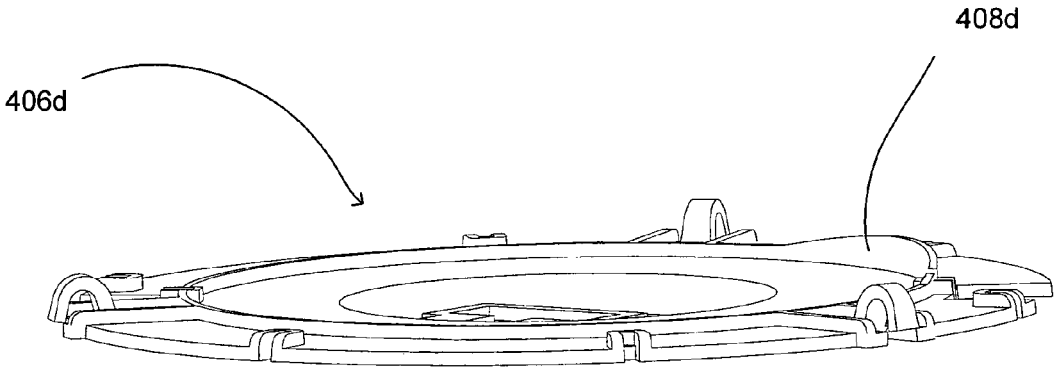
FIG. 4*d* depicts an exploded partial, perspective, view of a particle sensor.
Figure 4E:
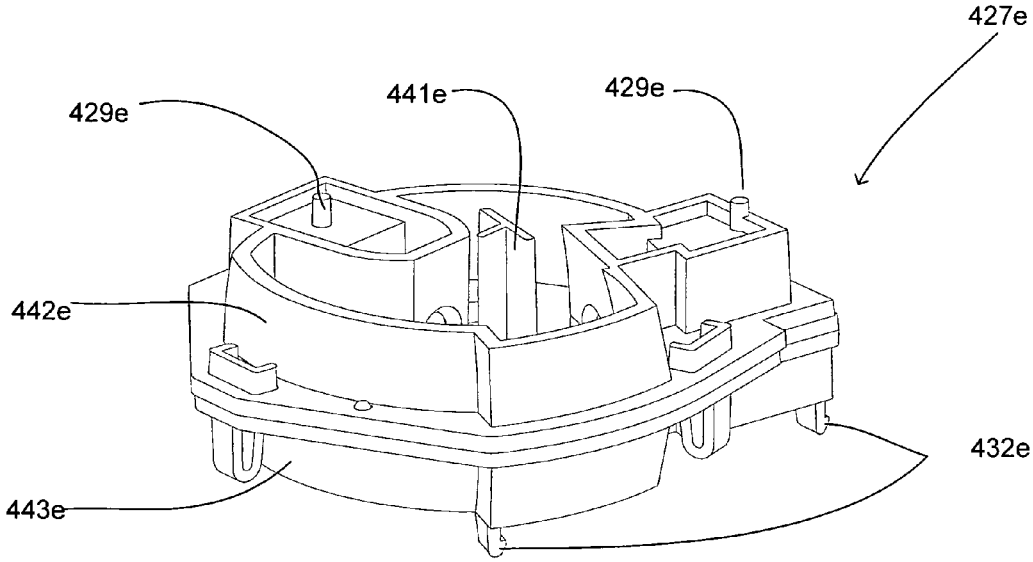
FIG. 4*e* depicts a perspective view of a chimney.

FIGS. 4*a*, 4*b*, and 4*c* depict another embodiment of a particle sensor 400*a*, 400*b*, 400*c*. By manipulating the shape, size, texture, placement, any combination of or sub combination thereof, of the at least one ridge or foil 408*a*, 408*d*, the sensitivity to incoming particles can be made substantially independent of the angle of rotation about an axis which is perpendicular to the top surface of the printed circuit board. The mount 405*a* may be secured to a wall or ceiling of a building with fasteners, as described elsewhere herein. The bracket 407*a*, 407*b*, 407*c*, is preferably configured to slidingly and/or rotatably engage mount 405*a*, 405*b*. The airflow director 406*a*, 406*b*, 406*d* may be "snapped" into place between 407*a*, 407*b*, 407*c*, and mount, or may be an integral part of either the mount and/or bracket. The printed circuit board (PCB) 410*a*, 410*b* may also be "snapped" into place on bracket, or otherwise secured with known fasteners either permanently or removably. The chimney 427*a*, 427*b*, 427*e*, 427*f*, 427*g*, 427*h*, 427*i*, 427*j* is preferably "snapped" into corresponding receivers 433*a*, 433*b*, which may be made integral to the PCB. The PCB 410*a*, 410*b* preferably has a series of holes or a screen 412*a*, the function of which is discussed elsewhere herein. The sounder assembly 420*a* may be soldered to the PCB 410*a*, 410*b* or made integral with the aesthetic housing 435*a*, 435*b*, 435*c* as discussed elsewhere herein. The battery 415*a*, 415*b* may be housed under the battery access case 436*a*, 436*b*, 436*c* in order to maintain aesthetics and/or for enhanced safety. The battery access case includes two sets of contacts which are discussed in detail elsewhere. The aesthetic cover 435*a*, 435*b*, 435*c*, optionally, integrally includes sounder cover 445*a*, 445*b*, 445*c* which functions similar to sound grills, 145, 245*a*, 345*b*. In another embodiment, the sounder cover 445*a*, 445*b*, 445*c*, is removably attached to aesthetic cover. The smoke cage cover 426*a*, 426*b*, 426*c*, optionally, includes louvers and may be made integral with aesthetic cover. As shown in FIGS. 4*a*, 4*b*, and 4*c*, the smoke cage cover may be made to clip or snap into the aesthetic cover, providing a removable smoke cage cover 426*a*, 426*b*, 426*c*. This will allow the user an easy access point for periodic cleaning of the smoke cage, including the chimney. Optionally the particle sensor, when assembled, may include a locking pin 494*h*. Many of the individual parts described above are also envisioned to be fastenable with known fasteners and processes, including screws, adhesives, solder, heat staking, and the like.

Two important considerations in placement of the smoke cage are speed of detection and directionality. In this embodiment the best directionality, without adding a ridge or foil, is achieved by placing the smoke cage in a central location. One major problem with this is that the sounder cannot be placed next to it due to size restrictions, specifically diameter, since it is not desirable to make the particle sensor larger. Another deficiency of this central position is the response speed which in this case is rather slow. With respect to speed, a much faster response time is achieved by placing the smoke cage near an outer edge of the particle sensor. Another benefit to this placement is that the sounder can also easily be accommodated without increasing the size of the particle sensor. However, the problem associated with positioning the smoke cage near an outer edge of the particle sensor is uneven directional sensitivity. When placed near an outer edge, sensitivity is highest corresponding to the direction with the shortest path to the ambient environment and significantly lower with respect to the direction corresponding to the longest path to ambient. This problem can be overcome by restricting airflow into the high sensitivity side in order to balance the sensitivities. Balance may preferably be achieved through at least one ridge or foil 408*a*, 408*d*.

As stated above, at least one embodiment provides a particle sensor with little to no change in sensitivity with respect to a change in mounting position. This may be achieved through the use of the airflow director 406*a*, 406*b*, 406*d* which, optionally, comprises at least one ridge or foil 408*a*, 408*d* to direct the airflow through the grating 409*a*, 409*b* which are formed integral to bracket 407*a*, 407*b*, and 407*c*. The at least one ridge or foil may be any shape, size, texture, orientation, combination of or sub combination thereof necessary to encourage airflow through the smoke cage, including the chimney 427*a*, 427*b*. The quantitative results of using element 408 are discussed later in connection with FIGS. 16*a-d*.

Figure 4F:
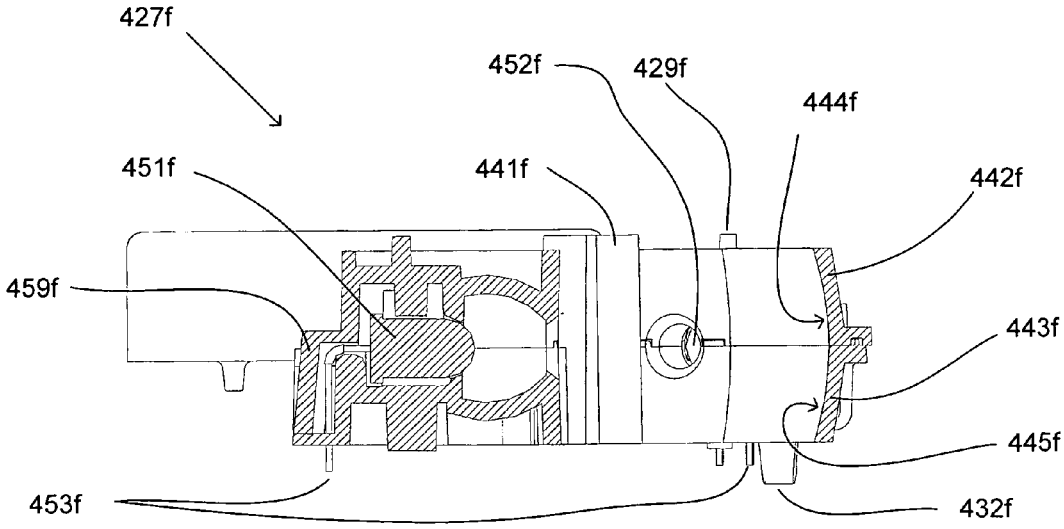
FIG. 4*f* depicts a profile view of a chimney.

The path air takes when encountering a particle sensor, fastened to a wall or ceiling, is similar to that of air flowing over a plane's wing. As best illustrated by FIGS. 4*h* and 4*i*, a portion of the airflow will follow a first path 497*i*, through the gaps provided in bracket 407*i*. Another portion of the airflow will follow a second path 496*i*, over the aesthetic cover 435*i*. A portion of the airflow following path 497*i* will also be diverted upward, preferably with the aid of the airflow director 406*a*, 406*b*, 406*d* comprising at least one ridge or foil 408*a*, 408*d*, this airflow takes a third path 495*i*. Similar to a plane's wing the portion traveling over the aesthetic cover will move faster creating a slight vacuum over smoke cage cover 426*i*. This pressure differential helps pull some of the air moving along the first path 497*i* up through elements 410*i*, 427*i*, and 426*i* along a third path 495*i*. By tailoring the optionally at least one ridge or foil 408*a*, 408*d* quoted sensitivity can often be gained, substantially independent of variations in air flow direction. In its simplest sense the airflow director is meant to enhance or inhibit airflow from areas or directions having a non ideal sensitivity in order to provide a particle sensor with near uniform sensitivity to all directions, thereby overcoming the afore mentioned problems. As will be described later by adjusting the airflow director a uniformity or about 90% or greater can be achieved (i.e. less than 10% difference in the sensitivity with respect to direction.) Another feature of this invention is that substantial directional characteristic changes can be made late in the design process without forcing new PCB designs. It may also be advantageous to use at least one ridge or foil on any of the other embodiments to balance directional sensitivities and thus decrease the probability of false alarms.

In a related embodiment the chimney 427*e*, 427*f*, 427*g*, 427*h*, 427*i*, and sounder are combined and may be placed centrally within the aesthetic cover. This may be possible by placing the piezoelectric element atop of the chimney wherein the chimney has an annular support ring on its top open side for supporting the piezoelectric element. The annular support ring is preferably interrupted so that the piezoelectric element does not seal off the top of the chimney. In this embodiment the volume of the smoke cage may also be controlled so the chamber may function as a resonant cavity for the piezoelectric element. By following the principles of the Helmholtz formula it is possible to place the sounder and smoke cage centrally in the particle sensor. Further if configured properly the tuned cavity may provide improved sound output when compared other embodiments which use a component or separate approach.

As depicted in FIGS. 4*e*, 4*f*, 4*g*, 4*h*. and 4*i*, the chimney 427*e*, 427*f*, 427*g*, 427*h*, 427*i*, according to the fourth embodiment is structurally different from previous designs. In order for the chimney 427*a*, 427*b*, 427*e*, 427*f*, 427*g* to facilitate the detection of particles, which are otherwise flowing in a direction perpendicular to the solid walls 442*f*, 443*f* of the chimney, the airflow path is preferably directed upward through the open sides of the chimney. This is preferably aided by simple modification of elements, including the aesthetic cover 435*a*, 435*b*, 435*c* and/or the printed circuit board 410*a*, 410*b*, as will be discussed in more detail. In some embodiments the term "smoke cage" refers to the physical housing in which an associated optics block is placed for detecting particles, which typically enter through louvers that are often made integral to the "smoke cage". The smoke cage associated with this embodiment, best depicted in FIG. 4*j*, may be more easily envisioned as a chimney with the optics block built into it, hence the name "chimney". Although it will still be referred to as a "smoke cage" herein when referring to the function it performs or the entire structure associated with it. As seen in FIG. 4*j* the smoke cage of this embodiment comprises a chimney 427*j*, made integral with the optics block. As discussed elsewhere the smoke cage 425*j* may also comprise a portion of the PCB, 410*j*, a portion of the aesthetic cover, 435*j*, and optionally a removable smoke cage cover 426*j*. Note that in FIG. 4*j* elements 410*j* and 435*j* are shown only partially for clarity.

As illustrated in FIG. 4*i*, in one embodiment, the airflow is directed through at least the PCB 410*i* and aesthetic cover 435*i*. In light of the effect of gravity settling dust particles on surfaces perpendicular to its "pull" the particle sensor in accordance with this embodiment is best suited for a ceiling mount that results in associated sensitive surfaces being parallel to the "pull" of gravity. However, with the addition of a removable smoke cage cover 426*a*, 426*b*, 426*c*, dust contamination issues are less of an issue. This smoke cage configuration provides designers the ability to more easily place parts on the PCB, without detrimental effects to airflow. The smoke cage is also easy to manufacture and smaller than previous devices, allowing cost savings on materials including the aesthetic cover, the printed circuit board, and the chimney itself.

Another benefit to this configuration is that the elements being placed on the printed circuit board 410*a*, 410*b* no longer interfere with the airflow through the smoke cage. This allows for much more flexibility in circuit board design, leading to time savings and allowing numerous ideas and concepts, some previously abandoned because they shielded the airflow of previous smoke cages, to be utilized. In a related embodiment the space between the printed circuit board perimeter and the inside surface of the aesthetic cover is sealed off. This may be desirable to aid in directing airflow through the chimney as there would be no parallel paths, for the airflow, through the aesthetic cover without traveling through the chimney.

Figure 4G:
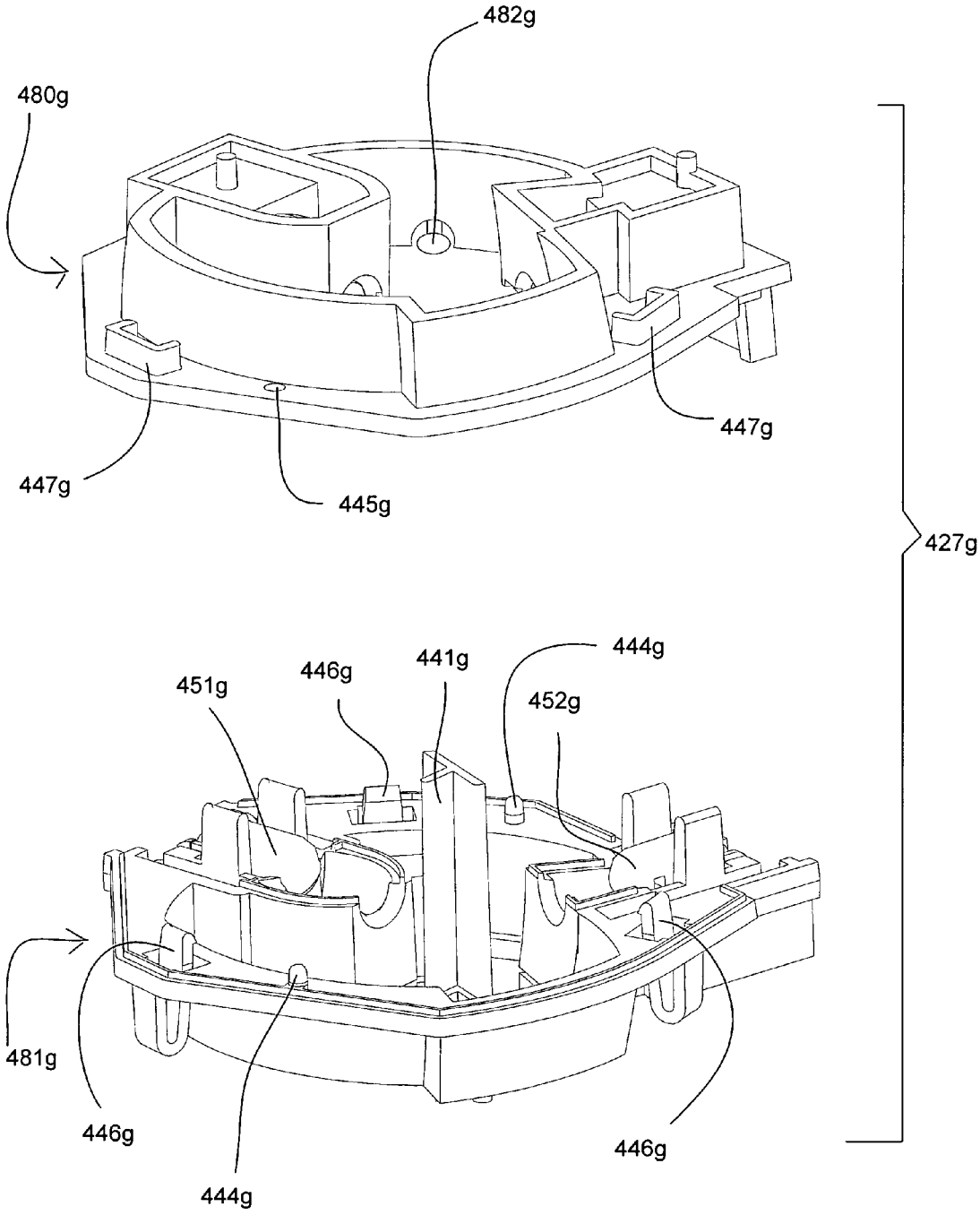
FIG. 4*g* depicts a perspective, exploded, view of a chimney.
Figure 4H:
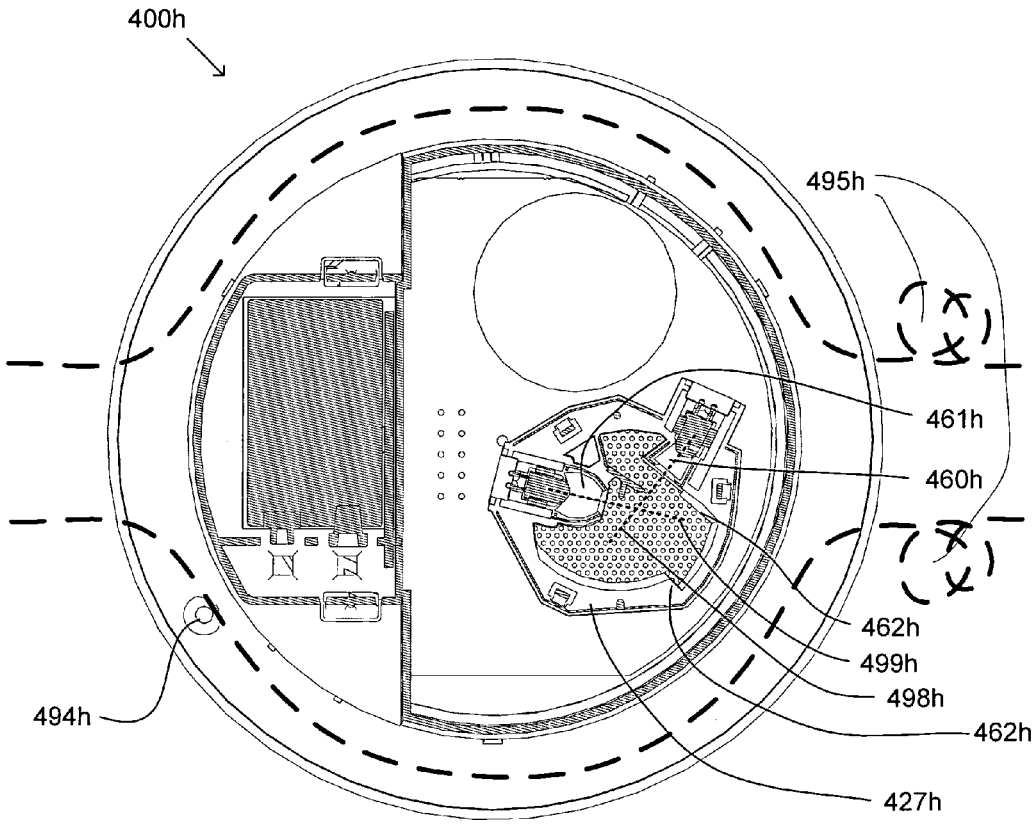
FIG. 4*h* depicts a plan view of a particle sensor.
Figure 4I:
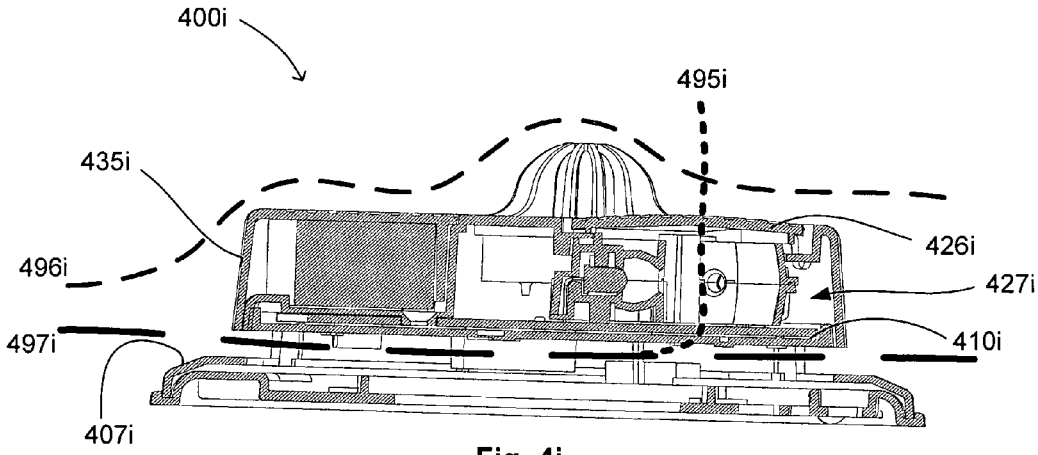
FIG. 4*i* depicts a profile view of the particle sensor.

As seen in FIG. 4*g*, the chimney 427*g* of this embodiment may comprise a top portion 480*g* and a bottom portion 481*g* which cooperate, and preferably "snap" together. The snaps 446*g* cooperate with receivers 447*g*, one of which is not visible in FIG. 4*g*, to mechanically couple the two portions together via a spring action as known in the art. As shown the snaps may be configured to allow separation of the two portions without damage to the chimney or snaps. When assembled the chimney functions to hold light source 451*g*, optical transducer 452*g*, and optional thermal sensor 482*g* firmly in place. As seen in FIG. 4*g*, alignment pins 444*g* cooperate with alignment holes 445*g* to assure correct placement. In at least one embodiment, the process of snapping the top and bottom portions together will also bend the leads into the proper orientation such that they are set for insertion into mating holes in a PCB. As seen in FIG. 4*f* formed element 459*f*, integral to the top portion, may be configured to bend the leads as the top portion is being snapped together with the bottom portion. In at least one embodiment the leads are pre-bent into shape allowing the light source and the optical transducer to simply be placed in their respective locations before the two portions of the chimney are combined. It should be understood that any type of fastening device or method can be employed to secure the two portions of the chimney together. Some fastening devices and, or, methods include heat staking, glue, ultrasonic welding, and the like.

The position of the light source and optical transducer may thus be dictated by the portions of the chimney. Preferably the primary optical axis of the light source is perpendicular to the top surface of the printed circuit board. This may be preferable since the effects of gravity on sensitive surfaces, including the reflecting walls of the chimney, may be minimized.

When fully assembled, the inventive chimney may be configured to snap into the PCB 410*a*, 410*b* by way of holes 433*a*, 433*b*, 433*c* accepting snap connectors 432*e*, and 432*f*. This connection may also be made by metal leads soldered through a hole in the PCB (not shown) or heat staked through the PCB. In at least one embodiment, at least a portion of the chimney is metalized to prevent unwanted electrical interference. A metal die cast may be preferable to use for its ease of molding and relatively low cost. It may be useful to electrically couple at least a portion of the metalized chimney to the PCB, specifically to a ground plane or node on the PCB. It is recognized that when the chimney is at least partially metalized, consideration would be give to any electrical leads in contact or nearby said metalized portion. Electrical leads of the optical transducer, light source, and optional thermal sensor may be insulated.

The chimney 427*a*, 427*b*, 427*e*, 427*f*, 427*g*, 427*h*, 427*i*, has curved inner walls 444*f*, 445*f* in order to control internal reflections from the light source. As described herein, by controlling internal reflections, the signal to noise ratio can be greatly improved. The walls of the chimney act as reflectors to redirect light rays within the chimney such that, without the presence of particles in the airflow, a minimal amount reaches the optical transducer. In one embodiment, substantially all light rays emitted from the light source are directed back toward the source. In another embodiment approximately 70% of light is directed back toward the source while the rest is directed toward a "light trap" 462*h*. Preferably the primary optical axis of the light source and optical transducer is substantially parallel to the printed circuit board and therefore also substantially perpendicular to the intended airflow.

As best seen in FIG. 4*h*, the chimney contains pre-chambers 460*h* and 461*h*. One advantage of using integrally molded pre-chambers 460*h*, 461*h* is that standard light sources and optical transducers may be used without special lenses (e.g. collimating or other types). A specific set of angles, in which light may travel, is determined by the shape, size, and orientation of the openings in the pre-chambers. This specific set of angles for pre-chamber 460*h* may or may not be the same as the specific set of angles for pre-chamber 461*h*. The pre-chambers are arranged to allow light to travel from the light source to the optical transducer when particles are present within the chimney. The chimney is preferably designed with a minimal number of corners and/or intricate details which allow dust to accumulate and result in spurious reflections. As depicted, the horizontal airflow 495*h* results from the fact that the housing behaves like a cylinder more than a plane's wing. Spiraling vortexes are created. When placed against a wall, these vortexes tend to create air movement that helps move airflow through the chimney.

Another method of controlling reflections and effecting signal to noise ratio is to provide the inner walls 444*f*, 443*f* of the chimney in a color similar to that of the dust anticipated to settle on said surfaces. Another advantageous implementation of the chimney comprises walls which are made from a material, or finished to simulate the effects of a layer of dust. When a polished or highly reflective coating is used on the interior surfaces a high signal to noise ratio (S/N ratio) is achieved, Preferably about 5 to 1, more preferably about 10 to 1, and most preferably about 20 to 1. However the S/N ratio often degrades faster with highly reflective coatings compared to other less reflective coating choices. For instance, a non-polished or low luster surface yields a S/N ratio of between about 1 to 1 and about 4 to 1. While a lower initial signal to noise ratio may seem undesirable, it often provides the benefit of prolonged stability, i.e. a particle sensor more tolerant to dust. This is particularly beneficial when it is desirable to use a fixed threshold controller, such as the Motorola MC145010 or MC 145012 application specific integrated circuits. The benefit being that the signal to noise ratio will not degrade as much, or as fast as if the surface was coated with the highly reflective coating. Lower reflecting surfaces provide a particle sensor which is more stable over time, thereby, creating less false alarms.

As stated above the smoke cage according to the embodiment depicted in FIGS. 4*a* through 4*i* may not function as efficiently as possible without the aid of a new airflow path 495*i* created by modifications to at least elements 435*i* and 410*i*. In at least one embodiment, the modification to element 435*i* is to create a smoke cage cover 426*a*, 426*b*, 426*c*, 426*i* which is capable of being removed. This aids in cleaning the smoke cage, including the chimney 427*a*, 427*b*, 427*e*, 427*f*, 427*g*. Preferably smoke cage cover is replaced via snapping into place or twisting and locking as commonly known in the art of removable fastening. The smoke cage cover 426*a*, 426*b*, 426*c*, 426*i* functions to block incoming light and large particles or bugs, and still allow air to flow through it. In at least one embodiment, this function is achieved by providing louvers. Printed Circuit Board (PCB) 410*a*, 410*b*, 410*i* is another component that functions to encourage air to flow through at least a portion of it. In at least one embodiment, a portion of the PCB that encourages airflow through it is created by drilling or punching holes through the PCB. It may also be desirable to at least partially remove a portion of the printed circuit board altogether. Partial removal can be accomplished by, for example, routering, etching, punching, etc. In a related embodiment, a portion of the circuit board is removed, or not created, and replaced with a component functionally equivalent to the holes or louvers. Such structures may be made from plastic, metal, cloth, or fibers. It may be beneficial to provide a cloth or mesh screen instead of a series of holes. In yet another embodiment a portion of the PCB is at least partially removed and replaced by an integral chimney and bug cage. This integral structure may be similar to that of chimney 427*a*, 427*b*, 427*e*, 427*f*, 427*g*, with the addition of having a bottom plate molded from plastic to function as a bug screen. As in other embodiments it may be desirable to configure the integral chimney and bug cage for snap in insertion.

Since both the modified PCB and the modified smoke cage cover encourage air to flow into and out of the particle sensor, they must also meet or exceed associated codes provided to ensure that insects and other objects do not make their way into the smoke cage. Preferably the holes, louvers, or other means of encouraging airflow, are configured to allow airflow while blocking a 0.05" rod from entry. In at least one embodiment, an airflow director 406*a*, 406*b*, 406*d* is provided to meet the function of directing the airflow through the particle sensor 497*i* upwards along path 495*i*. Alternatively, airflow may be directed to flow downward, along a similar path 495*i* and then merge with the airflow along path 497*i* to continue its journey out of the particle sensor. Preferably, airflow is directed so as to pass through the sweet spot of the smoke cage which surrounds the intersection point of lines 498*h* and 499*h*.

In one embodiment, at least one thermal sensor 482*g*, such as a thermistor, is positioned inside of the chimney. Typically thermal sensors are limited to locations outside of the aesthetic cover in order to be exposed to an appropriate volume of airflow. These exposed locations increase the risk of electrostatic shock to the device, possibly rendering it inoperable, increase the risk of vandalism to the thermal sensor, increase the cost and/or complexity of the design and/or assembly, and lastly are often found to be aesthetically unpleasant. The airflow achieved through the chimney 427*a*, 427*b*, 427*e*, 427*f*, 427*g* may enable a thermal sensor to be positioned inside the particle sensor assembly, thereby overcoming some or all of the problems discussed above. Various types of thermal sensors can be used including; surface mount, through hole, positive thermal coefficient (PTC), negative thermal coefficient (NTC), linear or non-linear thermistors, directly heated or indirectly heated thermal sensors, any combination of or sub combination thereof. Preferably a through-hole NTC thermistor is placed behind element 441*e*, 441*g*, and is held into place in similar manner to that of the optical transducer and/or light source. In a related embodiment multiple thermal sensors are used, either in parallel or series to obtain accurate measurements of thermal changes. In a related embodiment signal amplification is used to create an appropriate level of signal difference to trigger an alarm.

One advantage to this location is a cost savings associated with wires, connectors, and assembly over other systems since the thermal sensor is now significantly closer to the printed circuit board. Another advantage to positioning the thermal sensor close to the circuit board is that this reduces the noise that can be induced onto the lead wires since they are shorter. Yet another advantage of an internally positioned thermal sensor is a cost savings associated with electrostatic shock protection, and/or theft, and or vandalism as the need for such protection is lessened. The location and orientation of the thermal sensor is chosen so as to have little to no effect on the optical transducer and/or light source transmission and still be in a high volume airflow area. There is no need for a pre-chamber associated with the thermal sensor, unless it is shown to enhance airflow to the thermal sensor. In general, airflow enhancements can be achieved through variation of the at least one ridge or foil 408*a*, 408*d*, the airflow director 406*a*, 406*b*, 406*d*, the aesthetic cover 435*a*, 435*b*, 435*c*, the mount, 405*a*, 405*b*, 405*c*, or any combination thereof.

One way to enhance airflow near the thermal sensor is to vary its orientation with respect to the direction of airflow. With respect to the direction of airflow (see FIG. 4*i*), it may be desirable to tilt the sensor upwards, or downwards, twist it to be parallel, or keep it perpendicular, any combination of or sub combination thereof. For example, when a commonly available disc shaped thermistor is used it may be beneficial to tilt the sensor into the airflow, this is easily achieved by modifying the chimney walls to tilt and hold the sensor down when the two portions are snapped together. In a related embodiment a thermal sensor is used in conjunction with a preset threshold, above which an alarm condition is detected. In another related embodiment a logic system is used, either a micro processor or discrete electronics, including integrating, and/or differentiating circuits may be used. In this embodiment a threshold may also be present, though the advantage is that the rate of change in temperature would be relied upon to predict an alarm condition, thus enabling faster response time to hazards such as fires. Thus, at least one embodiment provides an advantageous location for at least one thermal sensor, and also may reduce the cost and/or complexity associated with incorporating at least one thermal sensor.

Figure 4K:
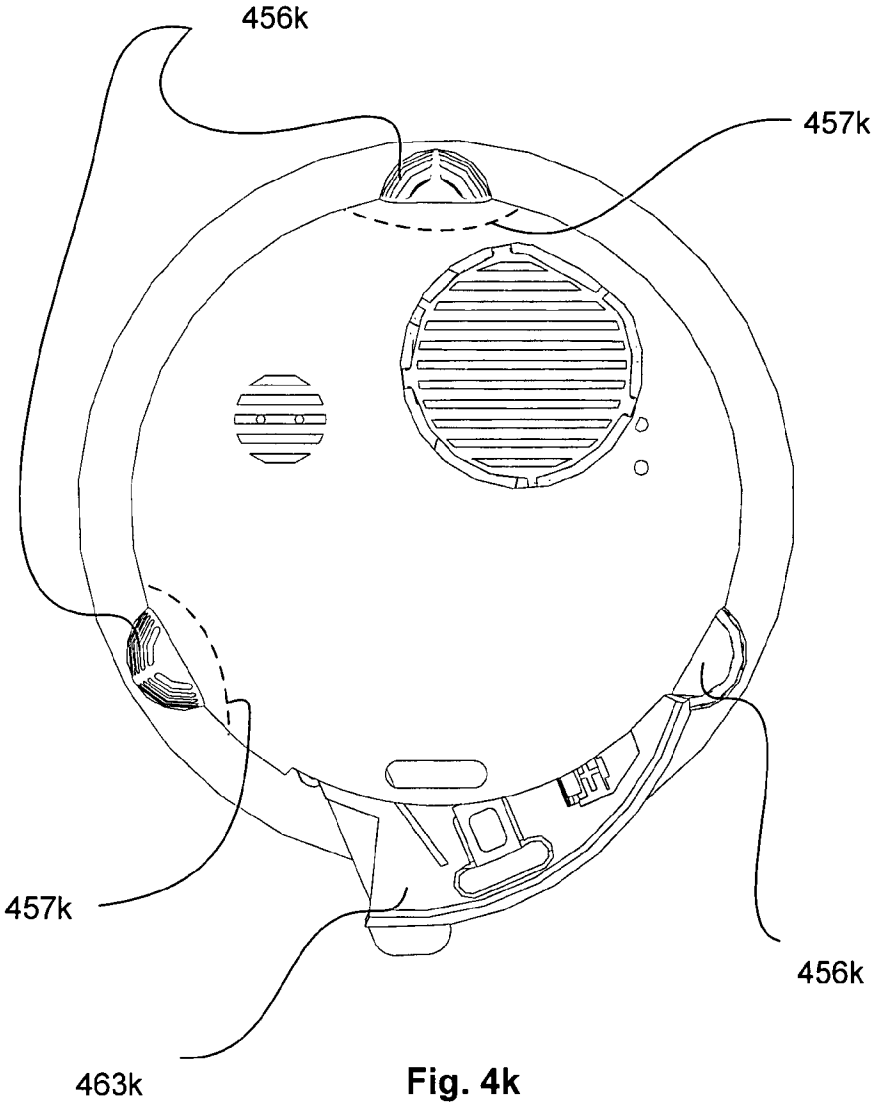
FIG. 4*k* depicts a plan view of an embodiment including thermal sensors.
Figure 4J:
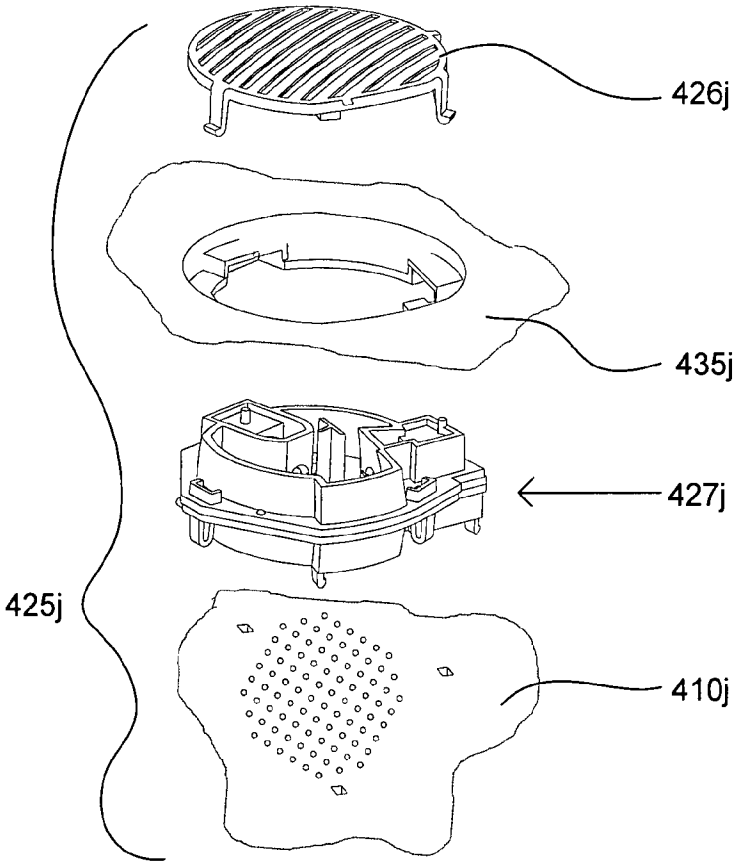
FIG. 4*j* depicts an exploded view of a smoke cage

In another embodiment, 2 thermal sensors are positioned at the perimeter of the aesthetic cover. A single thermal sensor can encounter dead zones typically at about 180 degrees, while having at least two sensors may prevent this if the thermal sensors are properly located. As seen in FIG. 4*k* there are 3 nodules 456*k* present to protect the sensors and maintain airflow. The preferred placement is 120 degrees apart, for aesthetic reasons 3 nodules are present. It may be advantageous to also provide a third thermal sensor, cost and area permitting. When determining whether to alarm, all outputs may be used or one may be chosen and the other or others discarded. In one embodiment two thermal sensors are provided and the third nodule is a used to hide the pivot mechanism for the battery door 463*k*. The battery door in this embodiment is similar to that of element 363 except that it uses a pivot member.

One advantage to placing the thermal sensors on the perimeter of the particle sensor is cost. Thermal sensors are typically isolated from the air coming from inside the particle sensor. This is mainly because this air may have been heated by electrical components. By placing a thermal sensor on top of the housing a seal may be needed, often this is a separate component installed during or after the thermal sensor is installed. The seal may not be necessary as a separate component when the thermal sensors are placed near the perimeter as the aesthetic cover may simply be molded to seal the thermal sensor off from the interior of the particle sensor. In one embodiment the function of sealing off the thermal sensor from the particle sensor is done without additional steps by simply modifying the molding of the aesthetic cover. As seen in FIG. 4*k* the mold may be configured to include an indentation 457*k* to keep the thermal sensor from being exposed to air from inside the particle sensor.

The battery access case 436*a*, 436*b*, 436*c* is an alternate structure which allows a user to replace the battery 415*a*, 415*b* without removing the assembly from its mount 405*a*, 405*b*. Particle sensors are often secured to a wall, ceiling, or electrical junction box by screws (not shown). As can be seen best in FIG. 4*b*, the battery access case preferably has a first set of contacts 437*a*, 437*b*, and a second set of contacts 439*b*, one of which is not shown. Preferably contacts function like springs to engage the corresponding battery terminal. These contacts may be conductive at least on the side which is in contact with the battery terminals. The contacts may be configured to removably snap onto the PCB. Associated conductive materials should not be present where a user has exterior access since this would electrically couple the user to the interior circuits, thereby, creating a shock hazard. Preferably, contacts 437*a*, 437*b*, 439*b* are made electrically conductive, and are preferably made sufficiently long so as to be inserted through the aesthetic cover 435*a*, 435*b*, 435*c* and further snap into PCB 410*a*, 410*b*. In at least one embodiment, electrically conductive material is present on at least two sides of the contacts 437*a*, 437*b*, 439*b* in order to electrically couple to the printed circuit board via metalized holes 493*a*, 493*b*, 492*b*, respectively, and not create a shock hazard to a user. All contacts may be metalized or, optionally, just one set of contacts, which would limit the battery orientation to 1 position. One benefit of metalizing all the contacts (including the compliment to 439*b*, not shown) is that the battery can be inserted with its terminals facing either direction, allowing two different orientations. In this case, holes 492*a* may be made electrically common with each other; the same is true for holes 493*a*. If only one pair of contacts 437*b*, 439*b* is made to be conductive there is only a need to metalize two holes, 493*b* and 492*b*, although it may be beneficial to metalize all four holes 492*a* and 493*a*. By metalizing and making electrically common all four of the holes, some particle sensor designs may feature a first battery orientation and others a second, both using the same PCB layout.

Another approach is to metalize all four holes and elect not to electrically couple the pairs of holes 492*a* and 493*a*. Choosing this approach also facilitates use of common printed circuit boards, but for different purposes, which may be chosen by the battery orientation. Battery installation may be configured to select desired operation (eg. In a first battery orientation the particle sensor may be configured to be powered and work, while a battery in a second orientation will not function to provide power. Optionally, the alternate battery installations perform a different function, such as, a carbon monoxide sensor or combined carbon monoxide sensor and smoke detector.

As seen in FIG. 4*a* the sounder assembly 420*a* is preferably a single assembly capable of being mounted to PCB 410*a*, 410*b* for easy manufacturing. The placement of the sounder is not an issue in this embodiment as it does not block airflow through the smoke cage 425*j*. Alternatively, the sounder assembly 420*a* may be made integral with the aesthetic cover as discussed elsewhere herein. Sound cover 445*a*, 445*b*, 445*c* may, optionally, be made integral with the aesthetic cover. The sound cover 445*a*, 445*b*, 445*c* functions to distribute sound in a uniform manner with minimal attenuation, and to protect the sounder assembly 420*a* from physical damage.

Figure 5:
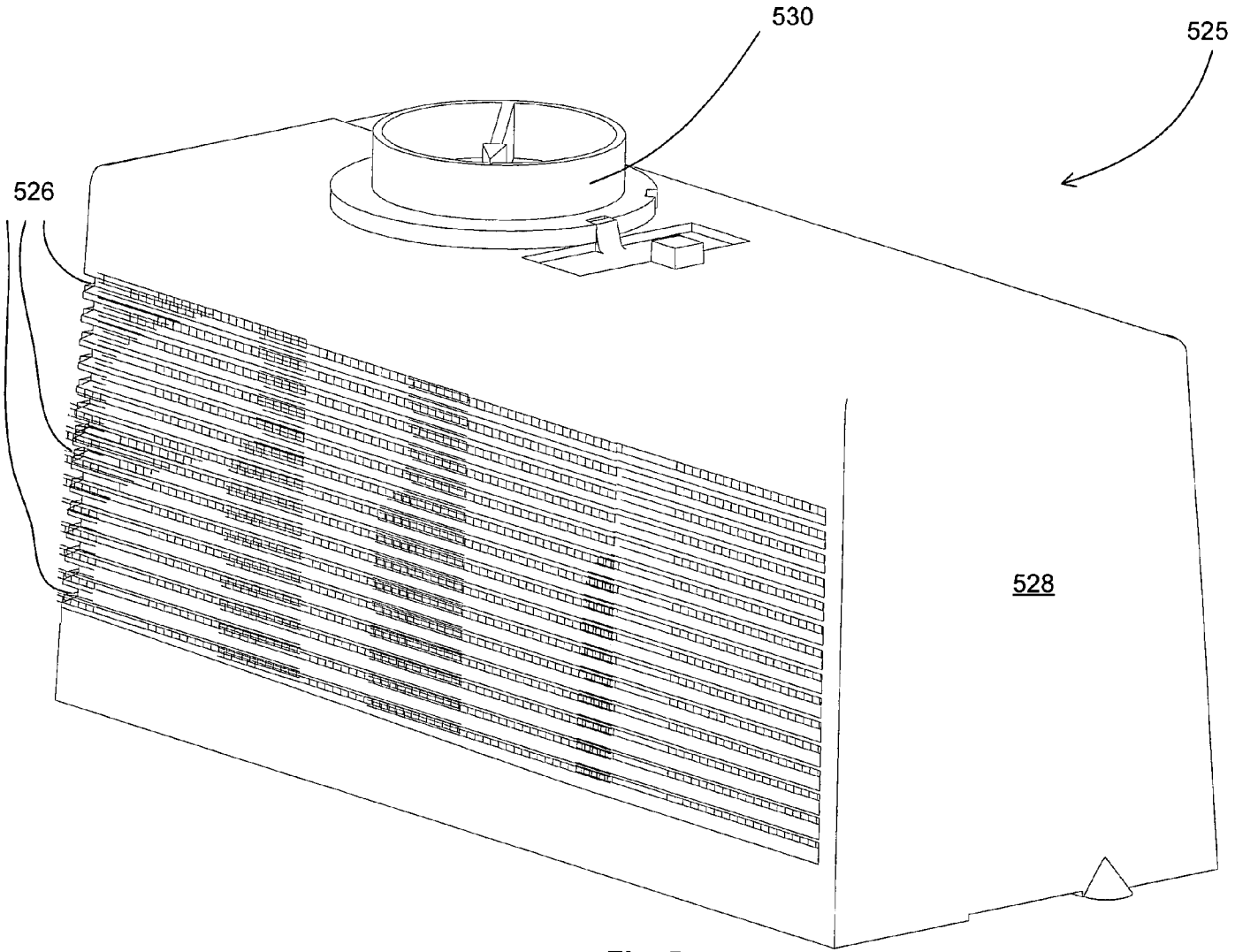
FIG. 5 depicts a perspective view of the smoke cage of the particle sensor embodiment of FIG. 1.

Turning to FIG. 5, there is depicted a smoke cage 525 defining a substantially cubical shape and comprising a bug screen 526 on at least one side and one end. At least one end 528 is solid. This smoke cage is similar to the smoke cage of the particle sensor 100 of FIG. 1. One reason the bug screen does not extend around the entire periphery of the smoke cage is that ambient light rays may otherwise enter the smoke cage. The smoke cage 525 is shown to comprise a test switch 530 for simulating a particle detection event.

In one embodiment the test switch tests the functionality of the particle sensor by increasing the gain associated with the optical transducer. In another embodiment the particle sensor's functionality is tested by lowering or eliminating the threshold associated with an alarm condition. The glow associated with the smoke cage, as discussed elsewhere herein, is relatively stable from particle sensor to particle sensor. The amount the gain is increased and/or threshold is lowered may be determined by measuring the typical "noise" level associated with the particle sensor. Since the "noise" level is relatively predictable it may be used as the test level, enabling a user to simulate an alarm condition by temporarily setting the alarm threshold to a test level, or vice-versa. This can be done, via the test switch or actuator, by increasing gain or decreasing the alarm threshold or both. Another method is to physically change the optical properties within the smoke cage to reflect a portion of light toward the optical transducer.

Turning now to FIG. 6, a domed smoke cage 625 is depicted to comprise a sounder assembly 620 mounted on top the corresponding domed portion. The domed smoke cage is further depicted to include a substantially flat portion 628 on an otherwise cylindrically shaped bug screen 626. Preferably, pins 629*b* and, or, stakes 629*a* are provided for improving the precision associated with placement of the smoke cage on the corresponding printed circuit board (not shown in FIG. 6).

Figure 7:
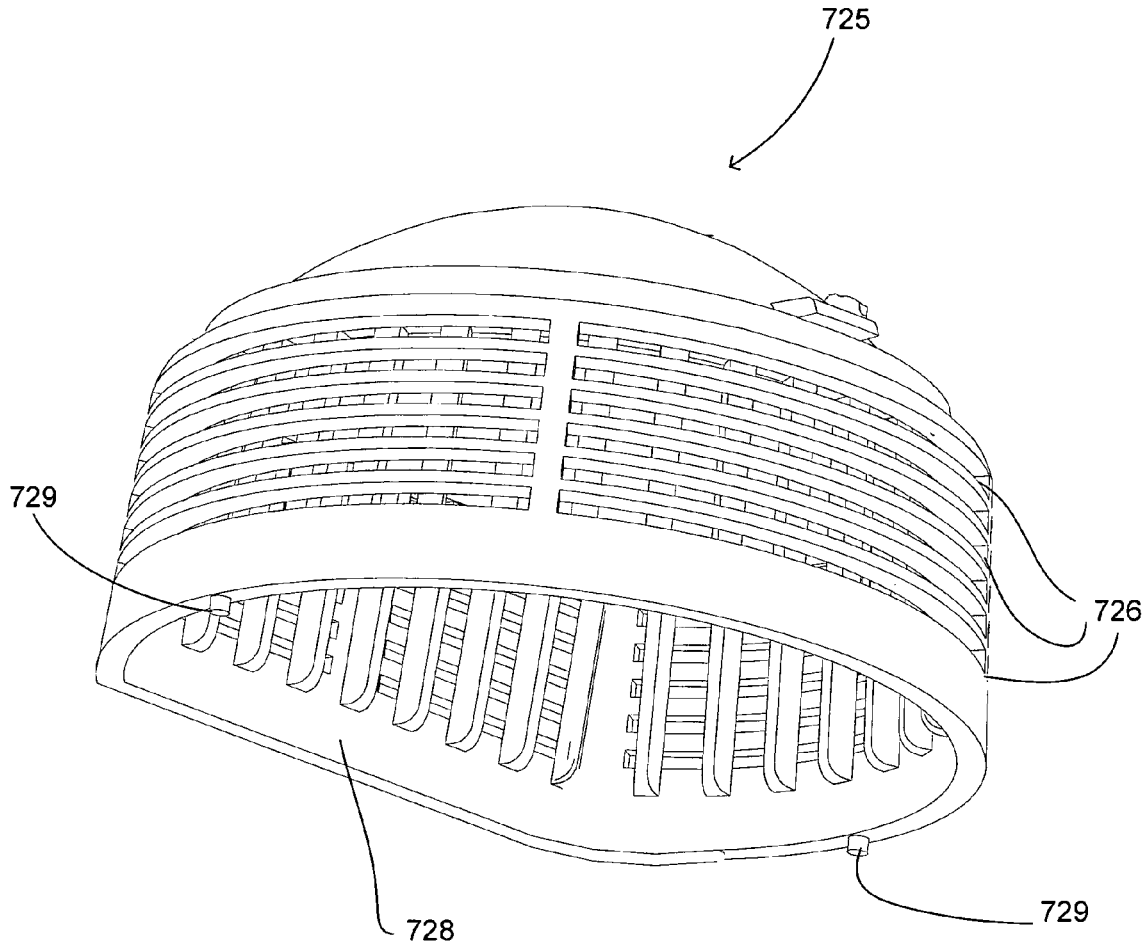
FIG. 7 depicts a perspective view of the smoke cage of the particle sensor embodiment of FIGS. 3*a*, 3*b*, 3*c*, and 3*d*

Turning to FIG. 7, there is depicted a domed smoke cage 725 include a substantially flat portion 728 on an otherwise cylindrically shaped bug screen 726. Preferably, pins 729 are provided for improving the precision associated with placement of the smoke cage on the corresponding printed circuit board (not shown in FIG. 7)

Turning now to FIGS. 8, 9, 10*a*, 10*b* and 11*a*, a light scatter type particle sensor 800, 900, 1000*a*, 1000*b*, 1100 is shown that arranges a light source 851, 951, 1051*a*, 1051*b*, 1151 and an optical transducer 852, 952, 1052*a*, 1052*b*, 1152 such that a very high light flux density 880, 980 occurs within the field of view 885 of the transducer near its focal point. The light rays that pass beyond this point are no longer considered useful; preferably, the light rays are not reflected back onto any surface that is within the field of view of the transducer. Because of the very low light levels involved in detecting particulate matter in the sensed atmosphere, controlling reflections is beneficial, especially as the surrounding structures are miniaturized. The optical transducer can not distinguish between light rays reflected off of particles and light rays that have reflected off a nearby structure and back onto a surface within its field of view. Reflections can create false indications of particles in the airflow. "Clear atmosphere" optical transducer output with negligible particles present in the surrounding atmosphere is considered "noise". Implementation of this optical principle of directing and, or, dissipating "reflected" light rays is one improvement offered by at least one disclosed embodiment.

Optics block 850, 950, 1050*a*, 1050*b*, 1150 positions and holds the light source and optical transducer in the desired orientation. The optics block and, or, optic block cover 853, 953, 1053*b* limits the field of view of the optical transducer such that particle detection is not compromised and such that external surfaces capable of reflecting significant light rays are blocked. The various surfaces of the optics block 850*b*1, 850*b*2, 853*b*1, 853*b*2, 950*b*1, 950*b*2, 953*b*1, 953*b*2, 1050*b*1, 1050*b*2, 1053*b*1, 1053*b*2 are sloped substantially to form various "V" shapes that function to further divert reflected light rays away from the optical transducer. The slight doglegs in the optics block and, or, optic block cover are preferred to hold the photodiode at a 15 degree angle horizontally and, or, to form apertures 881, 886, 981, 986. This angle helps maximize the electrical output per unit of particle density. The apertures at least in part define the light source light ray focus 880, 980 and the field of view of the transducer 885. The transducer is preferably configured such that an associated "optically sensitive" area is not centered under a corresponding lens.

Preferably, the optics block 850, 950, 1050*a*, 1050*b*, 1150 is positioned within a domed smoke cage 825, 925, 1025*a*, 1025*b* having a substantially flat portion 1028*a* on an otherwise cylindrically shaped a bug screen 826, 926, 1026*b*. FIGS. 8, 9, 10*b* and 11*a* depicts a preferred optics block placement relative the smoke cage from a profile view. FIG. 10*a* depicts a preferred optics block placement relative the smoke cage from a plan view.

Figure 8:
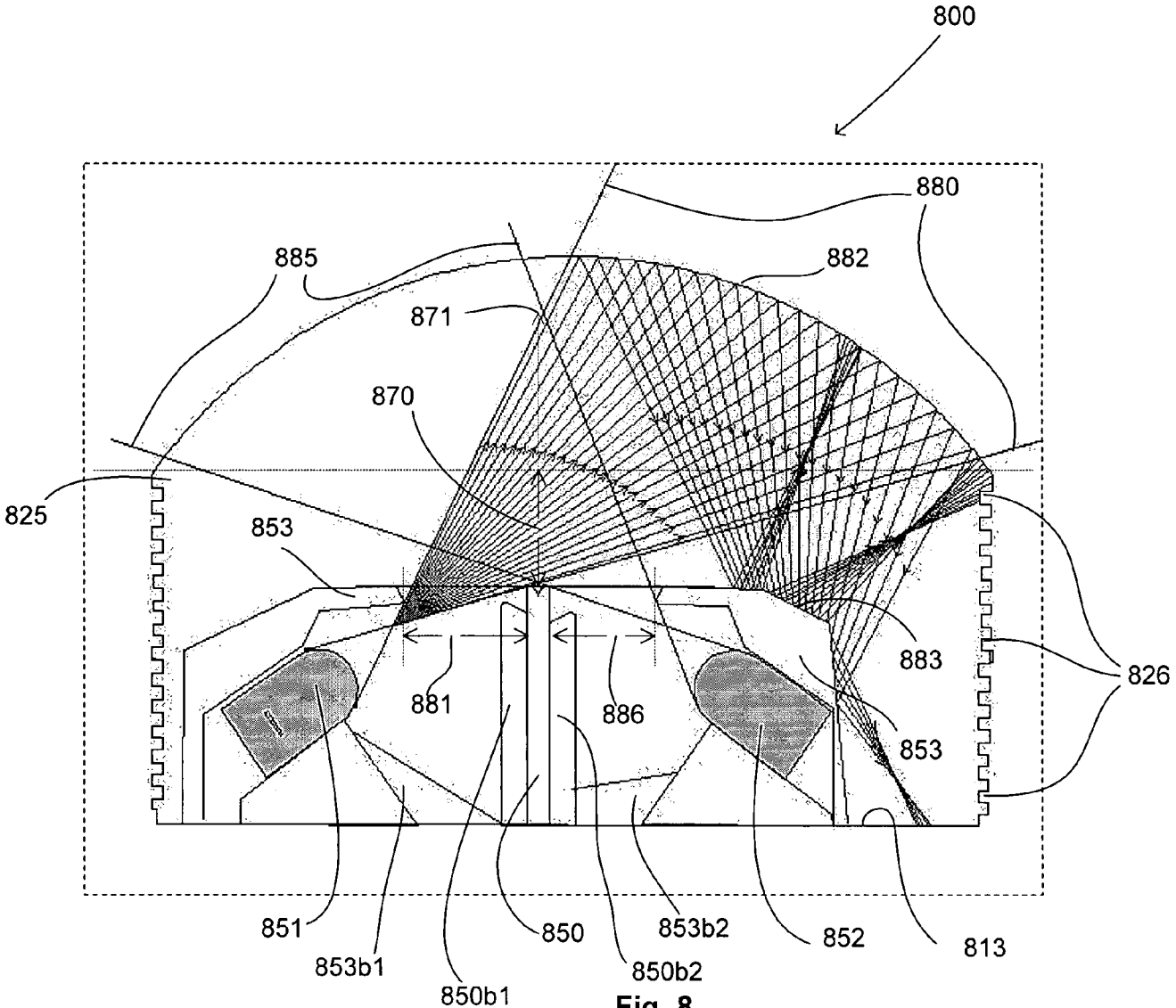
FIG. 8 depicts a profile view of light ray tracings within a smoke cage with the light source modeled as a point source.
Figure 9:
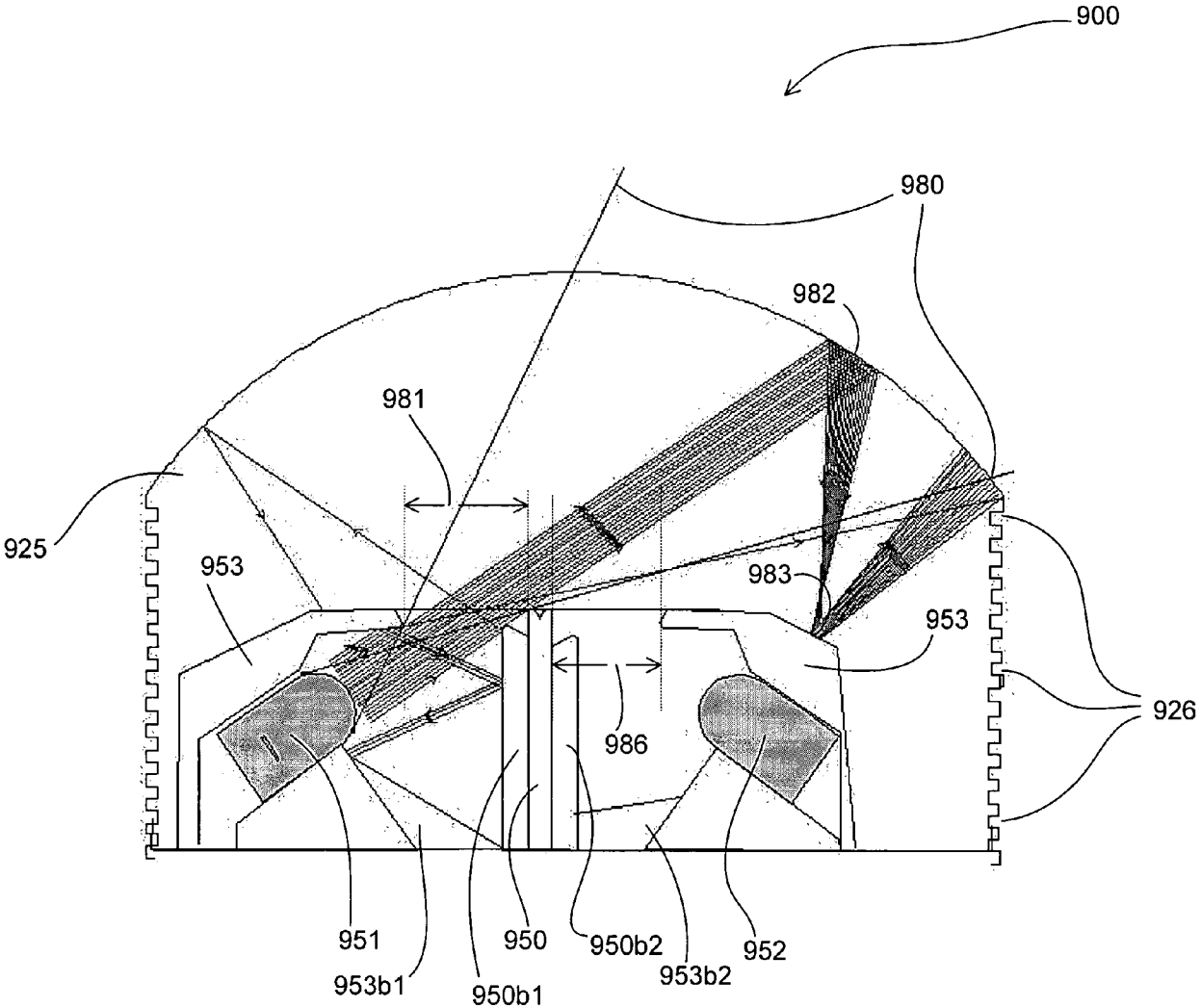
FIG. 9 depicts a profile view of light ray tracings within a smoke cage with the light source modeled as a collimated light source.

FIG. 8 depicts a profile view of light ray tracings of the light rays within a domed smoke cage 825 with the light source modeled as a point source. FIG. 9 depicts a similar light ray tracing with the light source modeled as a collimated light source. FIG. 10*a* depicts a plan view ray tracing with the light source modeled as a point light source. These light ray tracings depict only two dimensions; one skilled in the art of optics will recognize the basic concept of how the domed smoke cage operates in three dimensions by studying these two dimensional illustrations.

The domed smoke cage, when treated on its interior with a high gloss, black, finish, behaves according to the optical rules governing a spherical mirror. Unlike application of a planar mirror, one feature of this embodiment attenuates light rays as quickly as possible (i.e. with as few significant reflected light rays as possible), while keeping any stray reflections from bouncing back within the optical transducer's field-of-view. One related embodiment treats the interior surfaces of the smoke cage with a finish that absorbs as much of the incident light rays as possible, without significant reflections. With a high gloss black finish, the light rays that do reflect are in a very predictable direction away from the transducer and, or, are highly attenuated. It should be understood that surfaces of other components located within the smoke cage, for example: the optics block, the optic block cover, the printed circuit board and related components, may be coated with similar finishes as the smoke cage. This applies, as well, to all the embodiments discussed herein. It is common practice in the smoke detector industry to refer to the unwanted light rays that do manage to bounce off various surfaces and produce transducer output that is "noise". This "noise", in many known optical smoke detector designs, results in an electrical signal that is higher in amplitude than that produced by the desired signal from particles in the test space. Signal-to-noise ratios have been measured to be as low as 1 to 2 in a commercially available, fixed threshold, smoke detectors. In some designs, the electrical signal amplitude increases only 33% from "no smoke" (noise) to an alarm condition (signal). As a practical matter, these sensors work, however, they are more prone to false alarms and have poorer resolution when compared to a sensor having a high signal-noise ratio. This is especially true if the smoke cage optical design relies on a complex structure to redirect and dissipate light. A design with many crevices and sharp edges is likely to accumulate dust in those features. Accumulation of dust typically changes the original associated optical properties. The noise level typically increases with age, and can result in false alarms.

When the interior of the domed smoke cage is treated with a black, high gloss finish, the signal-to-noise ratio has been measured at 20 to 1. Preferably, over 95% of the transducer output signal is actually from particles in the test space. Initial resolution and, or, resistance to false alarms is, thereby, improved.

Dust accumulation is a problem for scatter sensors. In the case of a smoke detector, its function requires that dust-sensitive surfaces be exposed to potentially dusty atmospheres. An alternate method for keeping dust off these surfaces is to provide a fine filter between the sensor and the atmosphere. This may not be desirable as the filter tends to slow the exchange of flowing air each side of the filter. Additionally, when the filter becomes clogged, the particle sensor is rendered inoperative; often times unknown to the user. There is also a cost associated with the filter.

The ability to adjust certain optical characteristics by changing surface texture and, or, color of the smoke cage interior creates a unique advantage.

A high gloss interior finish will create a high signal-to-noise ratio that results in very good initial sensitivity to particles in the test atmosphere (e.g. S/N measured at 20 to 1). As dust accumulates, this ratio will degrade more rapidly than if the surface had initially been low luster. High gloss is generally more desirable for applications required to sense very low obscuration levels. Since dust accumulation will more rapidly affect the high gloss optical qualities, a self-compensating electronic controller is preferably incorporated to "subtract out" the effects of dust build-up as the associated signal-to-noise ratio degrades. It should be noted that a particle sensor of this type is especially preferred for locations inherently non-dusty, such as a clean room, where dust accumulation is less of an issue.

The high gloss results in high resolution, however, it also results in a greater sensitivity to dust accumulation. As a result, this method is better suited for self-adjusting (typically microprocessor based) controller designs. These designs can provide an offset that tracks and stores the "noise" level and subtracts it from the actual alarm signal. This compensation provides stability as the device becomes dusty and, or, ages. The sensor may still lose resolution as it becomes dusty and, or, ages. However, the chance of a false alarm is greatly reduced. A design in which dust accumulation changes the signal-to-noise ratio is typically not desirable for a fixed threshold controller, such as those using the Motorola MC145010 and MC145012 application specific integrated circuits used in many inexpensive smoke detector designs.

Choosing a low luster finish creates a controlled, but less ideal initial optical condition (e.g. S/N measured as low as 1 to 1). However, when a fixed threshold controller is desirable, having the signal-to-noise ratio stable is typically preferable when compared to having a high ratio. By choosing the desired color and, or, texture, dust accumulation will have less effect on the original calibration of the product. This extends the time between cleanings of a fixed set point sensor.

In at least one embodiment, smoke cages whose optical properties do not change significantly as dust clings to associated surfaces are provided. That is what the domed smoke cage provides when the high gloss finish is replaced with a low luster finish. In the macro sense, the low luster dome still behaves statistically as a light absorbing spherical mirror. However, at the surface level, there is much more randomization of where the non-absorbed light is reflected. This is similar to what happens when dust accumulates on the high gloss finish. The macro shape dictates that a large portion of the light rays will still be directed away from the transducer. At the localized surface level, more light rays are reflected at unpredictable angles. This creates a surface glow in all directions anytime light rays strike. This glow reduces the signal-to-noise ratio of the domed smoke cage to a measured 1 to 1. This means about 50% of the electrical signal that produces an alarm indication will result from actual particles, the remainder is likely the result of unwanted reflected light rays.

As dust accumulates, this ratio remains reasonably stable. This is not the case with other designs that rely on complex structures. Because the dust randomizes light in a similar manner to the low luster surface treatment, the signal-to-noise ratio remains stable. Preferably, the overall shape of the smoke cage is relatively large and uncomplicated. This means that the dust is not interfering with any fine details that are required to produce a certain optical result. This stability is where a benefit is derived for application in a fixed threshold controller. This effect may be further enhanced by choosing a surface color that "mimics" the type of dust expected. Lack of fine detail is also more conducive for molding in plastic or similarly moldable materials. The lack of fine details also results in a more uniform result in mass produced smoke cages. Materials that retain a static electric charge and, or, are in any way "sticky" will foster dust clinging to the smoke cage interior, therefore, those designs should be avoided.

Figure 3A:
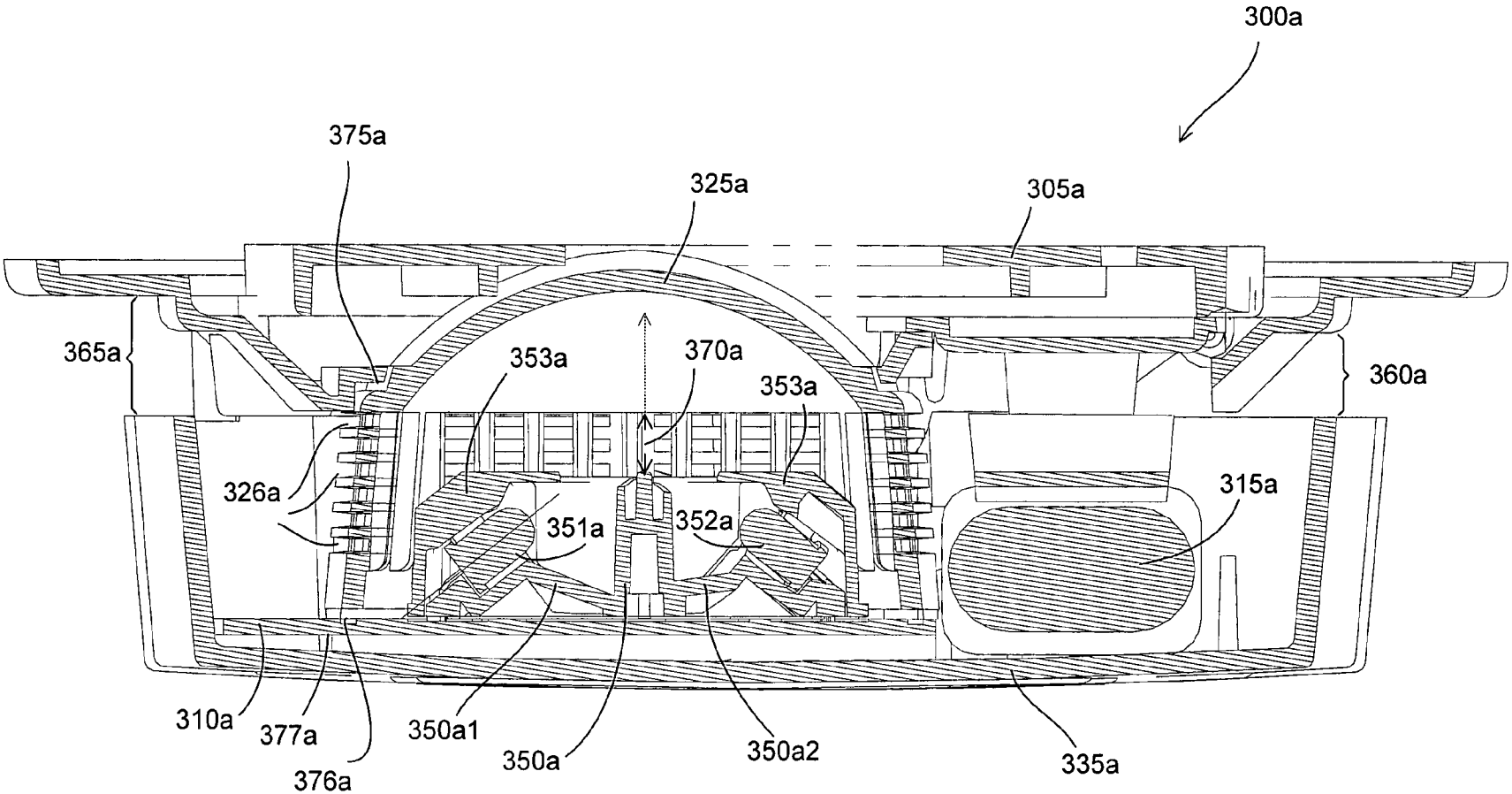
FIG. 3*a* depicts a particle sensor embodiment.
Figure 3B:
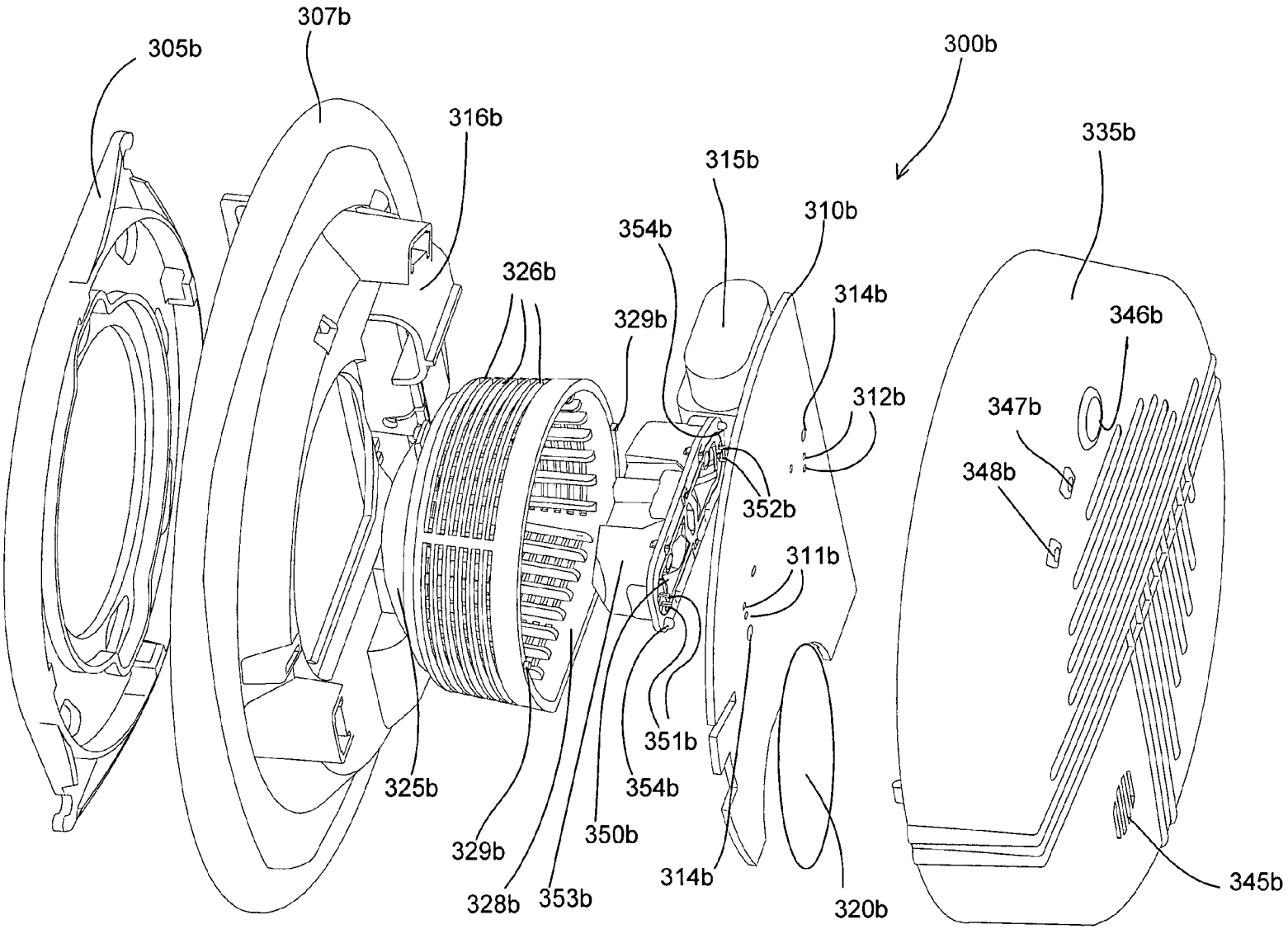
FIG. 3*b* depicts an exploded, perspective, view of the particle sensor embodiment of FIG. 3*a;*
Figure 3C:
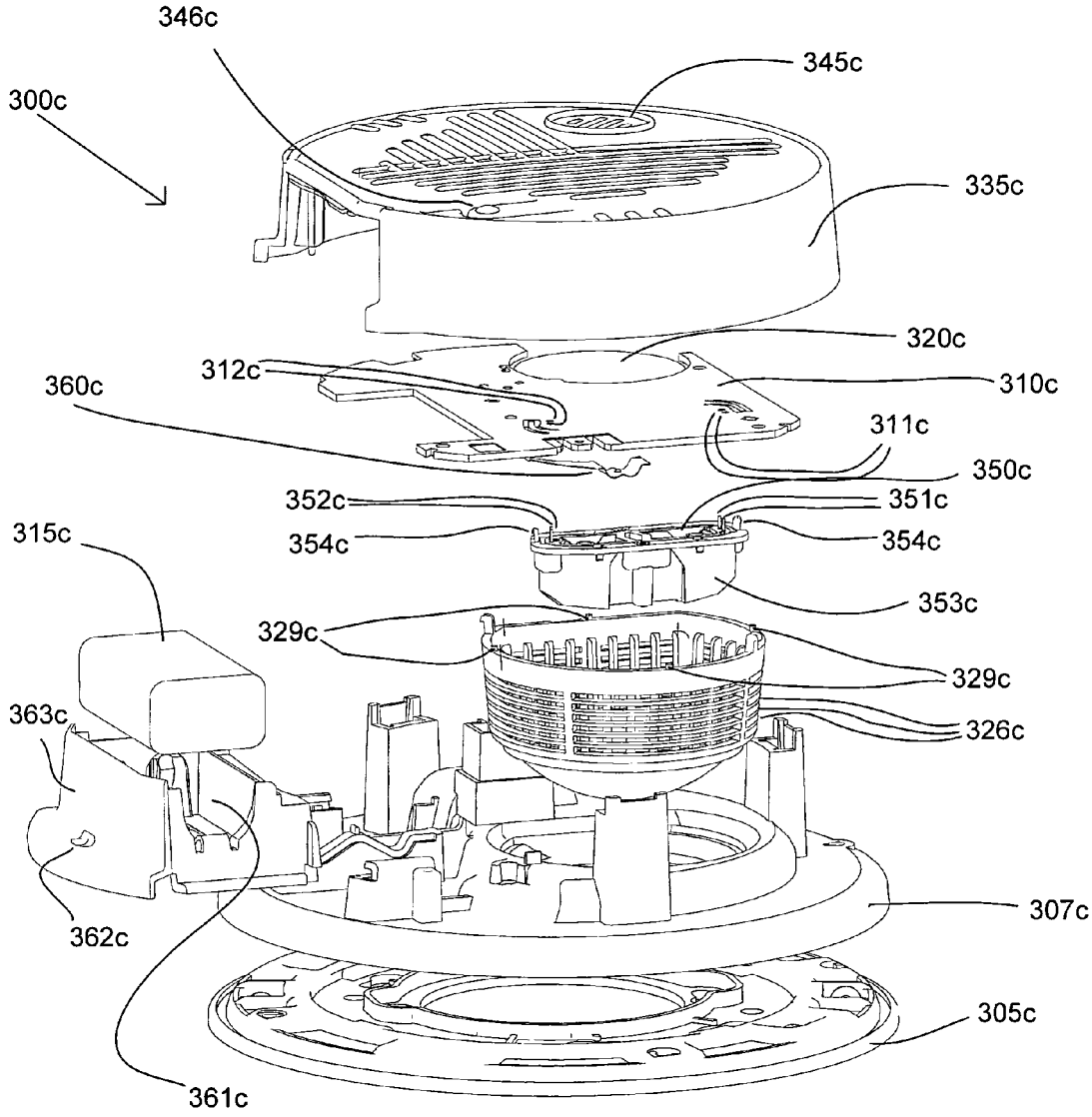
FIG. 3*c* depicts an exploded, perspective, view of the particle sensor.
Figure 3D:
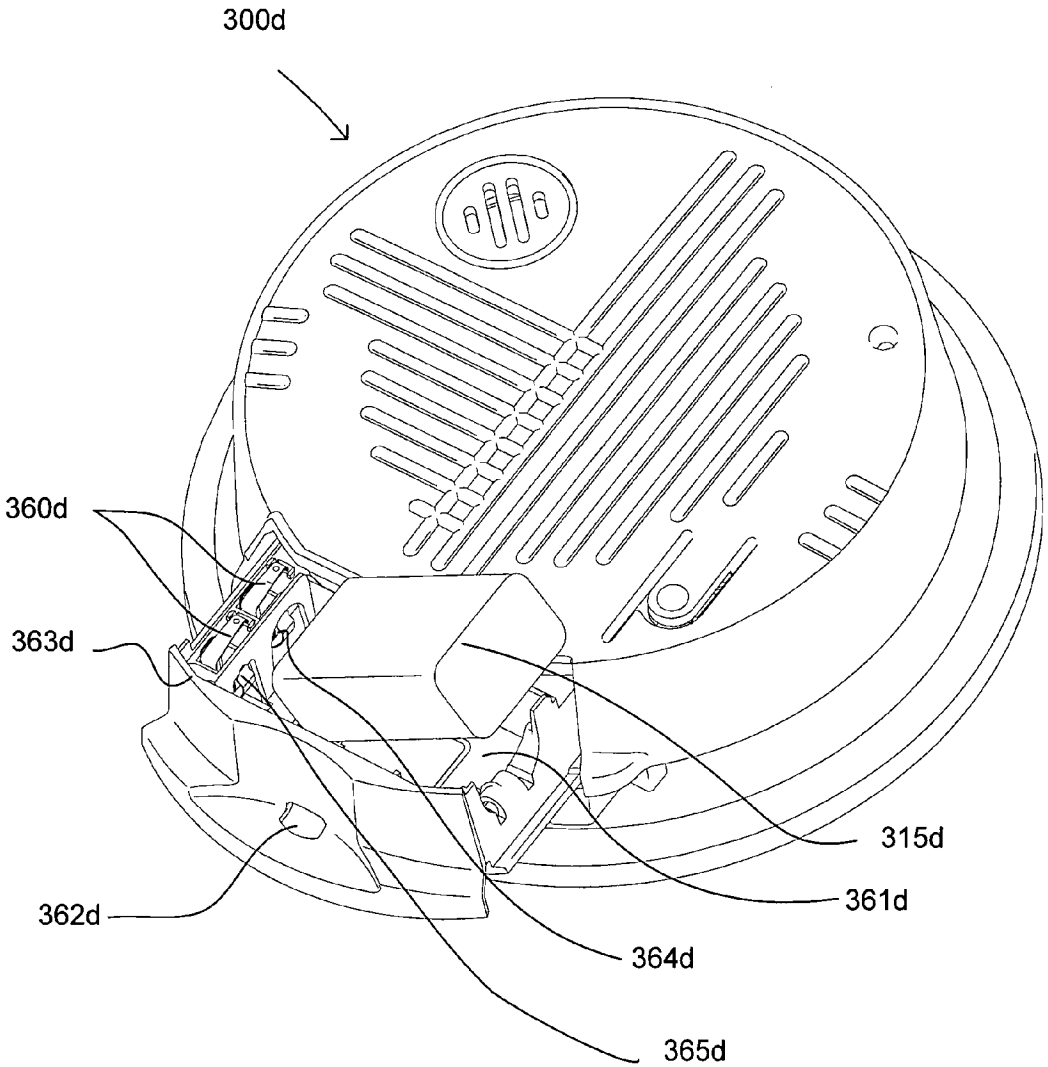
FIG. 3*d* depicts an assembled view of the particle sensor embodiment of FIG. 3*c;*

In at least one embodiment, the above features are provided using a unique domed smoke cage optical design that does not require complicated light labyrinths or prisms for normal operation. The absence of fine detail and sharp edges stabilizes the optical qualities as dust accumulates. Further, a surface color and texture treatment can be chosen to enhance stability. The earth's gravity has a tremendous effect on where at least larger dust particles settle. Simply mounting the device such that sensitive surfaces are placed farther from the earth with respect to non-sensitive surfaces will delay any dust build-up on the sensitive surfaces. Referring to FIGS. 2*a* and 3*a*, if one considers the mount attached to a corresponding ceiling, the particle sensor 200*a* is more likely going to have dust accumulating in the dome of the smoke cage than on the optics block. The particle sensor 300*a*, 300*d* will more likely experience dust accumulation on the optics block.

Therefore, it is generally more desirable to employ a particle sensor 200*a* in ceiling mount applications.

When one considers the mount attached to a wall, the length to width ratio of the optics block, the predominant airflow direction, the sweet spot, etc. should be considered when deciding on the rotational orientation of the particle sensor. Generally, either particle sensor 200*a* and 300*a*, 300*d* are applicable for wall mount applications.

Placement of the optic block within the smoke cage is a design variable. Placing the optic block off center under the dome tends to give better signal-to-noise ratios at the expense of some stability. Primary source reflections are directed off the optical axis in this configuration. The tilt of the dome with respect to the optical axis is another choice. The dome diameter may be varied to meet the needs of the design. It may also be truncated on the side opposite the optic block to save space.

Since the focal length of the intentionally lossy mirror is a function of its diameter, the optics for directing reflected light rays preferably incorporates a domed smoke cage directing reflections in desired directions. A dome radius of approximately 32 mm is desirable. The outer aesthetic cover preferably is an integral part of the ambient light rejecting function.

"Scatter type" particle sensors have what is commonly referred to as a "sweet spot" 270*a*, 370*a*, 870. The sweet spot is an area within the smoke cage where the light source output rays 880 intersect with the field-of-view 885 of the transducer. The closer and, or, more focused this area is to the optics block, the higher the electrical output per unit of detected particles. It should be understood that the sweet spot may extend as depicted with the dashed lines near 270*a*, 370*a*, 870 and may extend to a point designated by 871 in FIG. 8. Compact particle sensors benefit from precision in this regard. However, a highly focused "sweet spot" is also more prone to variation of this signal caused by mechanical movement of the optical elements and smoke density variations within the smoke cage. Airflow near surfaces of the smoke cage and surfaces of the optics block does not exchange with the ambient very well. Within about ⅛" the airflow tends to "cling" to surfaces and stagnates. Long delays in sensor response may be introduced if the "sweet spot" is too close to internal surfaces within the smoke cage. The preferred embodiment places the "sweet spot" in free space, more than ⅛" away from any surface. By intentionally choosing a less highly focused "sweet spot", the optical signal is the result of a larger sample of the corresponding test space. Experience has shown that this larger test space serves to "integrate" chaotic particle reflections and reduces the need for the optical components to remain rigid, precisely aligned and unmoving. Better particle sensor-to-particle sensor consistency is beneficial in mass production methods. At low airspeeds there are considerable "stiction" effects as the airflow moves near corresponding surfaces.

Figure 11B:
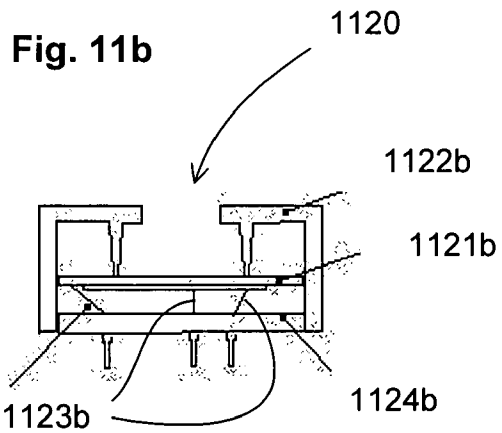
FIGS. 11*a*-11*c* depict various components of a smoke cage and associated audible device.
Figure 11C:
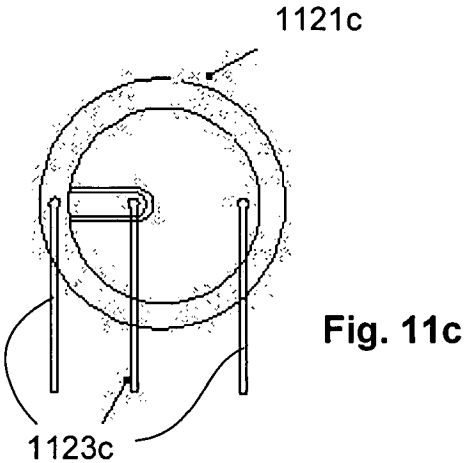
Figure 11A:
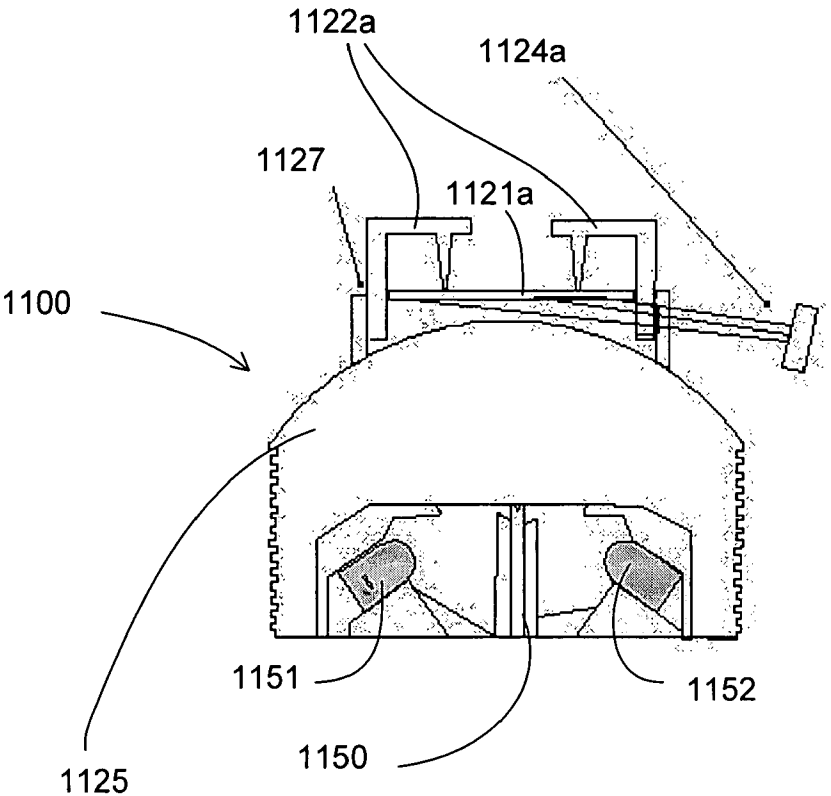

Turning now to FIGS. 11*a*-11*c*, an assembly 1100 is depicted to include a domed smoke cage 1125 with an optics block 1150, light source 1151 and optical transducer 1152 position therewithin. The domed smoke cage comprises a structure 1127 configured to receive a sounder assembly 1120. Preferably, the sounder comprises an acoustic housing 1122*a*, 1122*b* and an audio element 1121*a*, 1121*b*, 1121*c*. Preferably, the assembly 1100 further comprises electrical leads 1123*b*, 1123*c* extending from the audio element to a connector 1124*a*.

Figure 12:
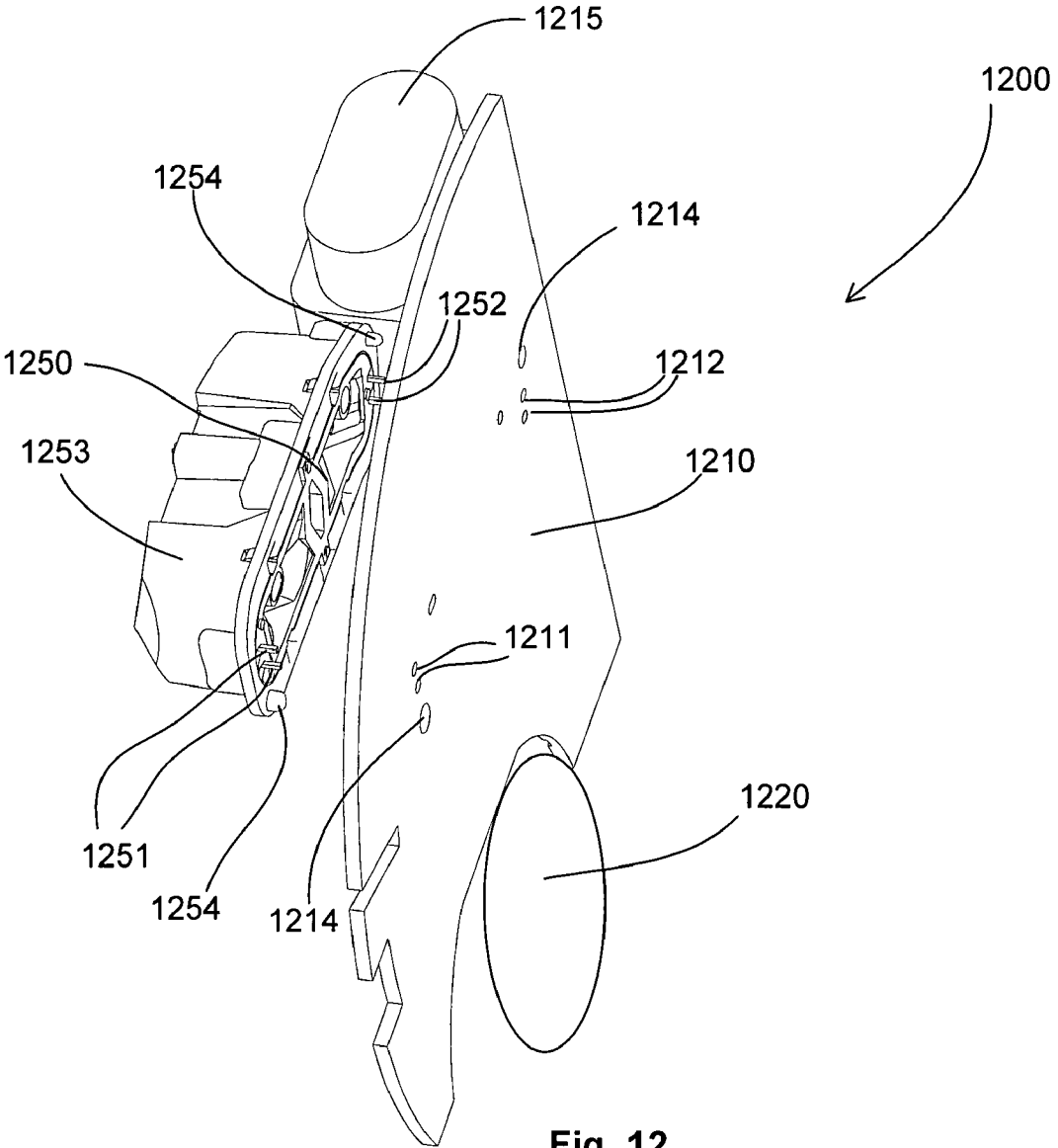
FIG. 12 depicts a circuit board, battery, sounder and optics block.

Turning now to FIG. 12, an assembly 1200 is depicted to comprise a printed circuit board 1210 having a power supply 1215, an optics block 1250, a optic block cover 1253 and a sounder assembly 1220 mounted thereto. Preferably, the printed circuit board and optics block are configured such that electrical leads 1251, 1252 are received within receptacles 1211, 1212, respectively. Preferably, the printed circuit board and optic block cover are configured such that posts 1254 are received within holes 1214. These configurations facilitate precision alignment of the corresponding components. The sounder may be mounted in planar relationship with the printed circuit board or may be partially mounted to a surface defined by the receptacles and holes depending on space constraints.

One of the more challenging aspects of particle sensor design is achieving uniform response to varying speed and direction of airflow. Due at least in part to the aesthetic cover, a more uniform sensor response is obtained. In one embodiment, this is due at least in part to the sounder preferably being placed on a higher plane than the bug screen on the smoke cage. With the sounder so positioned, smoke entry is not blocked. Lack of light labyrinths internal to the smoke cage also reduces airflow restrictions and smoke "shadowing". Since sensor response to smoke must be adjusted for the "worst case" direction, a uniform directional response allows the alarm threshold to be set at a higher particle density level than with known sensor assemblies. This, in turn, results in fewer false alarms. By "worst case" we mean the side or sides which have the lowest sensitivity to particles, in that the particle sensor must alarm in all directions to a set level of particles the "worst case" is the least sensitive side.

Preferably, the side walls of the smoke cage consist of a bug screen and are preferably constructed of the same material as the domed portion. The bug screen preferably has as much open area as possible, yet does not allow a 0.05" rod to pass through any associated opening. This will prevent most insects from contaminating the test space within the smoke cage, yet will not quickly clog shut with dust as would a fine filter. The bug screen has another function similar to "Venetian blinds". In conjunction with the aesthetic cover, ambient light is blocked from the field of view of the optic transducer inside the smoke cage. Ambient light can enter only from a restricted range of angles which the venetian blind effect blocks. This negates the need for a complex light labyrinth internal to the smoke cage. At the same time, the aesthetic cover preferably provides a minimum 10 mm wide open slot, extending radially from the smoke cage to a larger diameter, for airflow to enter the smoke cage from the surrounding atmosphere from substantially 360 degrees.

The 10 mm open slot has been found to be beneficial in overcoming surface "stiction" effects at low airspeeds, and allows free flow of the ambient air into the smoke cage. Narrower slots begin to restrict or redirect airflow unacceptably. Further, it has been found that a large "smoke capture area" to "smoke cage interior" volume ratio is beneficial for improving sensor response times. By placing the smoke entry area at the perimeter of the aesthetic cover, the capture area is maximized. The combination of a large ambient capture area, and small smoke cage interior volume, has been found advantageous for fast response. Essentially, the aesthetic cover's shape forms a ductwork that guides airflow through the sensor sweet spot. At low airspeeds, a preferred sensor design has been found to respond faster than exposing the smoke cage directly to the ambient conditions.

Due to the less than 0.05" wide openings in the bug screen, stiction effects tend to make this surface behave more like a solid wall than a screen at low air speeds. Smoke tracer testing of the smoke cage in free air has shown that general air flow tends to go around and not through the bug screen at low airspeeds. Surrounding the smoke cage with "ductwork" leading from a relatively large capture area, helps overcome this effect, and improves sensor response.

In at least one embodiment, radio frequency interference and, or, electromagnetic interference protection of the sensor is achieved with fewer associated components. The optics block is the sub-assembly that contains the light source and optic transducer. The light rays emitted by the light source may be visible or invisible to the human eye depending on the application. Very low electrical signals (nano-amps) are typically generated by the optics block. As a result, the signals are easily disrupted by external noise sources such as cell phones, brush-type motors, etc. It is common practice to have a separate metal piece formed to shield the sensitive areas. In at least one embodiment, the optics block, itself, is metal and connected to a common ground plain through the printed circuit board. This results in lower manufacturing costs by eliminating separate components.

Turning now to FIGS. 13*a*-13*i* through 16*a*-16*m*, nine graphs depict the measured smoke response of a particular embodiment of particle sensor. With the exception of FIGS. 16*a*-*d* the first graph in each series (13*a*, 14*a*, 15*a* & 16*e*) corresponds to a reference measurement of the optics block mounted on the PCB, no base or aesthetic cover, in a dark smoke test cage. These "bare sensor" graphs represent the best possible exposure of the sensor to ambient smoke levels (i.e. an actual product could not be produced this way). The rest of each set of plots 13*b*-*l*, 14*b*-*l*, 15*b*-*l*, 16*f*-*m* corresponds to the whole particle sensor, assembled, containing the previously measured optics block. Each graph represents a 45 degree change in the rotation of the sensor with respect to the primary smoke flow direction. The sensitivities computed for each direction of a particular embodiment are calculated by taking a point on the measured particle level curve and dividing by a corresponding point on the actual particle level curve at a time when the actual level reaches 2.5%/ft obscuration.

Figure 13:
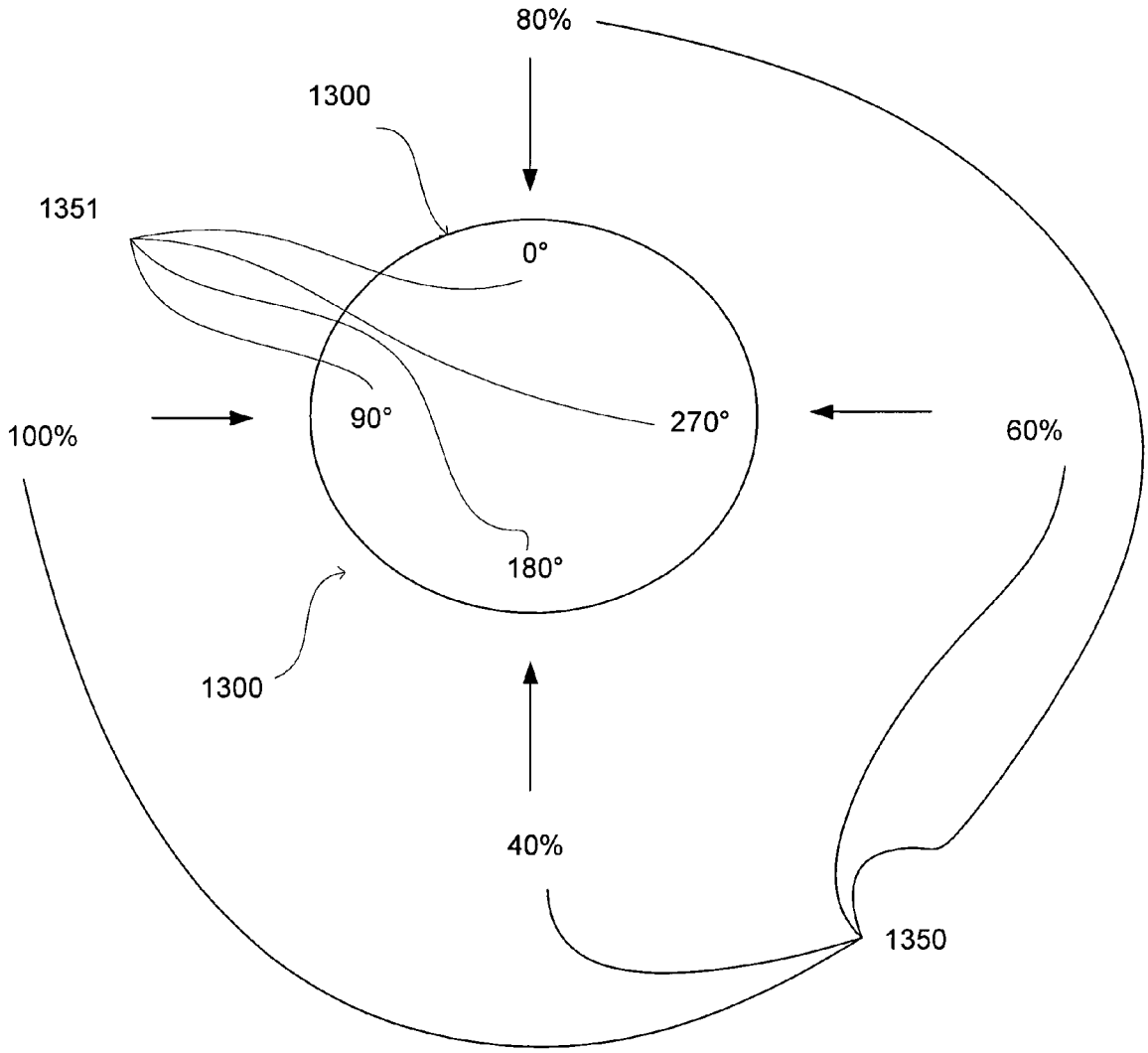
FIG. 13 depicts sensor orientation to provide context for the sensor response curves.
Figure 13A:
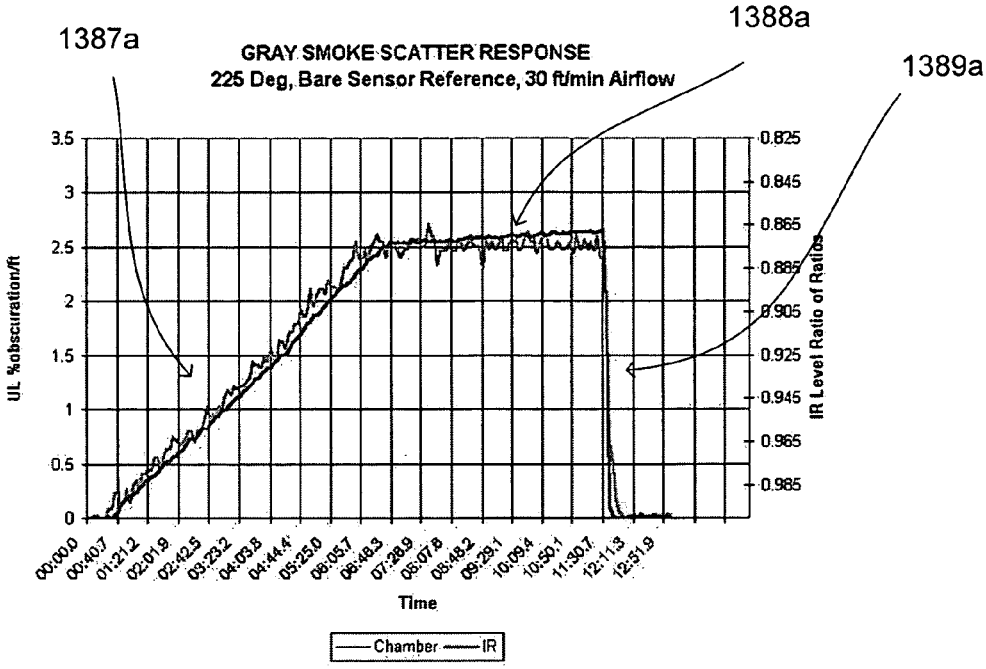
FIGS. 13*a*-13*i* depict response curves for the particle sensor embodiment of FIG. 1.
Figure 13B:
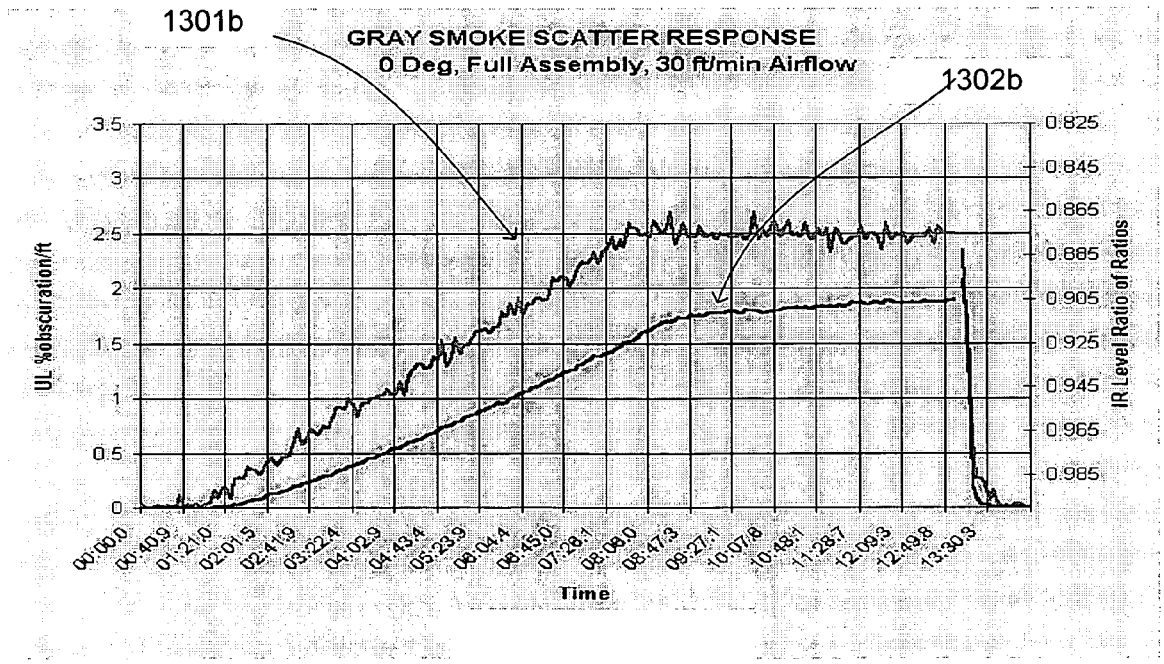
Figure 13C:
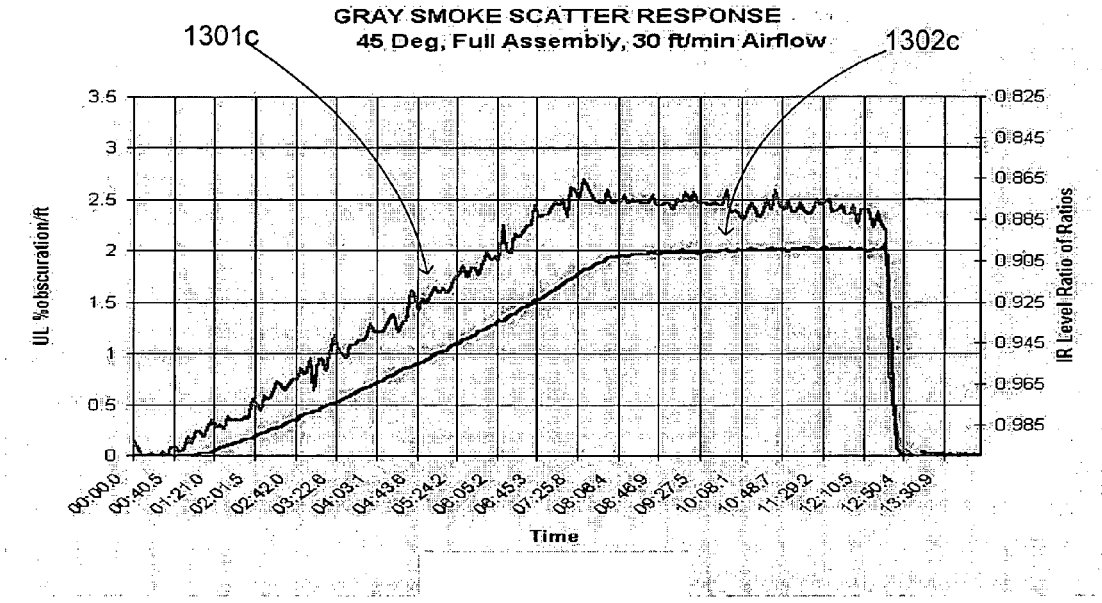
Figure 13D:
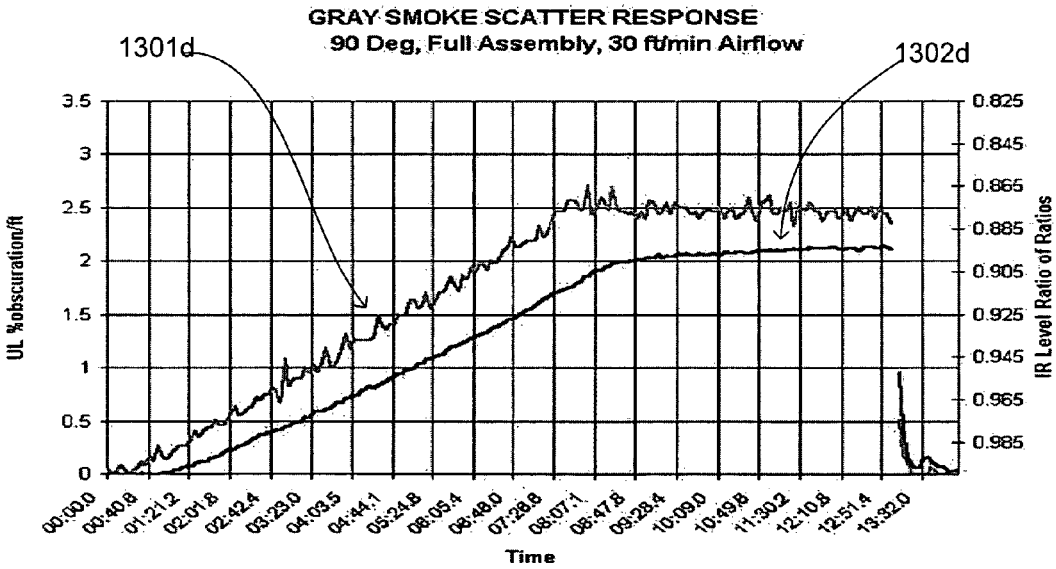
Figure 13E:
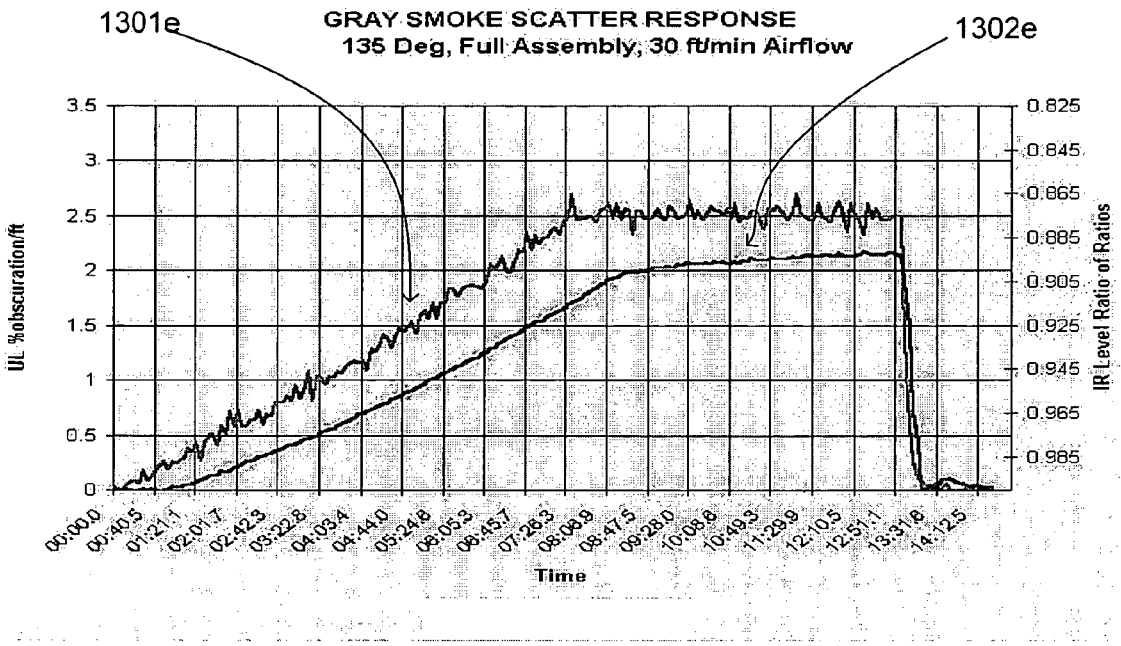
Figure 13F:
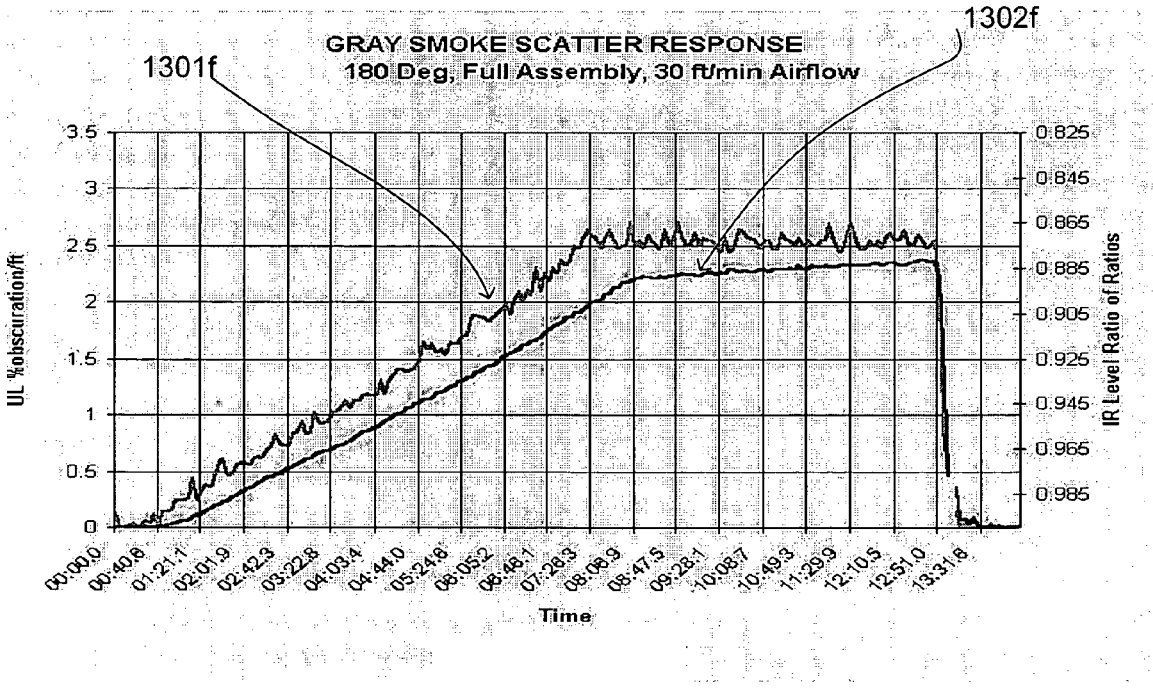
Figure 13G:
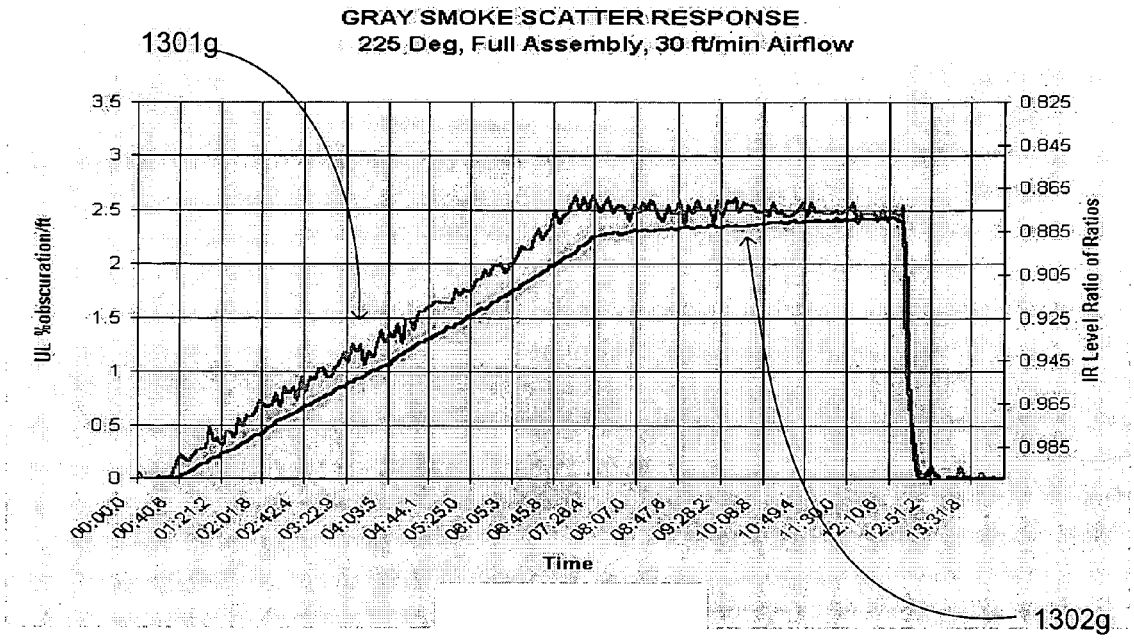
Figure 13H:
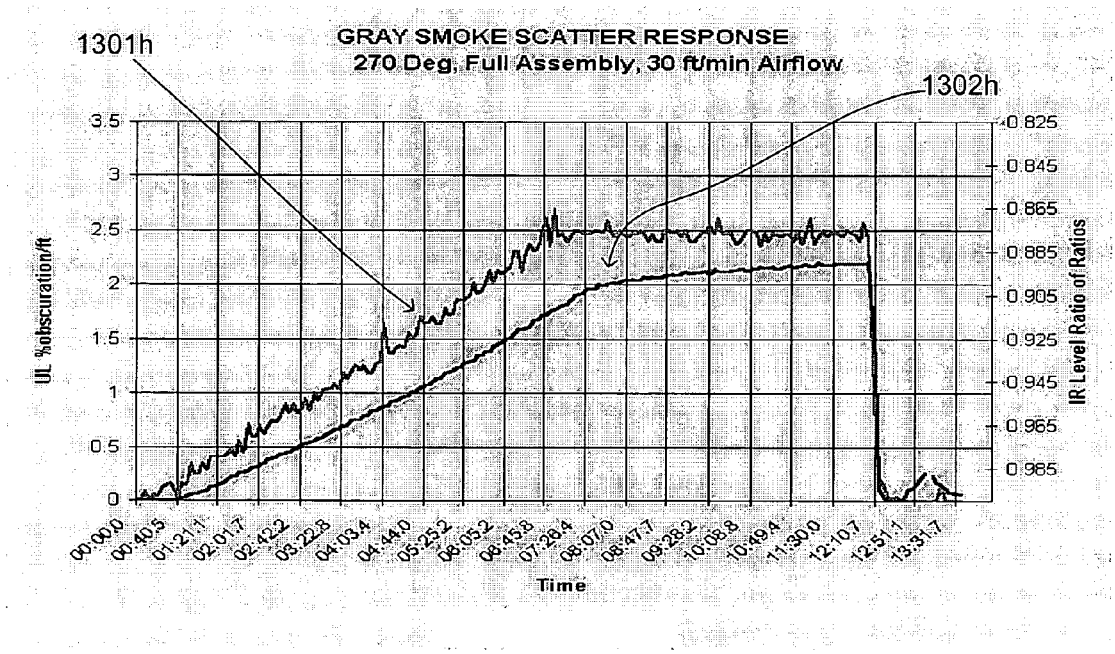
Figure 13I:
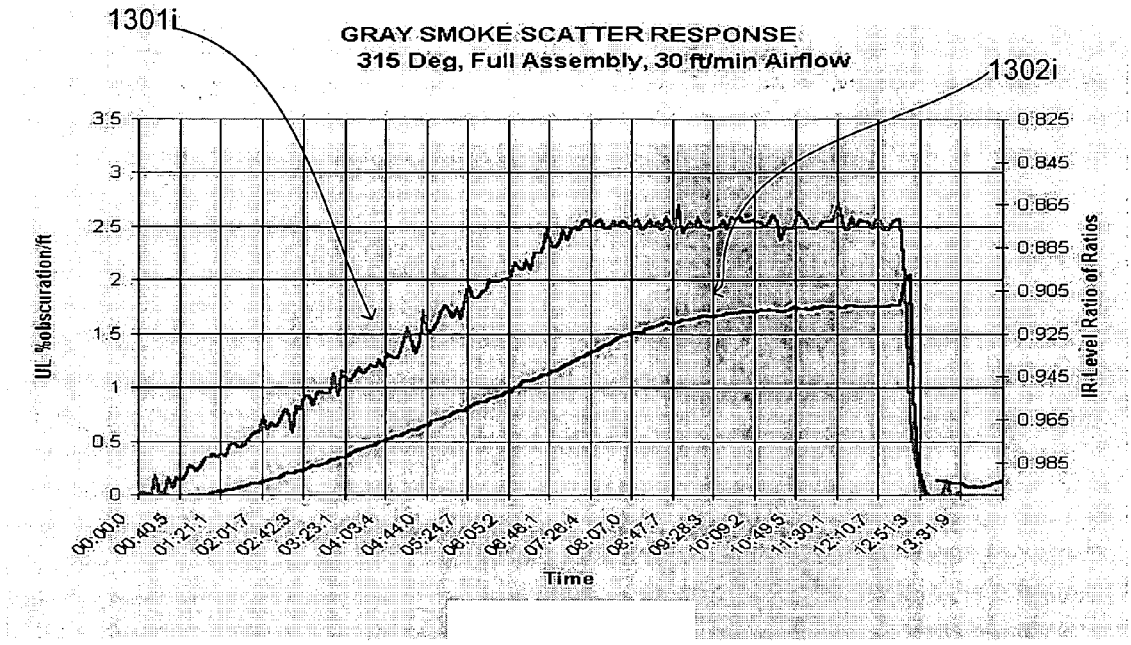
Figure 14A:
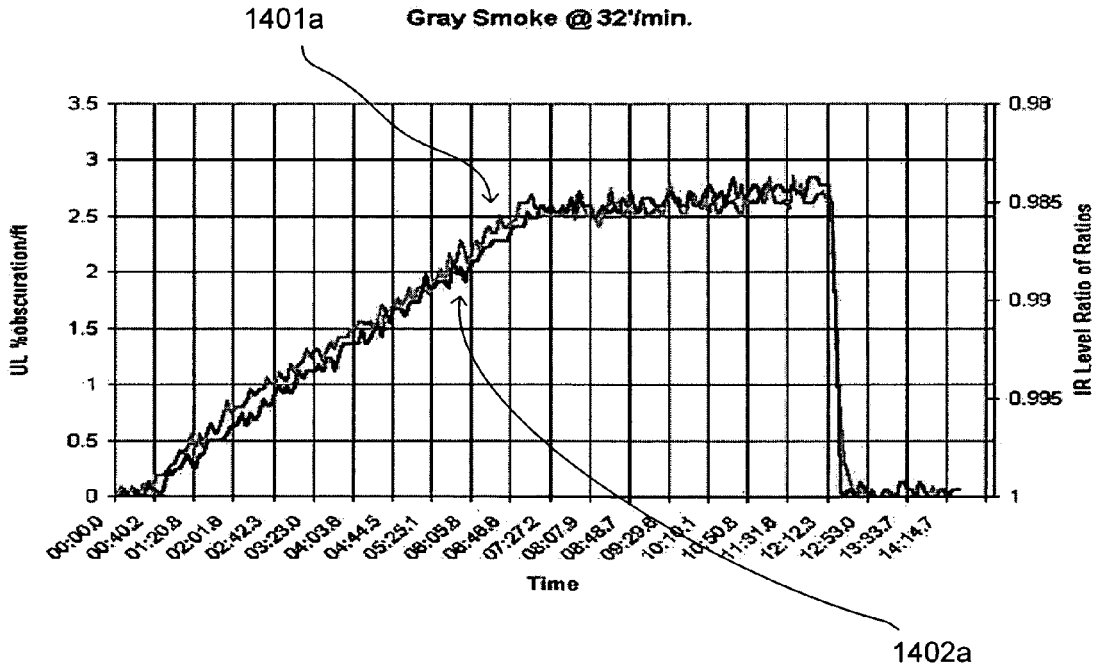
FIGS. 14*a*-14*i* depict response curves for the particle sensor embodiment of FIGS. 2*a* and 2*b;*
Figure 14B:
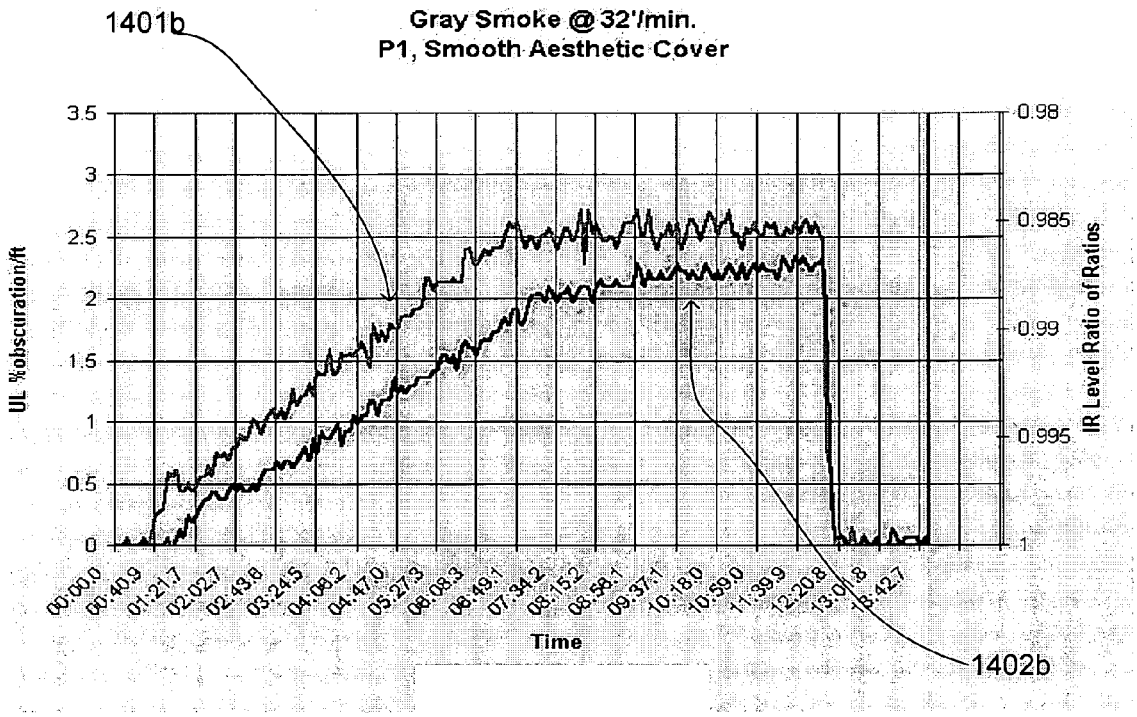
Figure 14C:
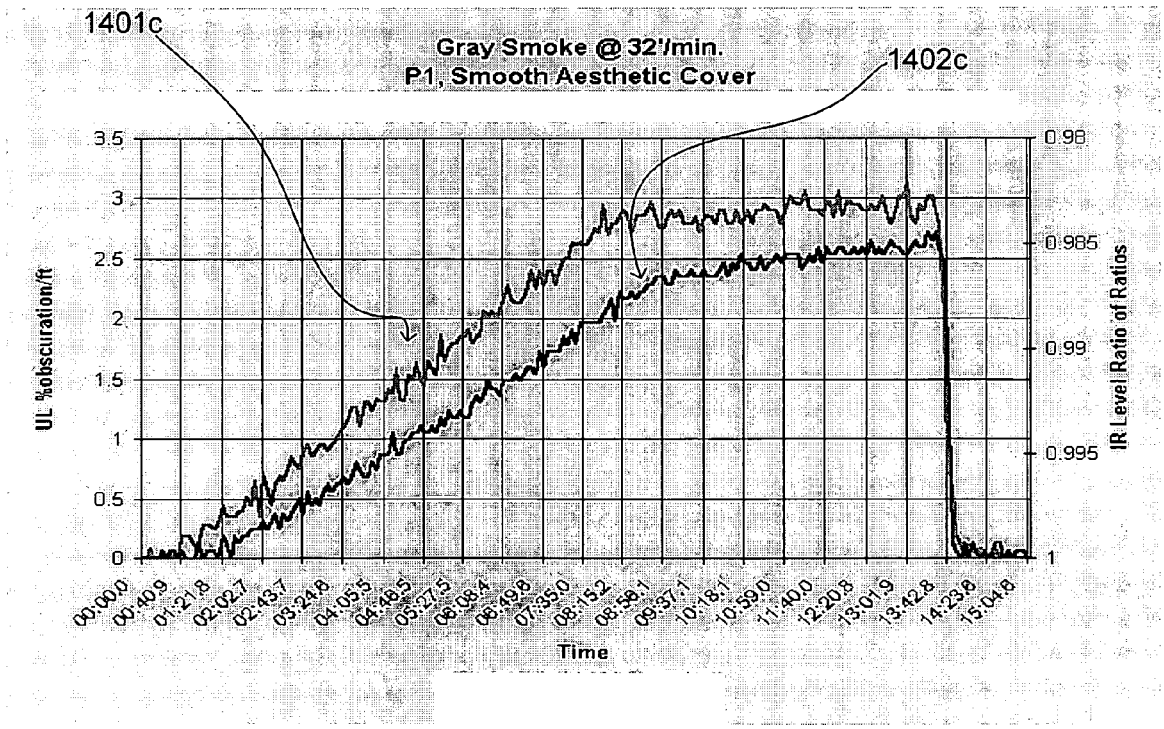
Figure 14D:
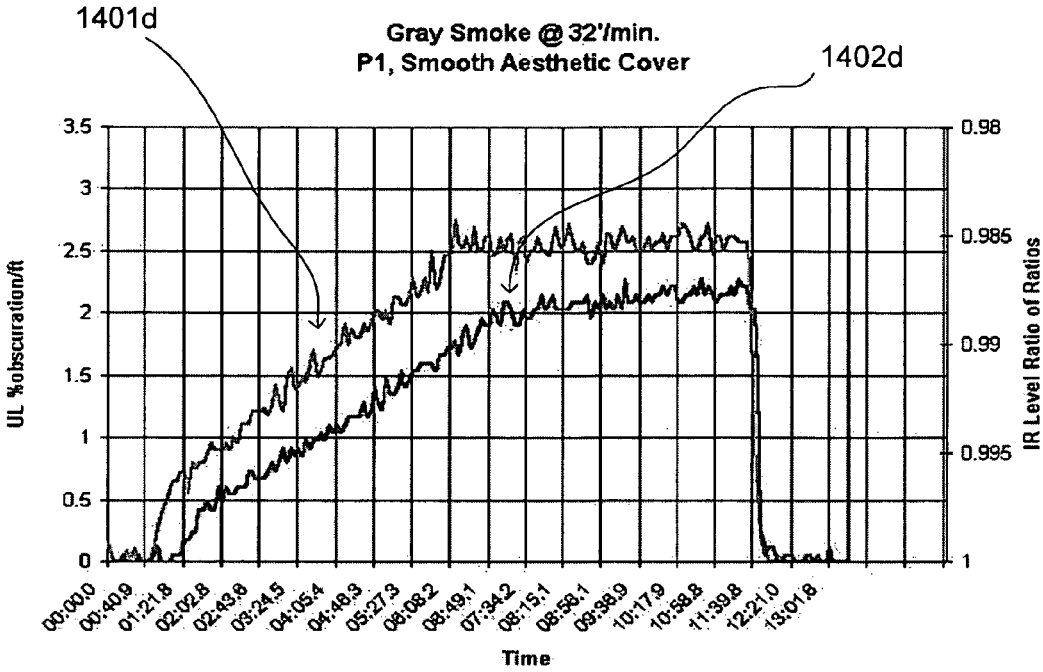
Figure 14E:
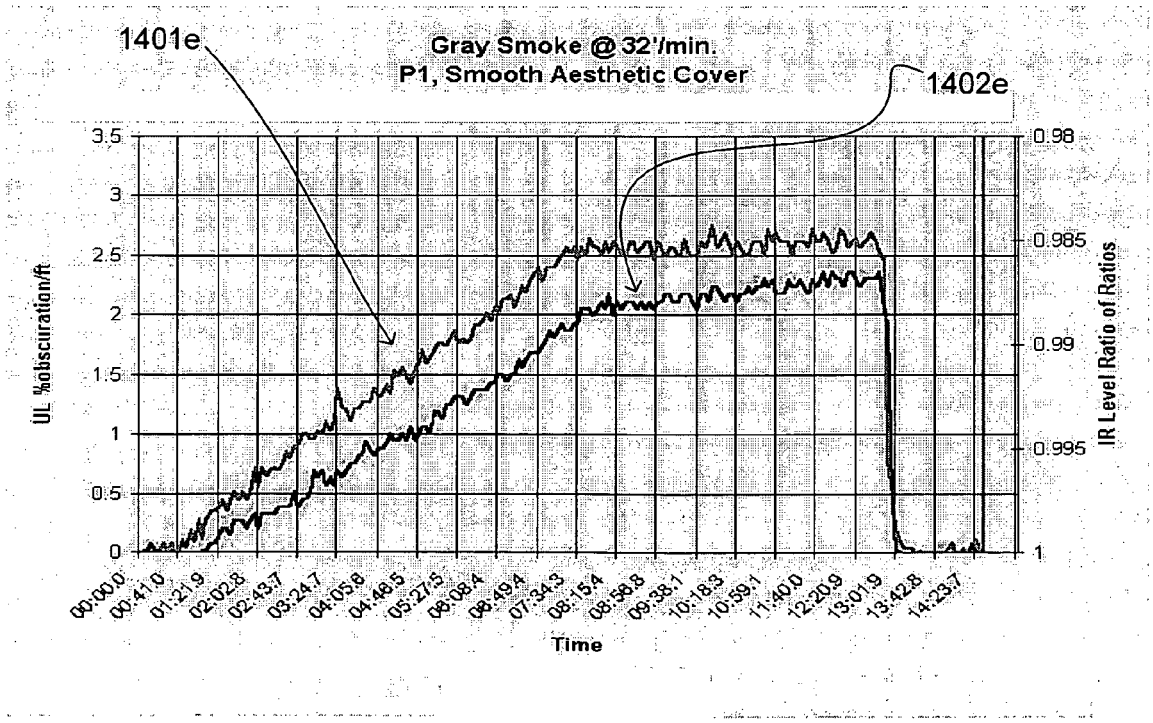
Figure 14F:
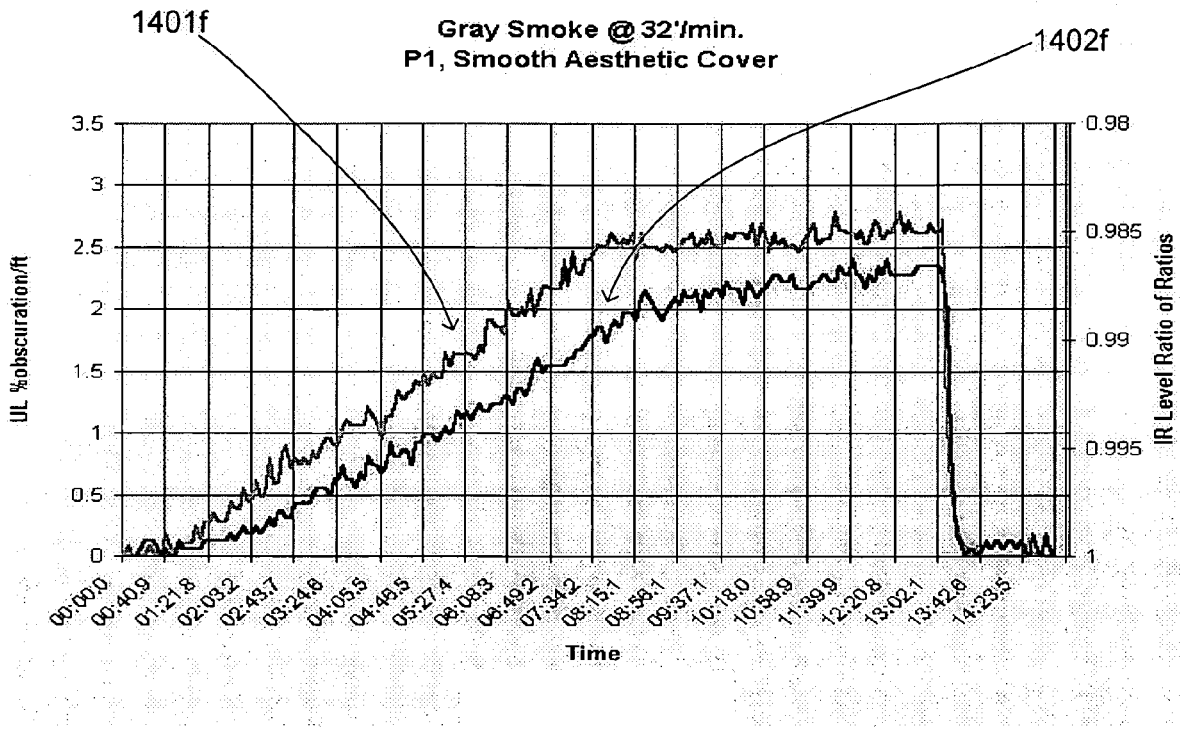
Figure 14G:
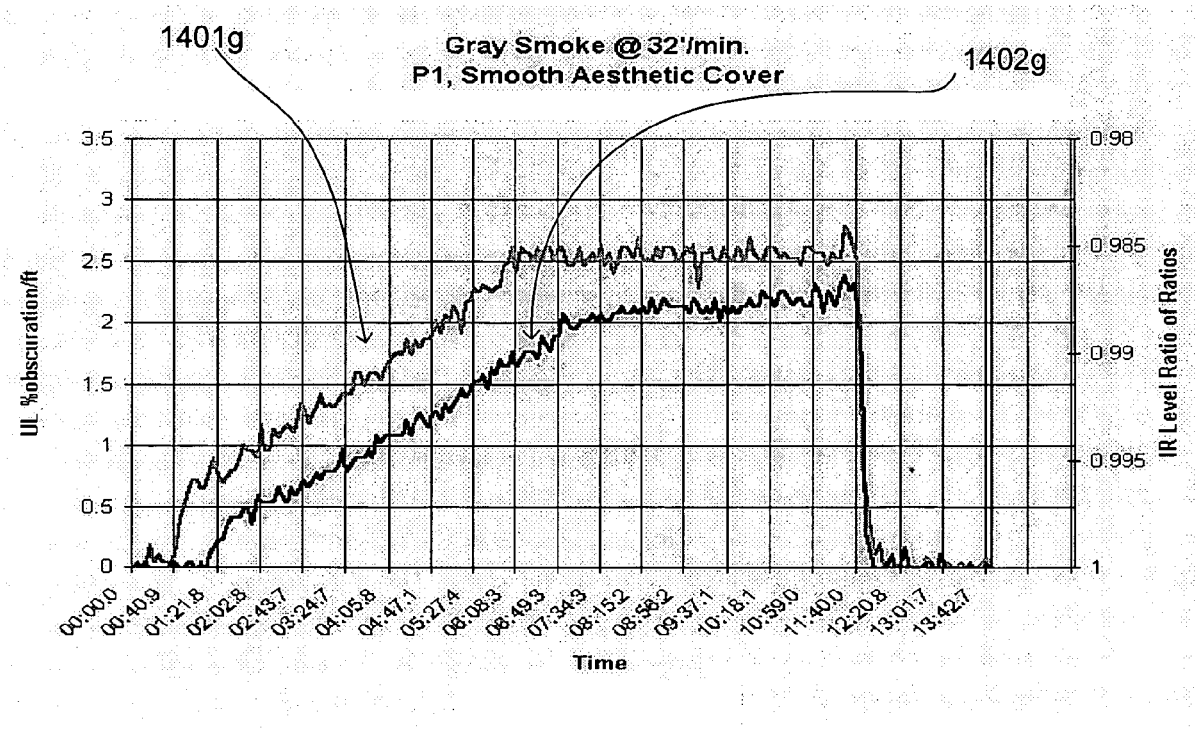
Figure 14H:
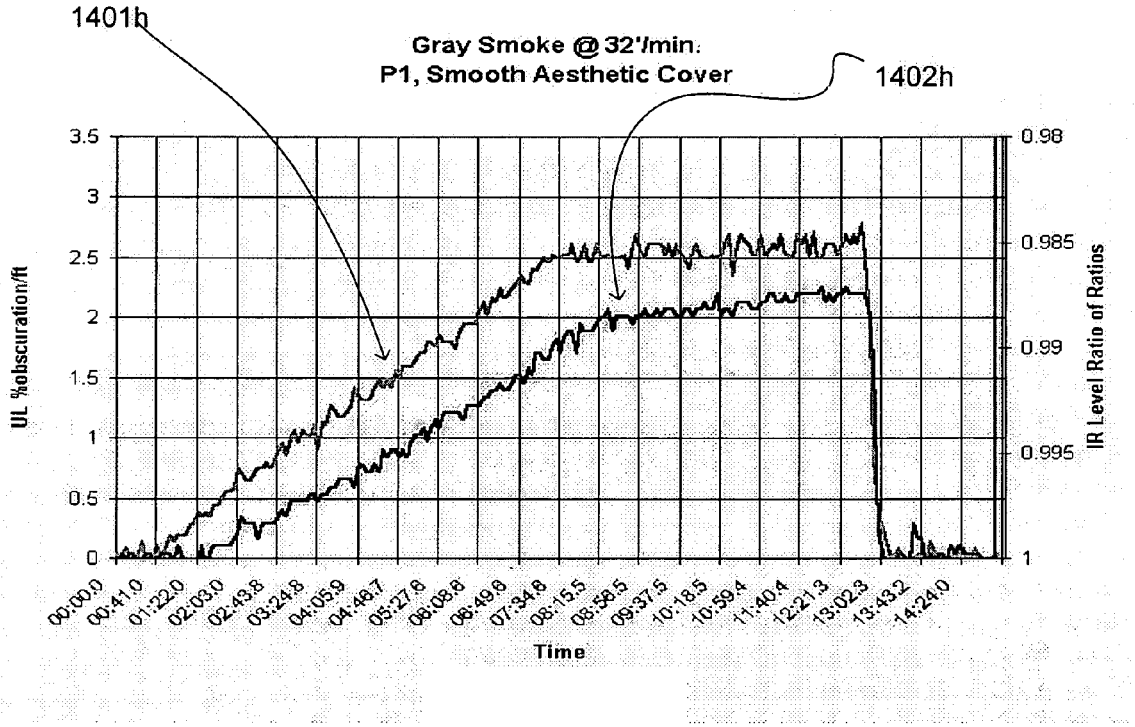
Figure 14I:
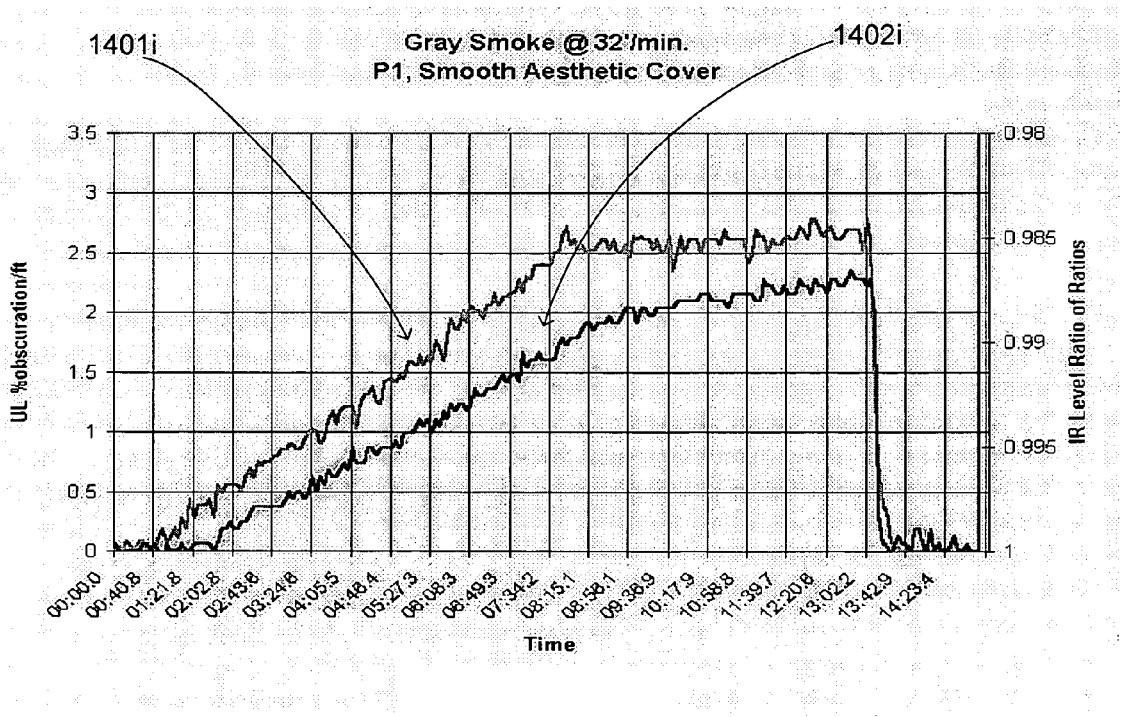

For illustrative purposes the phases of the test are labeled in FIG. 13*a*. The smoke is preferably generated by a known industry standard method of burning cotton wick. The wick is preferably burned until a smoke density of 2.5%/ft obscuration is achieved within the test chamber (phase 1387 where % obscuration rises), as measured by a known industry standard, 5 ft long "beam-type" sensor. The burning wick is preferably then removed and the smoke density maintained in the test chamber for 5 minutes (phase 1388 where % obscuration plateaus for roughly 5 minutes). Preferably, the chamber is then evacuated and returned to 0%/ft obscuration (phase 1389 where % obscuration suddenly drops, everything afterwards is erroneous data).

Two sets of data are depicted on each of FIGS. 13*a*-13*i* through 16*a*-16*m*. The first data set 1301, 1401, 1501, 1601, associated with the test "chamber", is produced by the 5 ft long obscuration beam type sensor. The preferred beam type sensor is contained within the smoke chamber and is defined by Underwriters Laboratories of Northbrook, Ill. The second data set is produced by the fully assembled particle sensor in accordance with the particular embodiment being tested, these curves (IR readings) are labeled 1302, 1402, 1502, and 1602 respectively.

As depicted, there is typically a 20-30 second lag between corresponding smoke levels measured by the chamber beam sensor, and the IR (i.e. the beam leads the IR readings). This is largely due to the design of the test chamber and the way smoke is introduced and dispersed within the chamber at low airspeeds. Also, because the chamber sensor works on the obscuration principle (light blocking), and the particle sensors work on the light scatter principle (light reflection), there are slight variations in this relationship as the smoke "ages" and, or, clumps together. This effect may be observed during the 5 minute steady-state period of 2.5%/ft obscuration. The IR readings tend to increase, while the obscuration sensor indicates a steady particle density in the test atmosphere.

FIG. 13. FIG. 13 is an example and is only provided here for visualization of example calculations which follow. The particle sensor 1300 has been given an arbitrary directional labeling (angles 1351) to help coordinate the discussion of FIG. 13. For each direction of interest the sensitivities 1350 have been labeled. For this particle sensor to alarm at 2.5%/ft obscuration (external) in any direction its alarm threshold must be set according to the sensitivity of the 180 degree orientation, 40%. The threshold setting for this example would be 1.0%/ft obscuration, see equation 1. Thus, internally whenever the particle sensor "sees" 1.0%/ft obscuration it will alarm. This creates a possibility of false alarms in that other orientations have higher sensitivities, these other sensitivities will contribute to the apparent calibration range. Using equation 1 again to find the actual obscuration level which will set off the alarm for a particular direction is just as simple. For instance this exemplary embodiment will have an apparent alarm calibration range of 1.0%/ft to 2.5%/ft obscuration since the 270 degree orientation will produce an alarm at 1.0%/ft obscuration due to its high sensitivity. For further reference the 0 degree and 90 degree orientations have apparent calibrations of 1.25%/ft and 1.67%/ft obscuration respectively.

$$\text{Internal obscuration level} = \text{Sensitivity} * \text{Actual obscuration level (external)} \qquad \text{Eqn. 1)}$$

FIGS. 13*a*-13*i* correspond to the particle sensor 100. Notice the variation in sensor response relative to airflow direction. In the best case direction of 225 degree rotation, about 88% (2.2% obscuration internally) of the 2.5%/ft ambient smoke is being sensed at the instant in time that an alarm should occur. In the worst case direction of 315 degree orientation, only 52% (1.3%/ft obscuration internally) of the ambient smoke is being sensed. Because of the rules for UL approval, particle sensor 100 has to sound an alarm when only 52% of the ambient smoke is present at the sensor if it must alarm at 2.5%/ft obscuration. This level of smoke is very low, and the sensitivity must be very high to alarm at this level. This increases the chance of a false alarm due to the high sensitivity required, and the 40% variability with direction. The apparent alarm calibration due to smoke flow direction would be from 1.5%/ft to 2.5%/ft.

Turning now to FIGS. 14*b*-14*i* which correspond to the embodiment of FIGS. 2*a* and 2*b*, each successive graph is with the particle sensor 200 rotated 45 degrees with respect to the airflow direction. These graphs demonstrate that on the average, 77% of the ambient smoke is present at the optics block at the time an alarm should sound. At best, 80.4% of the ambient smoke is present (45 and 135 degree orientation), and at worst, 70.5% of the smoke is present (225 degree orientation). UL requirements dictate that the alarm must sound at the appropriate ambient level with the particle sensor oriented in the worst case direction for airflow into the product. The manufacturer may increase the gain to compensate for a weak detection spot. While this achieves the goal of being certified by UL® it may cause the detector to be more prone to false alarms, especially if a fixed threshold controller is used. The ideal solution is to have a detector with little to no variation in sensitivity with respect to change in mounting orientation, wherein the sensitivity to smoke is also very high. The particle sensor 200*a*, 200*b*, therefore, has to be calibrated to sound an alarm at 70.5% of the actual ambient smoke level. If the desired alarm point is 2.5% obscuration, this would result in an actual set point, threshold, of about 1.8%/ft internally. If the product is rotated with respect to smoke flow, the apparent alarm calibration would vary from 2.2%/ft to 2.5%/ft.

Figure 15A:
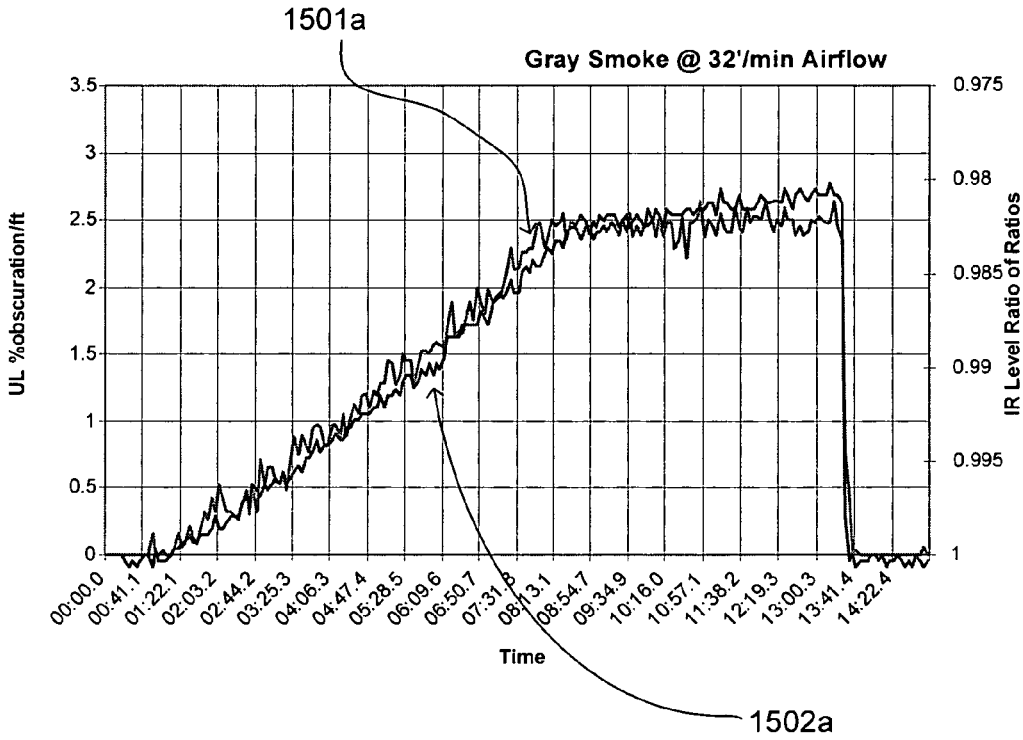
FIGS. 15*a*-15*i* depict response curves for the particle sensor embodiment of FIGS. 3*a*, 3*b*, 3*c* and 3*d;*
Figure 15B:
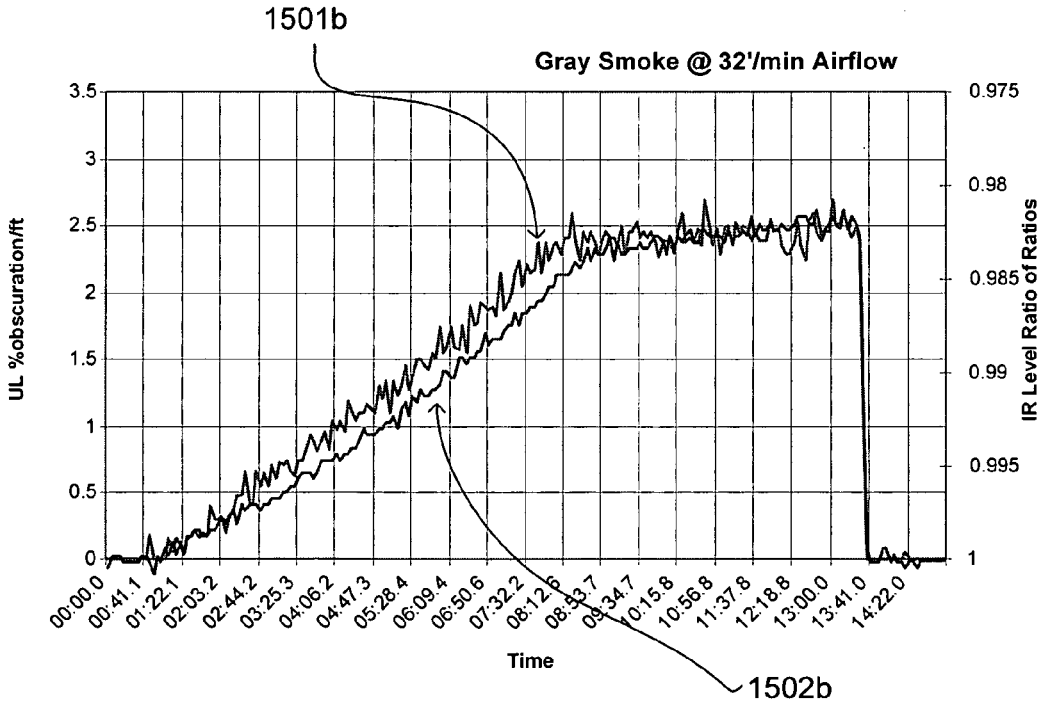
Figure 15C:
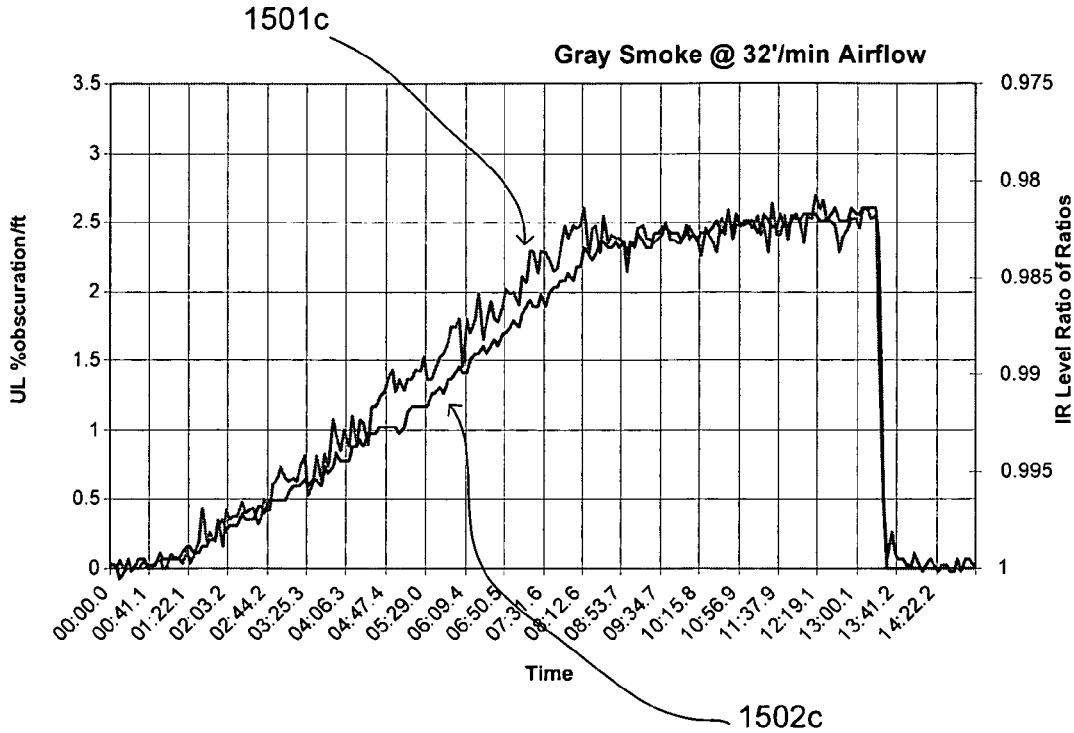
Figure 15D:
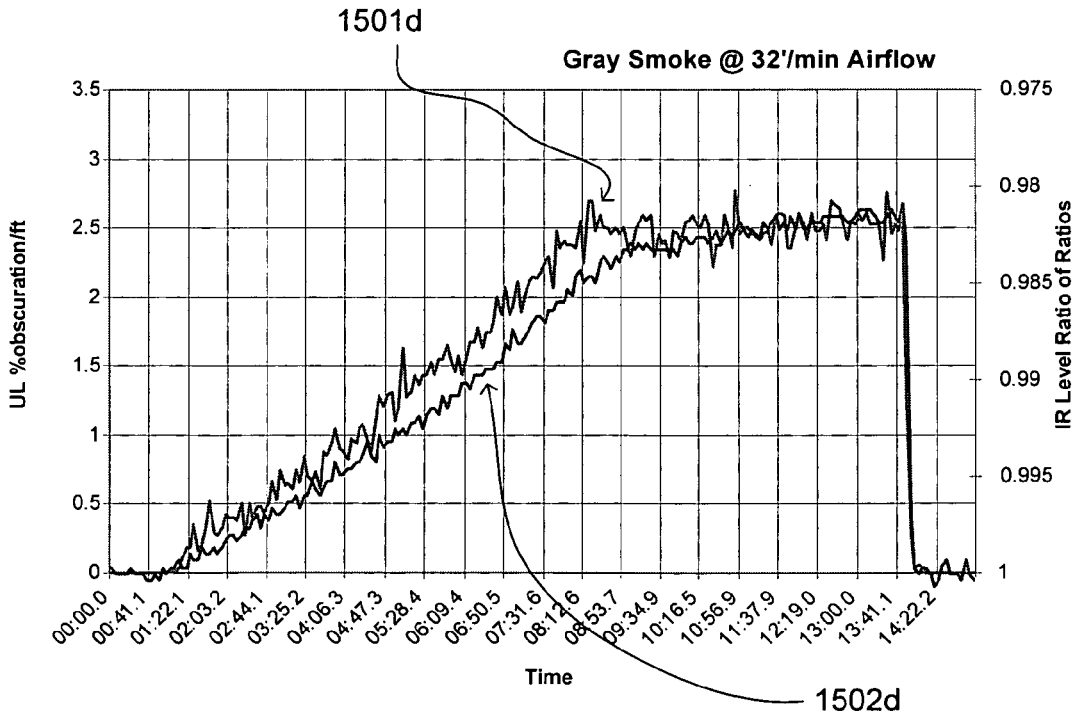
Figure 15E:
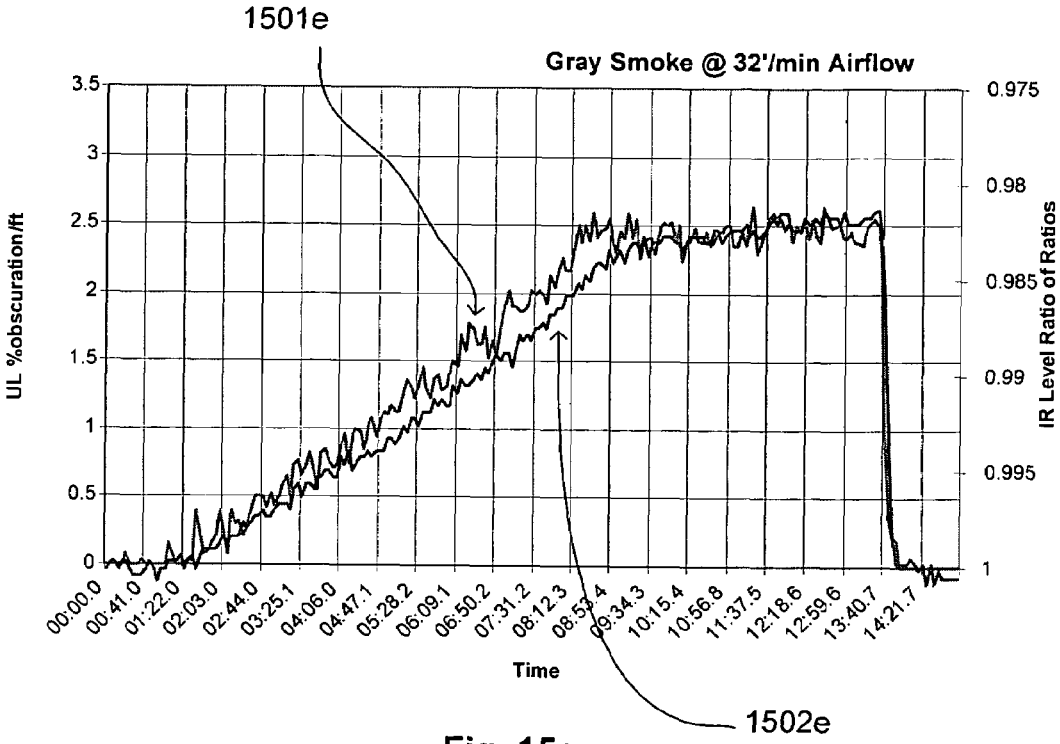
Figure 15F:
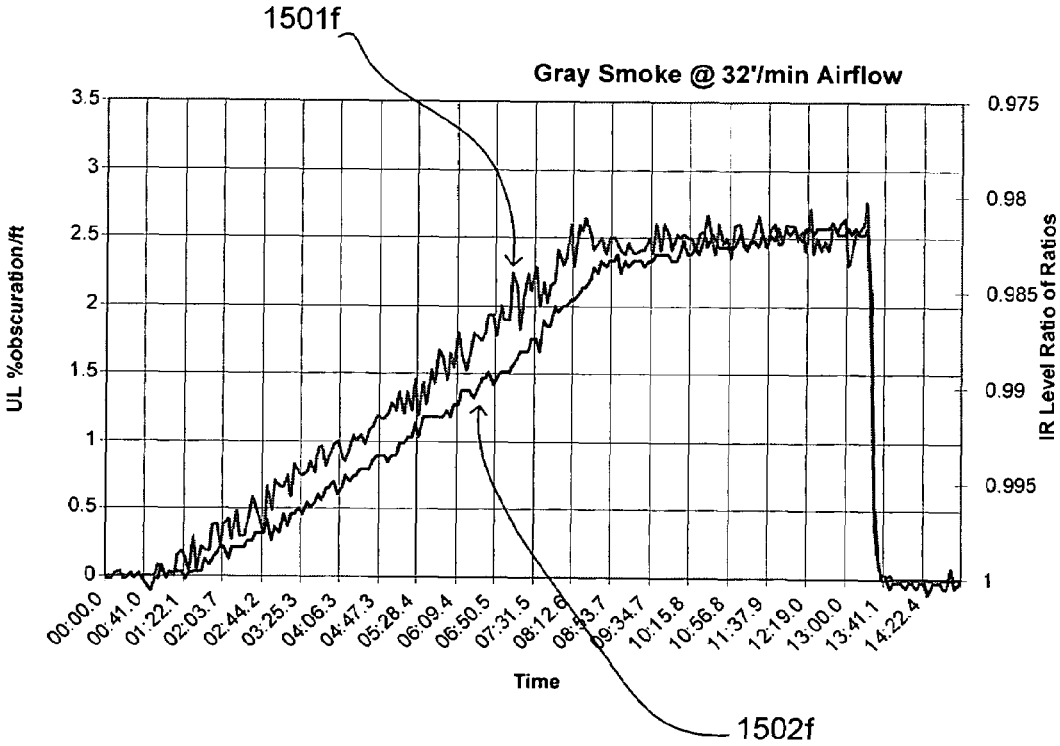
Figure 15G:
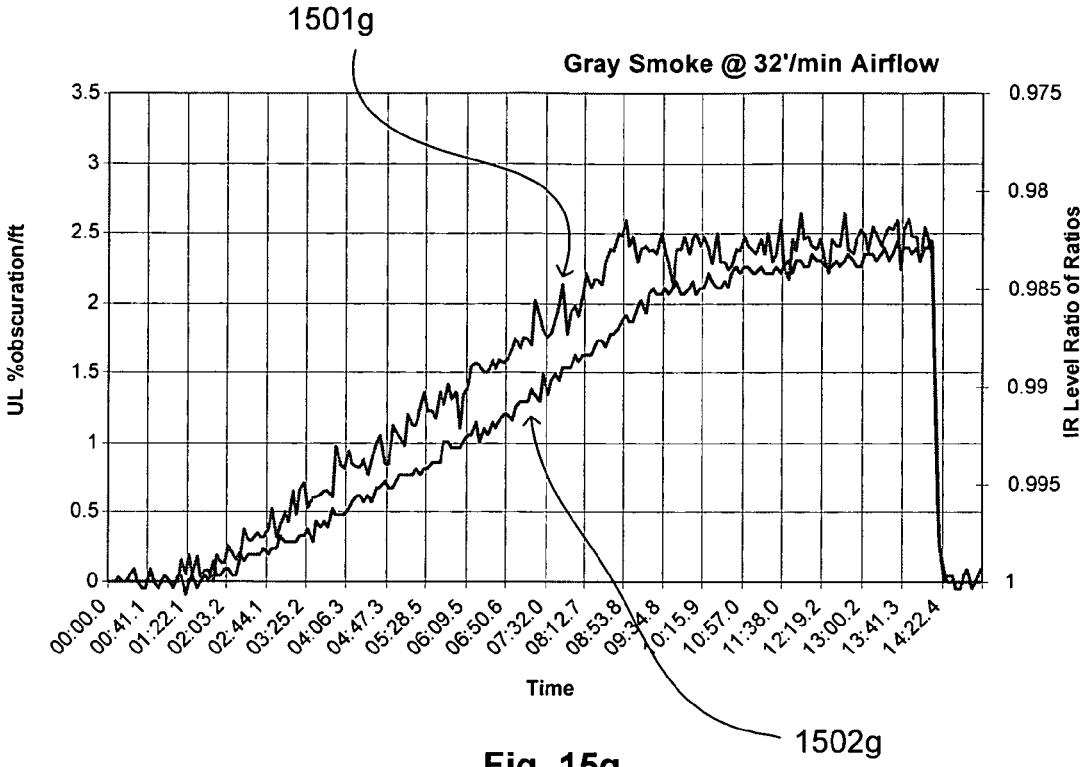
Figure 15H:
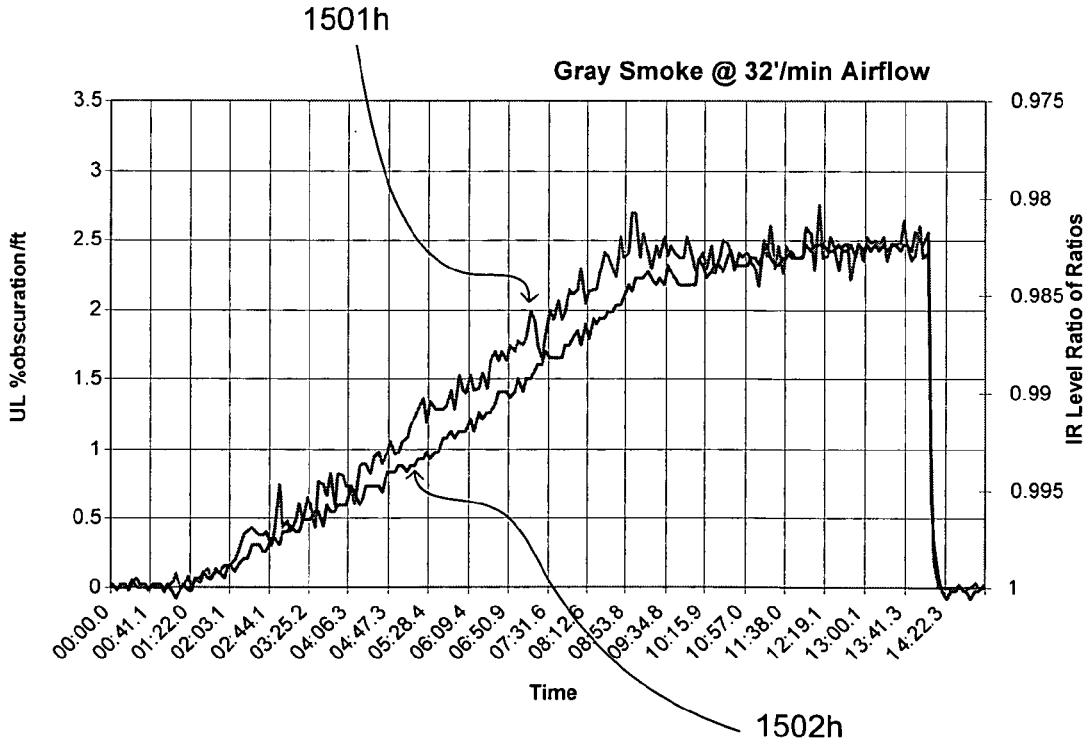
Figure 15I:
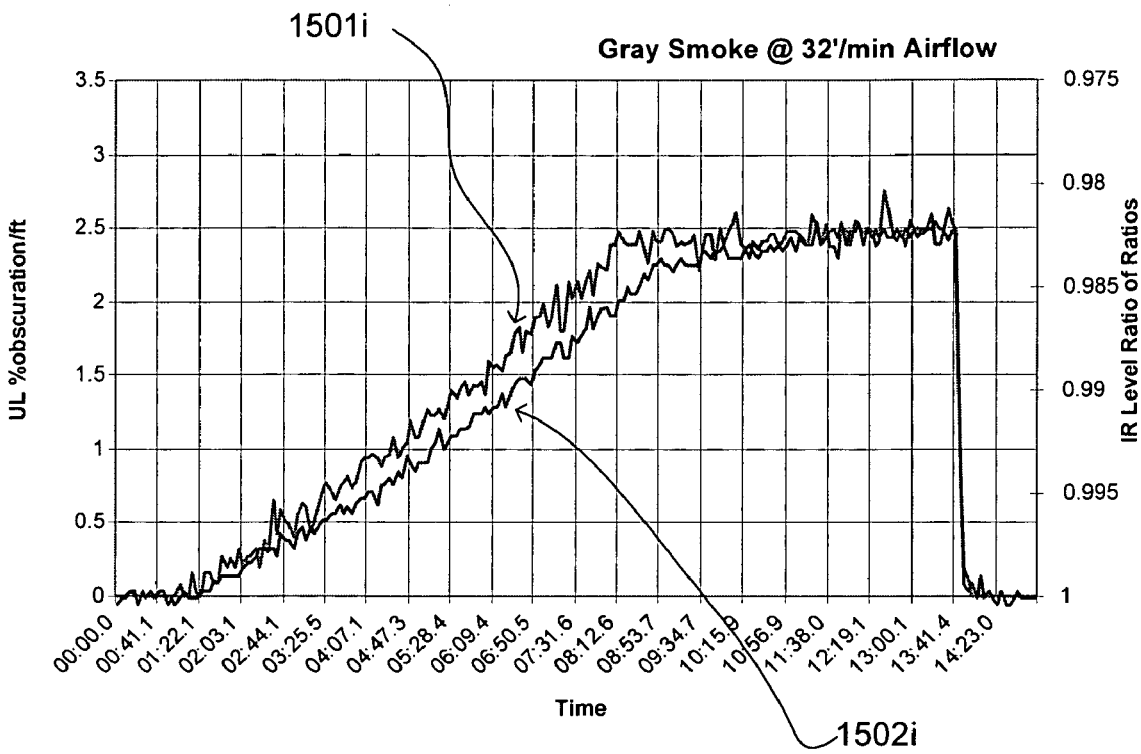
Figure 16A:
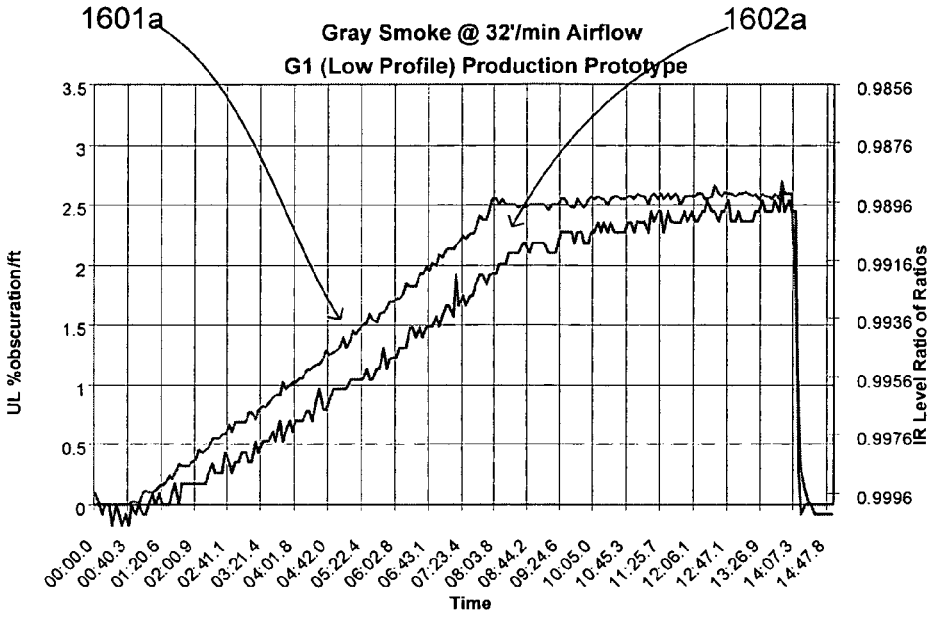
FIGS. 16*a*-16*b* depict response curves for one particle sensor embodiment of FIGS. 4*a*-4*i;*
Figure 16B:
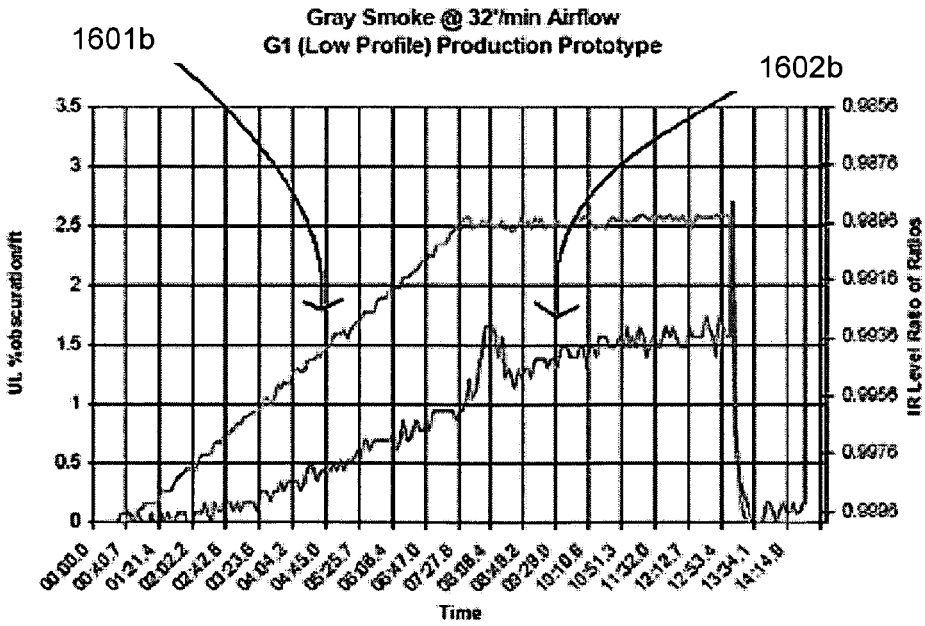
Figure 16C:
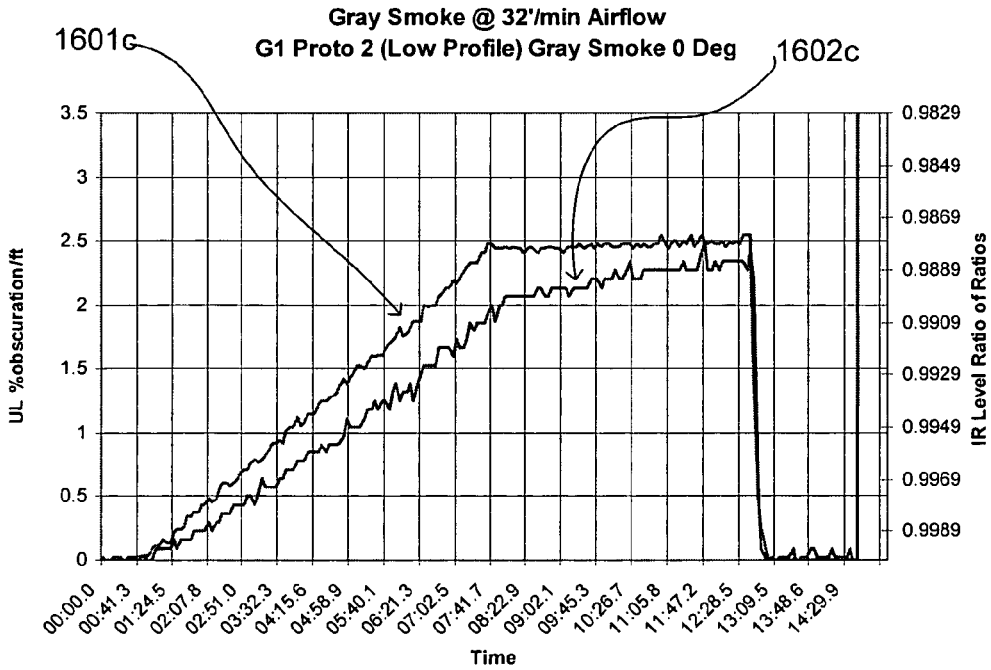
FIGS. 16*c*-16*d* depict response curves for another particle sensor embodiment of FIGS. 4*a*-4*i;*
Figure 16D:
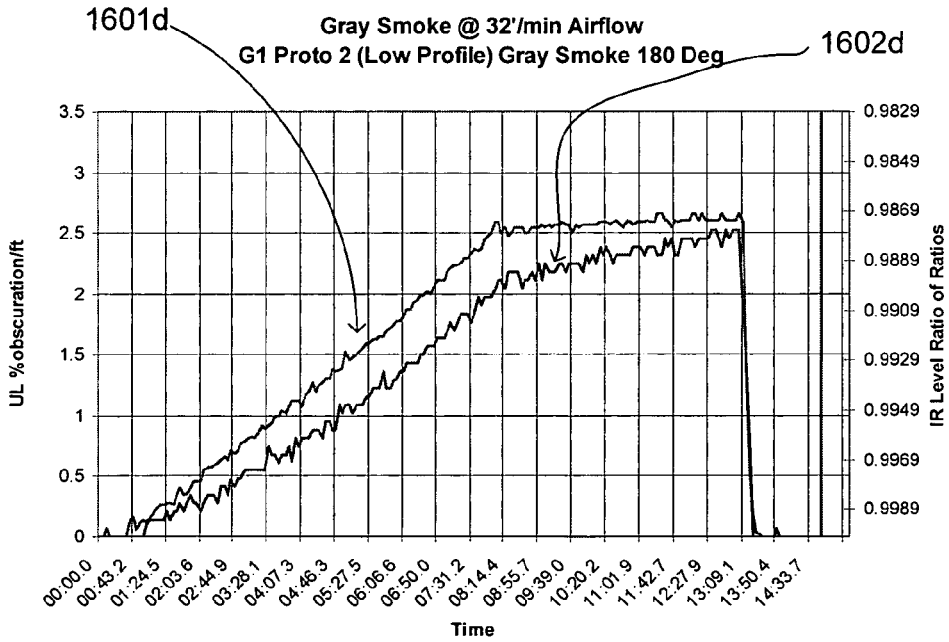
Figure 16E:
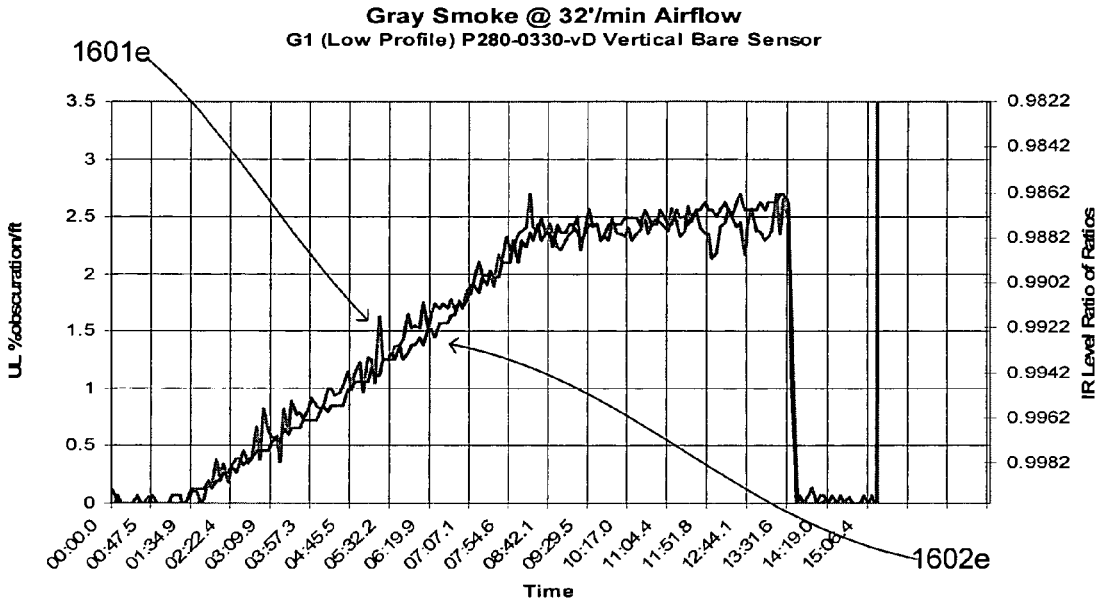
FIGS. 16*e*-16*m* depict response curves for the particle sensor embodiment of FIG. 4*k*.
Figure 16F:
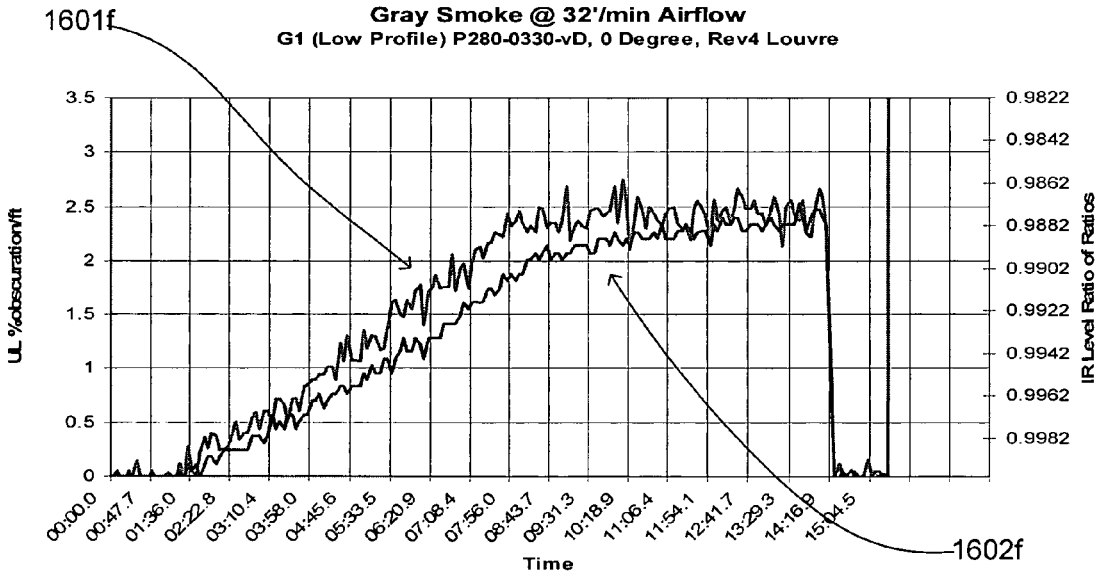
Figure 16G:
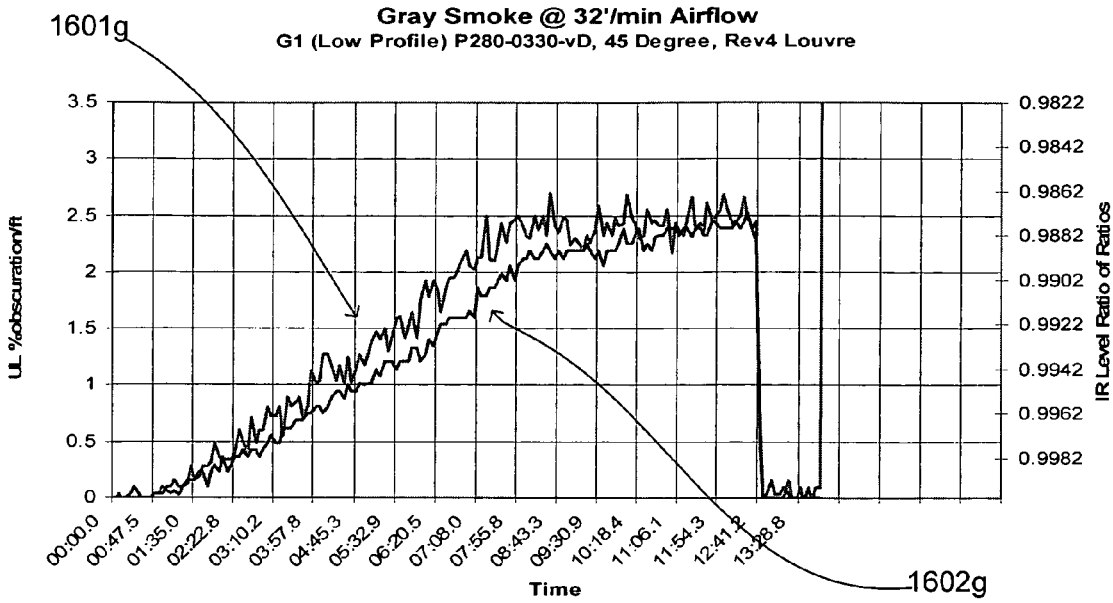
Figure 16H:
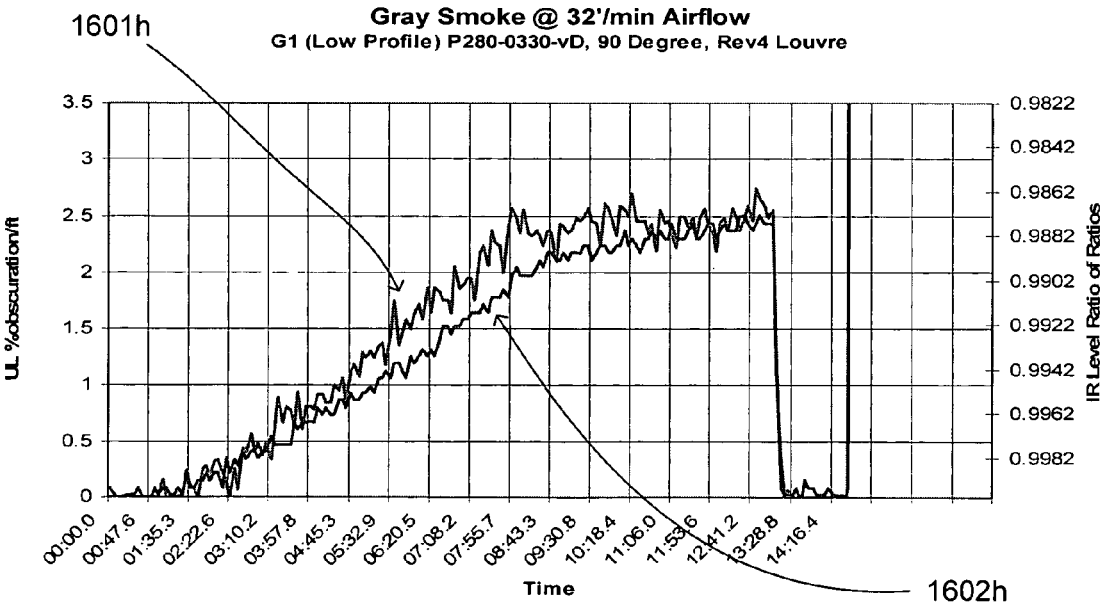
Figure 16I:
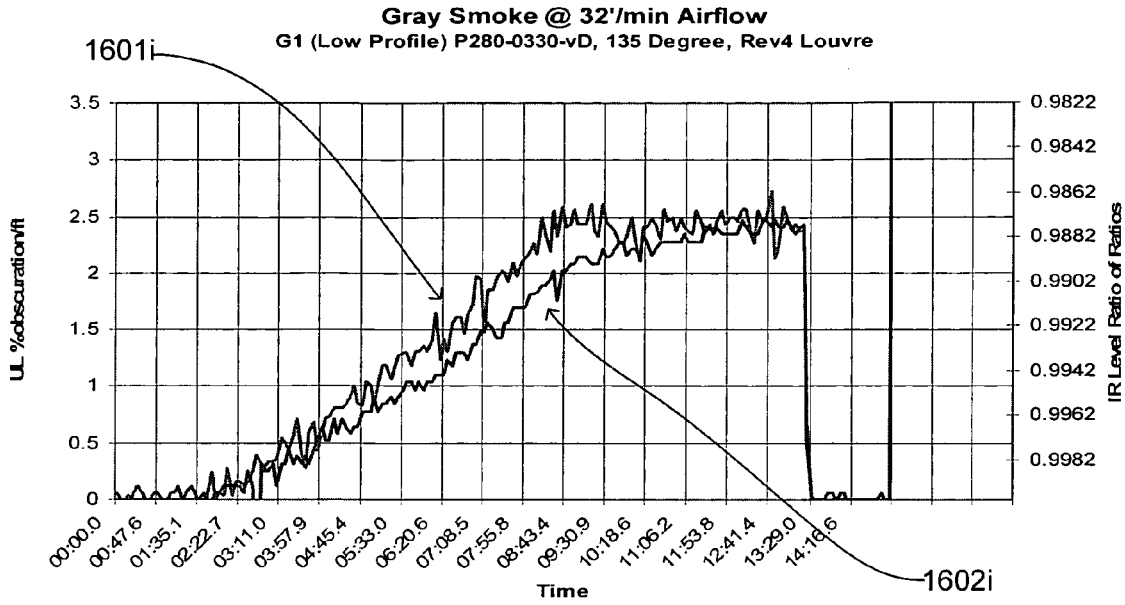
Figure 16J:
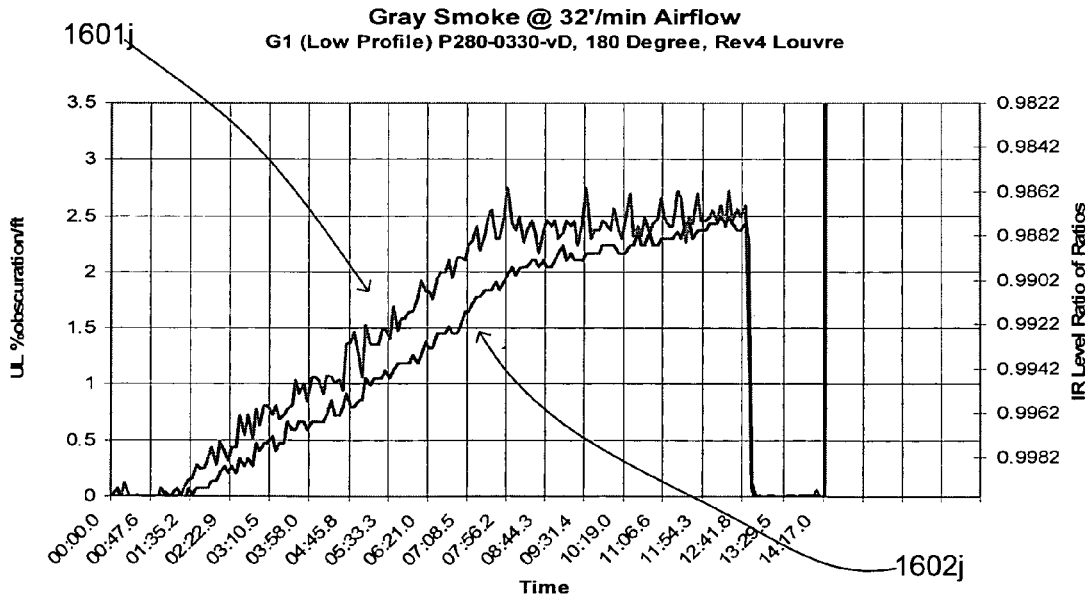
Figure 16K:
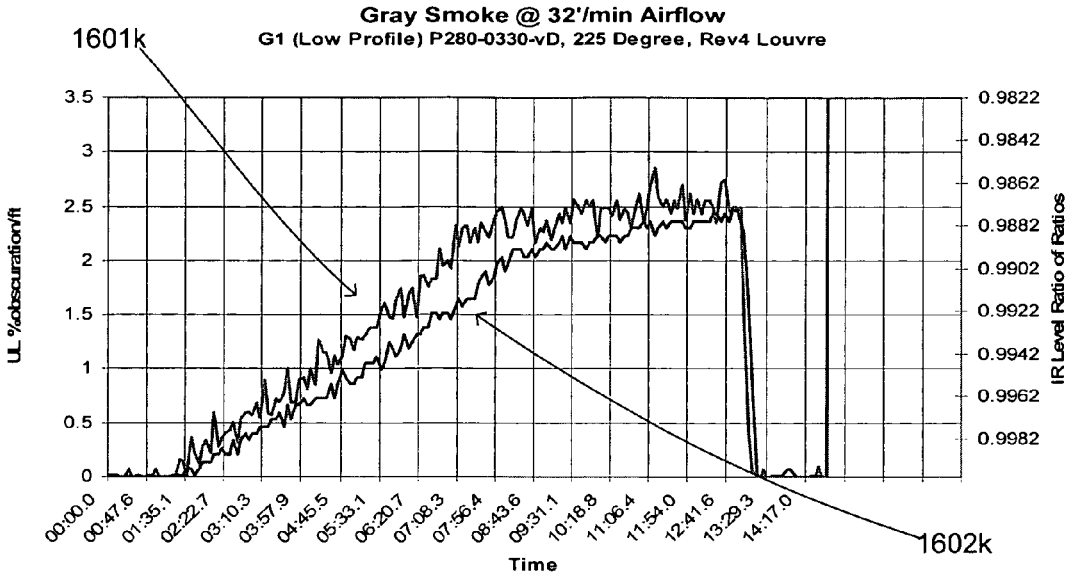
Figure 16L:
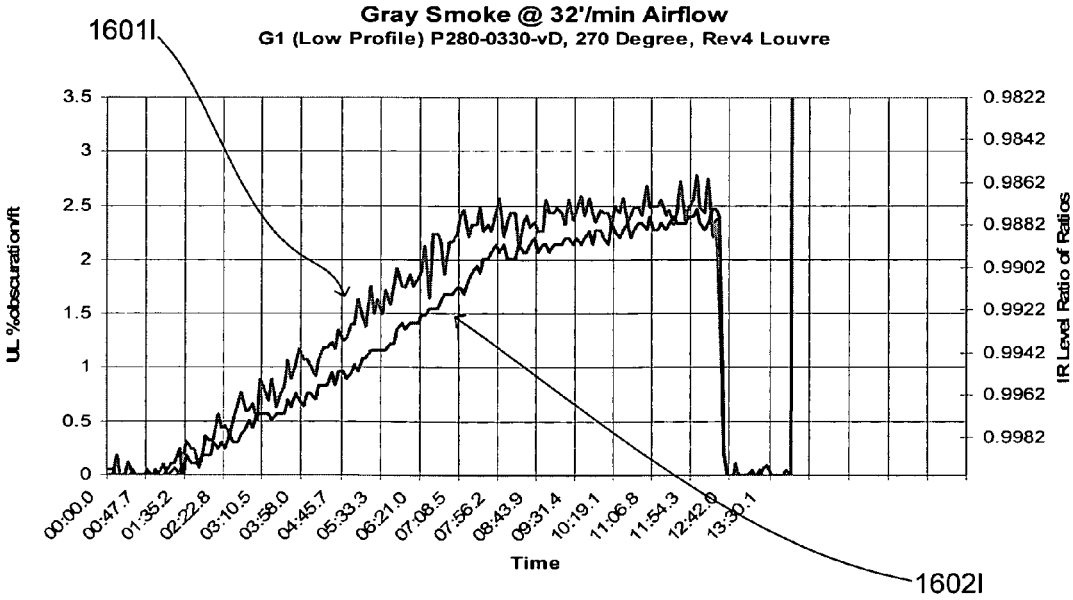
Figure 16M:
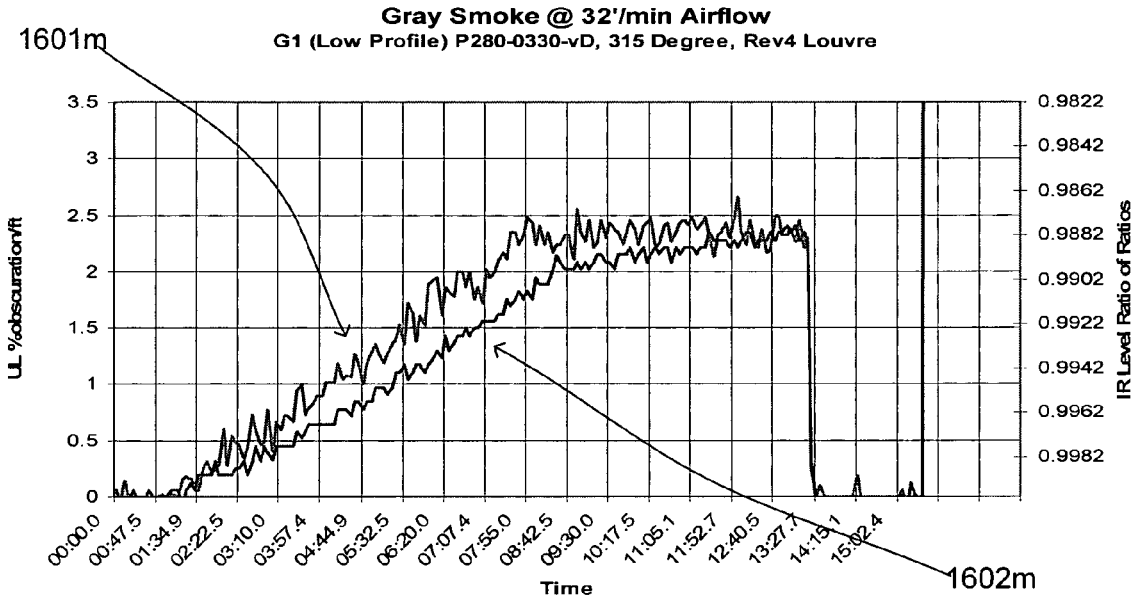

FIGS. 15*a-i* illustrate the directional sensitivity of the particle sensor embodied in FIGS. 3*a-d*. By analyzing these figures it can be determined that the threshold may be set at 83.3%. The directions of interest are those with the lowest sensitivity (FIG. 15*g* at 83.3%) and the highest sensitivity (FIG. 15*a* at 91.7%.) Internal calibration would be set at about 2.1%. Thus when the product is rotated with respect to smoke flow, the apparent alarm calibration would vary from about 2.3%/ft to about 2.5%/ft FIGS. 16*a* and 16*b* show the directional characteristics of a particle sensor without the aid of the airflow director including at least one ridge or foil. FIGS. 16*a* and 16*c* show the response at zero degrees without and with modification, respectively, to improve airflow respectively. In these four tests zero degrees corresponds to a rotation of the sensor such that the smoke cage is closest to the direction of incoming smoke. Referring to FIG. 4*h* this would correspond to the lower right edge being closest to the incoming smoke. FIGS. 16*b* and 16*d* corresponds to a 180 degree position, where the smoke cage is furthest away from the incoming smoke flow. In comparing FIGS. 16*a* and 16*c* no major difference is found, this is because the smoke cage is close to the perimeter where the incoming smoke is found and has sufficient airflow. FIG. 16*b* however illustrates that the particle sensor is not nearly as sensitive to smoke which comes in opposite the smoke cage. With the addition of an air foil 408*d* to the particle sensor the sensitivity increases markedly as shown in FIG. 16*d*. The more uniform set of responses, 16*c* and 16*d*, is preferred as this will allow a higher threshold setting, thereby preventing false alarms.

FIGS. 16*e*-16*m* depict response curves of the embodiment shown in FIG. 4*k*, which includes an airflow director. As with the other sets of response curves the first figure, 16*e*, is a comparison of the optics block being tested vs. a reference sensor which will be used to indicate the true particle level in the test chamber. FIGS. 16*f-m* are response curves plotted at 45 degree increments, starting at zero degrees and ending at 315 degrees. As can be seen, and calculated from the graphs, the ratio of smoke sensed vs. smoke known to be in the ambient air is as follows. The orientation of FIG. 16*f* with a ratio of 85.4%, FIG. 16*g* with 93.8%, FIG. 16*h* with 91.7%, and FIGS. 16*i*-16*m* all with 85.4%. In this embodiment the lowest ratio is 85.4% and thus the particle sensor would be set corresponding to this threshold.

In the preceding example, FIGS. 16*e-m*, a hole diameter of 0.041", providing an open area of 34% adjacent the "chimney" was used to achieve the results noted above. A more preferred hole diameter is 0.047" which provides an open area of 45%. A comparison of the "worst case" angle with 0.041" and 0.047" diameters yielded a ratio of 85.4% and 89.6% respectively. Based upon this test, by increasing the diameter of the holes to 0.047", corresponding to an open area of 45%, would allow the resulting particle sensor threshold to be 89.6%. Generally, the larger the diameter the faster smoke or other particles will enter the smoke chamber, however structural integrity and the need to deny entry to insects and other objects must also be considered. It may be useful to note that a faster response does not typically change the shape of the corresponding plots, rather it shifts the test data left by shortening the delay for detecting the particles.

Many modifications and variations of the present embodiments are possible. These changes can be minor, major, internal, external, physical or electrical. The preferred embodiment may be configured to achieve a least sensitive orientation of at least 55%, more preferably at least about 60%, more preferably at least about 65%, still more preferably at least about 70%, yet more preferably at least about 75%, even more preferably at least about 80%, and most preferably at least about 85%. For instance small modifications like variation of the hole size in a chimney embodiment will have a smaller effect than say adding an air foil to the same embodiment to improve the least sensitive side's sensitivity. In domed smoke cage related embodiments component layout will alter directional sensitivities. Another change which can affect the magnitude of the least sensitive orientation is the sweet spot "density" or focus, by having a more focused sweet spot it may be possible to receive more electrical signal which would increase sensitivity. By modifying the surface texture and or color the magnitude of the sensitivity can be increased, as discussed previously though this design choice may or may not be preferred. For instance, particle sensor 200 may have a modified smoke cage to limit airflow to the high sensitivity side. While this may decrease the overall variation in directional sensitivity it may simultaneously affect the least sensitive side by up to 10%, i.e. this new embodiment would have a least sensitive side sensitivity of about 60%. Yet another example may involve using a gradient of hole sizes in a chimney embodiment, the holes would preferably be sized inversely proportional to the directional sensitivity in order to further balance said directional sensitivity. Again this embodiment may affect the least sensitive side by roughly ±5%, depending on whether the least sensitive side's hole diameter was expanded, kept the same, or decreased. One skilled in the art will recognize that by modifying the disclosed embodiments a multitude of sensitivities can be achieved, some of which may be cost prohibitive.

A particle sensor comprising an aesthetic cover, a printed circuit board and a smoke cage, said particle sensor configured such that a least sensitive particle sensor orientation with respect to airflow has an associated sensitivity of at least 55%.

Yet another way to increase the signal to noise ratio is to perform electronic subtraction of the noise. A first significant contributor to noise is alternating current (A.C.) hum from the power supply. A second significant contributor to noise is unwanted reflections, typically from dust accumulation over time, sometimes referred to as a "glow". A third noticeable contributor to noise is ambient light leakage, this factor is typically resolved by complicated louvers and light labyrinths which shield the optics block from ambient light. All of these sources of noise could be compensated for mechanically but this would provide for a very cost prohibitive particle sensor, instead current designs are made with the most beneficial noise preventing elements that can be added without making the particle sensor prohibitively expensive. By electronically subtracting noise from the signal some, if not all, of the mechanical noise preventing solutions may be unnecessary. This can be done in a multitude of ways but the basic premise is that a reference reading (light source OFF) is compared to an actual reading (light source ON) to determine the component(s) which are due to light source only, the readings are taken at the optical transducer.

Figure 17A:
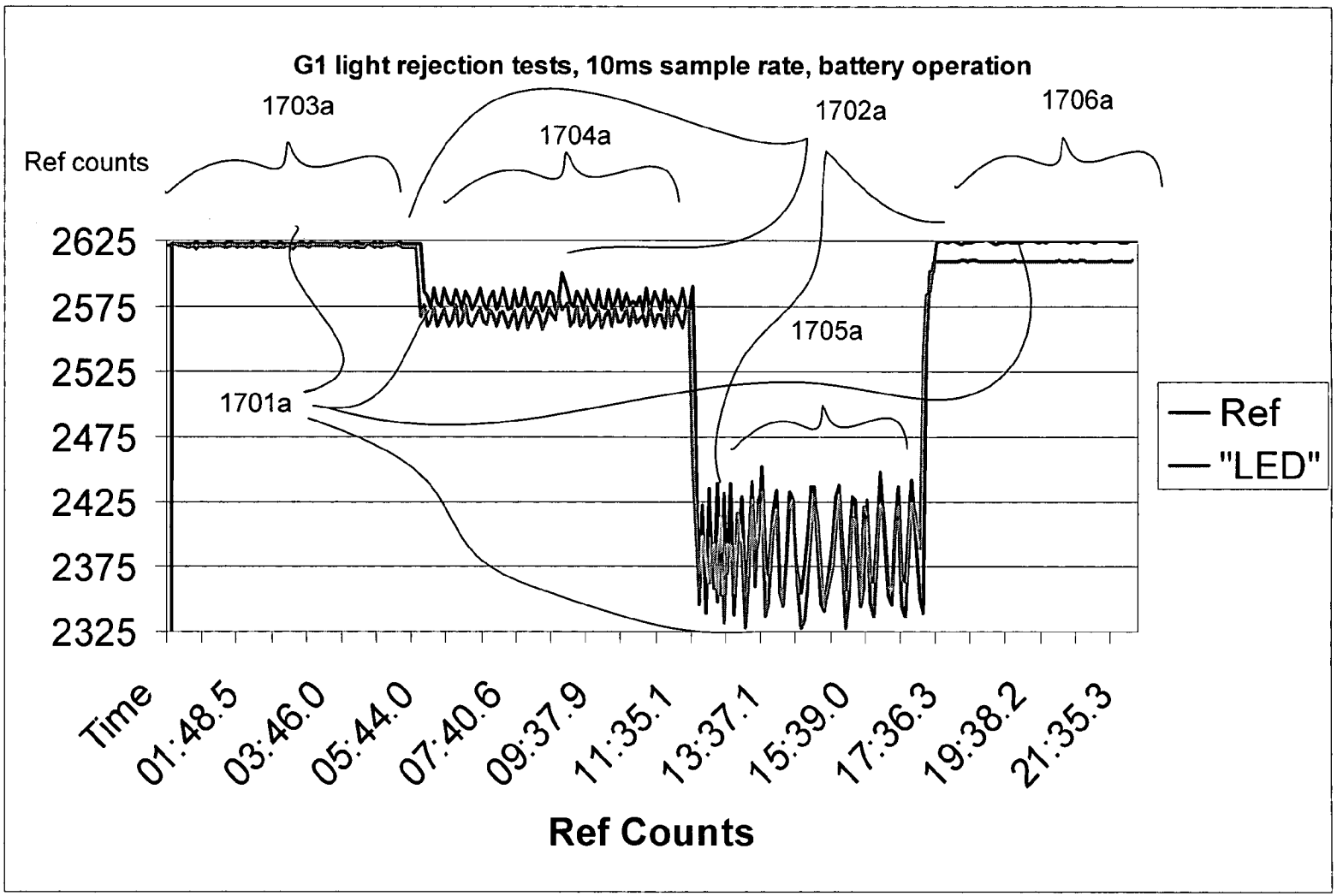
FIGS. 17*a*-17*g* depict various plots of noise rejection schemes.

In one embodiment a standard timer is used as a delay between the reference reading and the actual reading(s), these data points will be referred to as a sample pair hereinafter. The timing between the readings is chosen to simply be as close together as possible to minimize the effects of any transients in the optical and electrical system. In one embodiment, FIG. 17*a*, 17*b*, the time delay between readings is 10 ms; this corresponds to at least 5 time constants of the capacitive system to allow for a full discharge. In this way, at least, thermal drift within the optical transducer may be effectively negated.

FIGS. 17*a*, 17*b*, 17*c*, 17*d* are plots corresponding to a light rejection method based on changing the delay between the reference and actual sample readings during different light conditions. These tests were run in a lab environment, lit by fluorescent lighting along with some incandescent desk lamps, on an assembled particle sensor with the aesthetic cover removed, see FIG. 4*h*, or FIG. 4*a*. It is helpful to keep in mind that the reference signal 1702*a* is measured at the optical transducer without activating the light source. The actual reading 1701*a*, is taken at the optical transducer while the light source is activated. The output signal is a function of both the actual and reference which indicates noise or particles in the environment when the output dips below 1. A reading of 1 for the "ratio of ratios" (vertical axis of FIG. 17*b*, 17*d*) corresponds to no difference in the pair of signals 1701 and 1702. A "ratio of ratios" greater than 1 means that during the reference reading more light was present than during the actual reading. Also bear in mind that "A.C. hum" is a contributor to noise so in the light rejection tests, FIG. 17*a*, 17*b*, 17*c*, 17*d*, a D.C. battery is used.

Figure 17B:
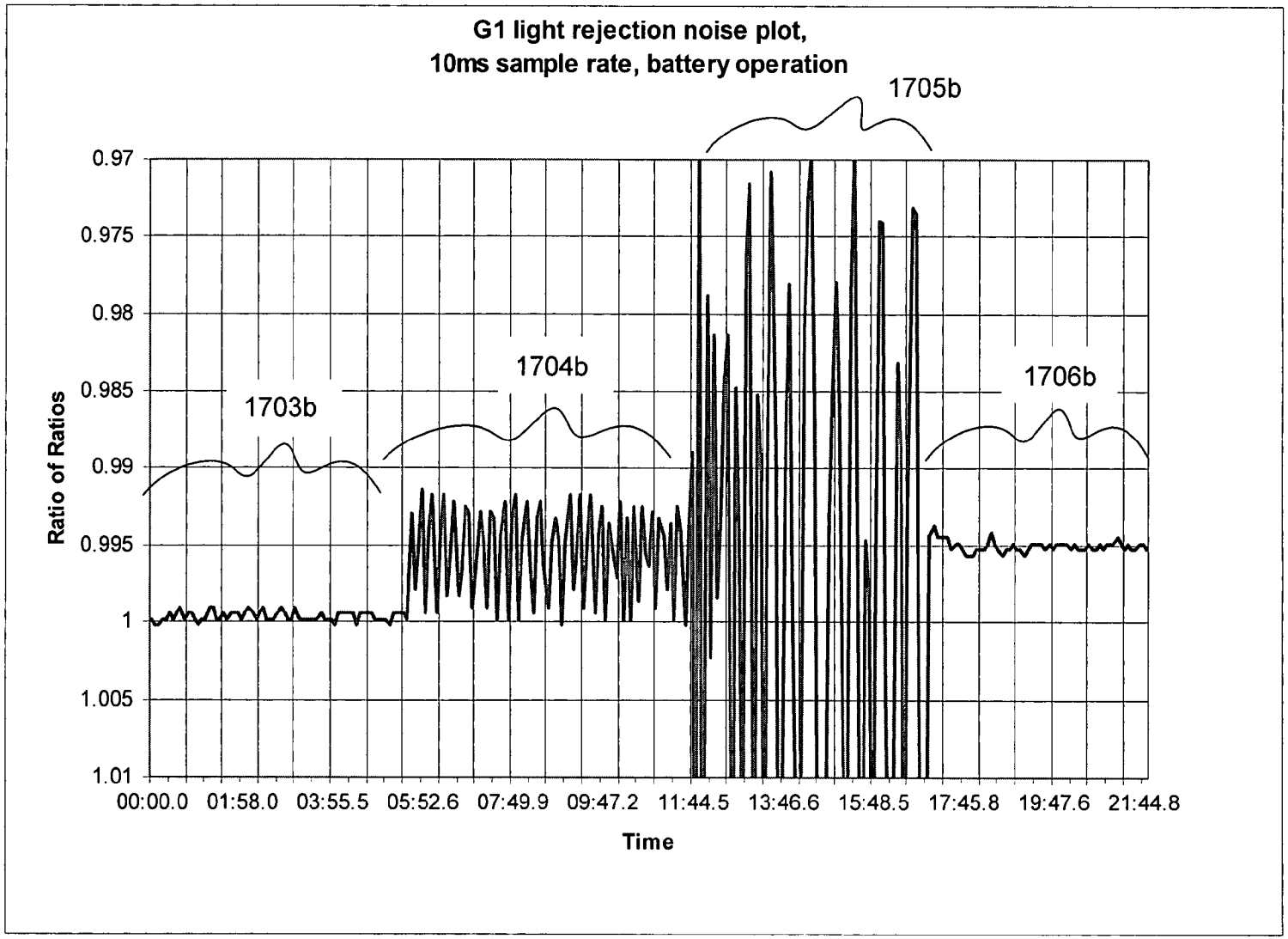

During time period 1703*a*, 1703*b* the optical transducer is physically blocked while the test room is dark thus providing a very accurate measurement as indicated in FIG. 17*b*. Time period 1704*a*, 1704*b* corresponds to a low ambient light condition without the light transducer blocked, thus what you see is noise from light pollution which is visible with reference to 1704*b*, note that the "ratio of ratios" is less than one. The third period of time, 1705*a*, 1705*b* corresponds to a high ambient light condition which when samples at 10 ms produces significant noise in the output signal over time period 1705*b*. Finally time period 1706*a*, 1706*b* corresponds to a relatively dark room, where the optical transducer is not blocked. As seen over time period 1706*b* this light pollution is relatively insignificant.

Figure 17C:
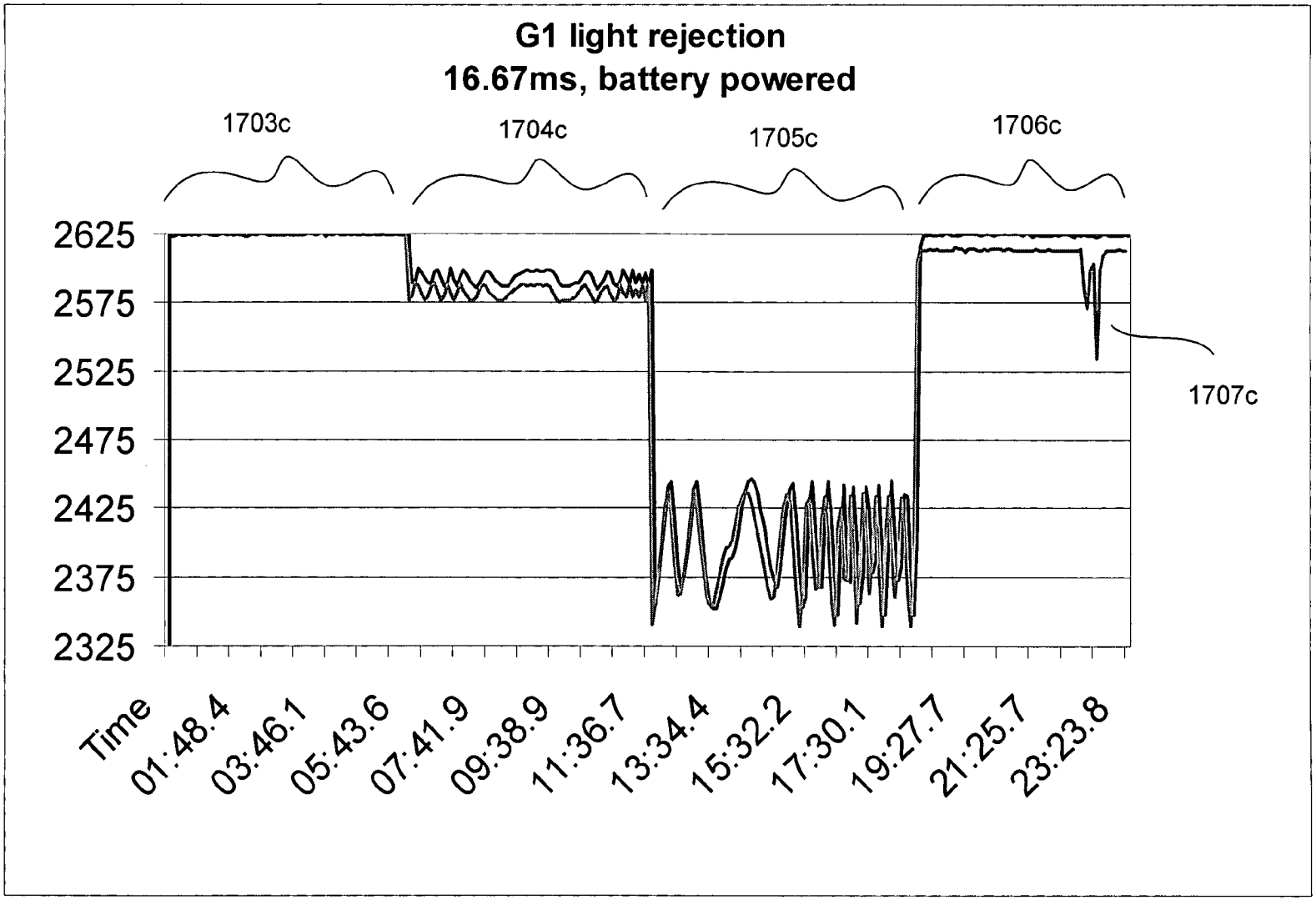
Figure 17D:
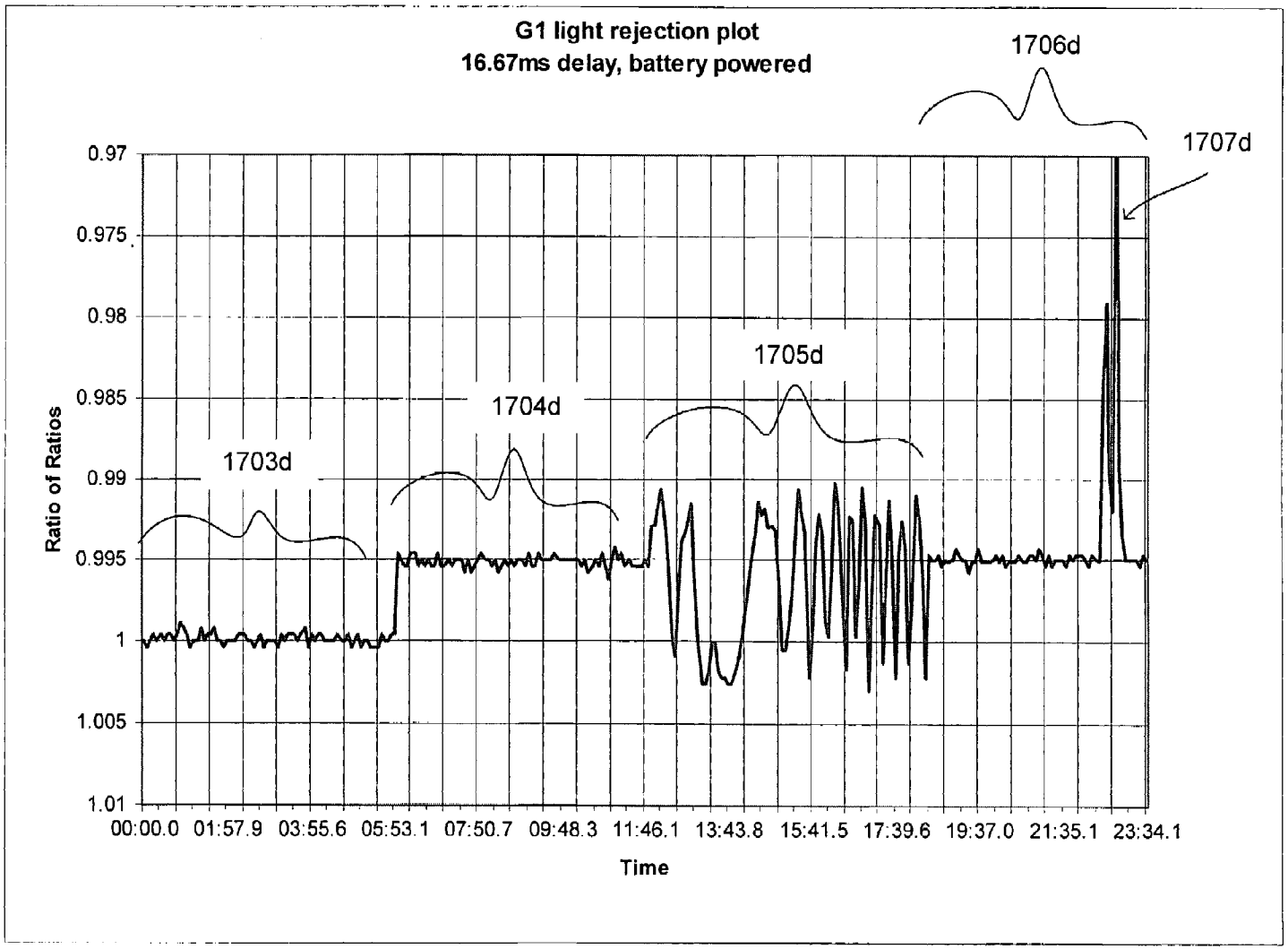

In a related embodiment, FIG. 17*c*, 17*d*, a specific delay time is allowed to elapse between the reference reading, 1702*a*, and the actual reading 1701*a*. In the United States this specific delay time is preferably 0.01667 sec., which corresponds to the frequency at which the power is being modulated i.e. 60 Hz. In other countries the delay time will also correspond to the power frequency which may be 50 Hz yielding a delay of 0.02 sec. In this particular embodiment the period may be set at the factory by designating a geographic region in which the particle sensor will be sold. An alternative design is to include a button or switch that can be selected or toggled, preferably by an installation technician, to select the frequency at which power in the geographic location is modulated. By using the reference and actual readings (sample pair) thermal noise and, or, noise due to light pollution can be reduced or even eliminated.

As seen in FIGS. 17*c*, and 17*d* by using a 16.67 ms time delay between the reference and actual readings, noise from A.C. modulated light sources can be significantly reduced. The same lighting conditions and changes in lighting are used as were present in FIGS. 17*a*, and 17*b* with the addition of some smoke introduced very late in the test while the room is dark to show the general effect of smoke (1707*c*, 1707*d*). It is important to note that if you look carefully at FIG. 17*c* the reference and actual readings are more in phase with each other than in the previous embodiment, FIG. 17*a*. The reason noise due to A.C. modulated light and, or, "A.C. hum" may be reduced is because the samples are taken at the same, or a positive non-zero integer multiple of the modulated light period. In essence, the modulated light, or phase dependent noise, is in the same state, or amplitude, at both times when the readings are taken. It is not necessary for the time delay to be equal to one period of the modulated light, a multiple of that period will work as well, as long as one keeps in mind component tolerances in the timing devices and any deviations from ideal in the power frequency. Choosing too long of a time delay could cause timing errors with respect to the phase to be sampled at and, or, the light to be rejected may have manually changed state. The preferred delay time is equal to one period of the modulated power frequency since it is not unreasonable to achieve with current electronic devices and minimizes power use by keeping the "device ON" time, during sampling, short.

Figure 17E:
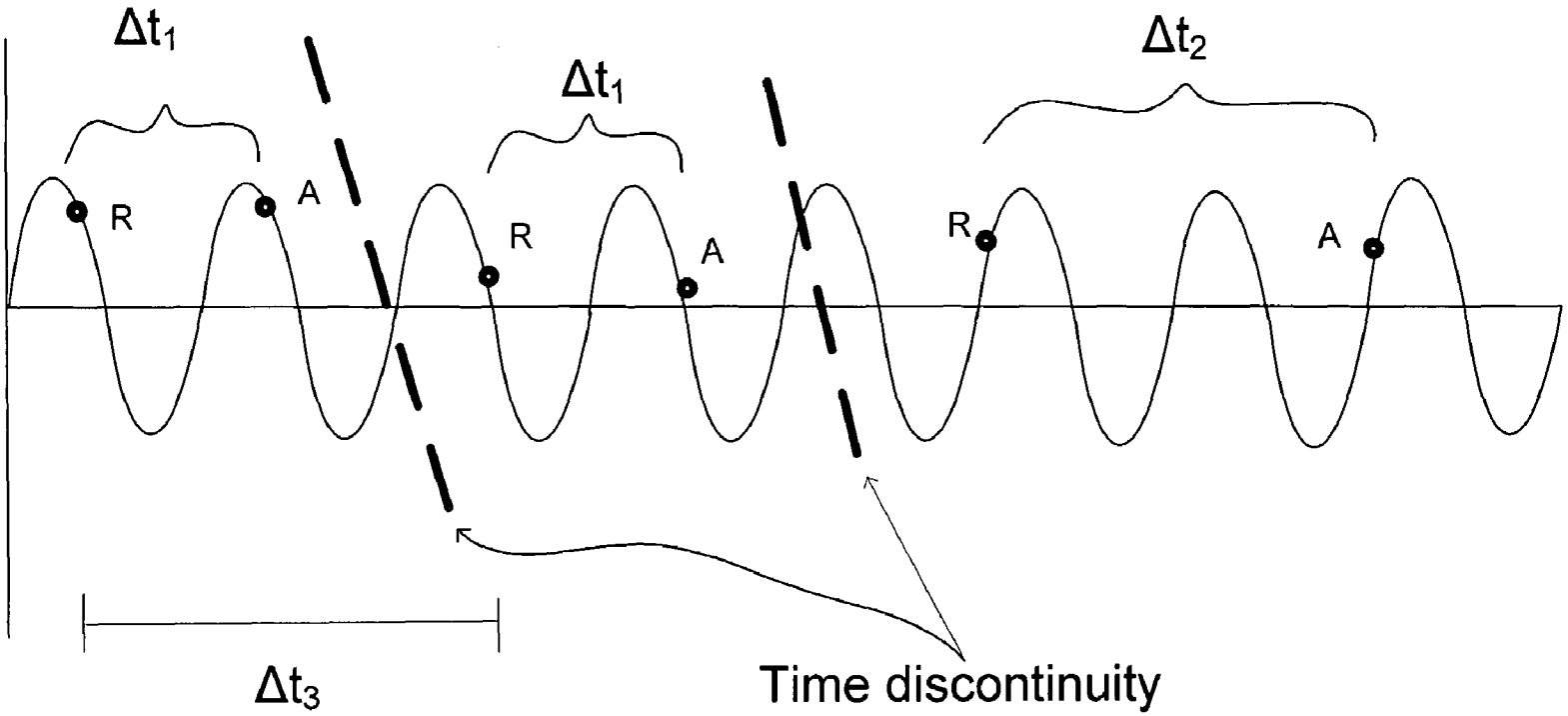
Figure 17F:
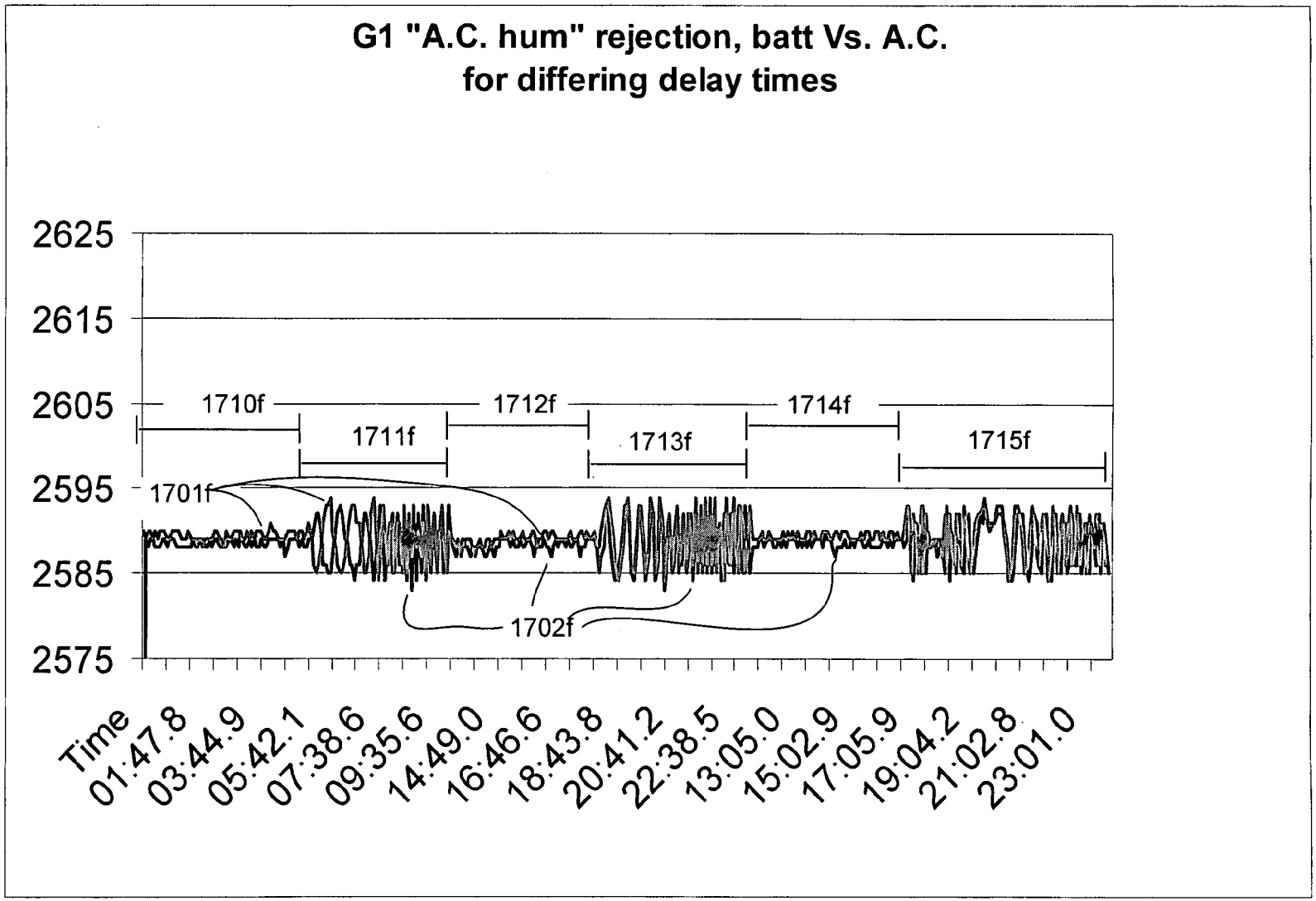

Interestingly enough, by taking consecutive samples at the same or positive integer of the modulated power frequency "A.C. hum" may also be significantly reduced. In the previous figures battery power was used in order to achieve a controlled test by eliminating significant, the noise introduced by A.C. power. In the following figures, 17*e*, 17*f*, 17*g*, battery power will be used as a reference to compare a series of different delay times. FIG. 17*f* is actually 3 consecutive test runs spliced together into one graph. Both FIGS. 17*f*, and 17*g* were run in a dark room on an assembled particle sensor, with the aesthetic cover on, in order to minimize light pollution.

Figure 17G:
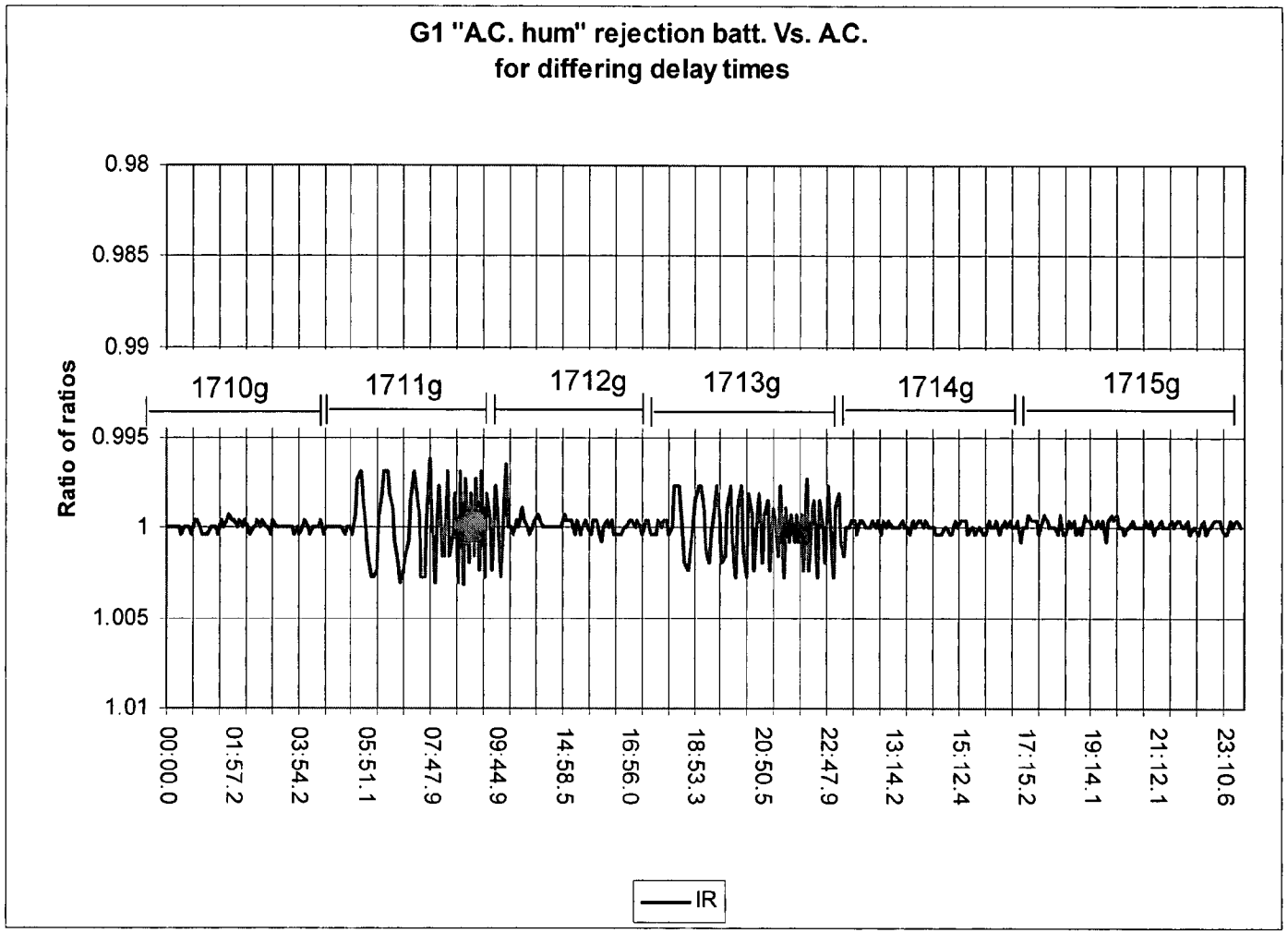

As seen in FIGS. 17*f* and 17*g*, when the particle sensor is using battery power, 1710*f*, 1712*f*, 1714*f*, 1710*g*, 1712*g*, 1714*g*, the noise level is relatively low. When using A.C. power, 1711*f*, 1713*f*, 1715*f*, 1711*g*, 1713*g*, 1715*g*, the noise level is significantly higher, except when the delay between samples is significantly equal to the period of modulation of the device power. Time periods 1710 and 1711 *f* and *g* respectively refer to a delay time of 10 ms. Time periods 1712 and 1713 *f* and *g* respectively refer to a delay time of 14.1 ms. Time periods 1714 and 1715 *f* and *g* respectively refer to a delay time of 16.67 ms. By now the reader should be able to infer, correctly, that the power was modulated at 60 Hz during these tests. The battery power was used as a reference to show an appropriate signal level without "A.C. hum".

By taking consecutive reference and actual readings at the same phase angle sources of noise which are frequency dependent, such as fluorescent lights, pulse width modulated LED lighting, brushed motors, and some types of dimmer switches can be compensated for. In the previous embodiment where the reference and actual readings were made sequentially very quickly it is entirely possible to take a reference reading at a zero crossing (fluorescent light is OFF) and then take the actual reading at a peak of the A.C. wave (fluorescent light is now ON). The importance of taking the reference and actual readings at the same phase angle should be clear, by doing so noise from both A.C. hum and light pollution may be compensated for.

In a third embodiment of the noise compensation means the optical transducer may be turned on for a sufficient period of time to allow it to capture the ambient light level, including any modulated light sources. In order to capture modulated light sources an analyze their frequencies an upper limit may be set on the capture time, for instance 0.5 sec, or 1 sec. to save power and, or, minimize erroneous readings from lights which may be manually switched on or off during the sample period. The optical transducer's signal may be processed by a microprocessor or by discrete components to find the frequency, if any, ambient light is modulated. Once the frequency is known the delay between a reference reading and an actual reading can be adjusted to allow the optical transducer to take readings which correspond to significantly identical phase angles on the modulated wave. In this manner variable frequency light sources can be compensated for.

In a fourth embodiment 3 or more readings are made to compensate for noise. In the case where light is modulated at a different frequency than that of the power to the particle sensor having only 2 readings may not be optimum for noise compensation. In this embodiment 3 or more readings are made, preferably, a reference reading, an actual (light) reading and an actual (power) reading. In this case 2 calculations for noise compensations may be made with 2 measurements used by each calculation; the reference reading may serve as the reference for both the light and power actual readings. In a similar embodiment measurements can be made sequentially by measuring a reference and actual (light) then again a reference and actual (power). In this manner 4 readings would be made and used for noise compensation calculations, 2 reference, and 2 actual measurements.

It is important to note that noise being carried on the A.C. waveform can be located both randomly and concentrated on specific phases of the wave. For instance an inexpensive dimmer used for controlling household lighting actually chops the 60 Hz waveform at certain levels, the levels correspond to the selected light level. This chopping of the waveform creates noise which is higher at certain phases of the wave. Other devices which generate noticeable noise include brushed motors used in fans, etc . . . To address this phenomenon it may be beneficial to allow for the specific time period to "float" on the waveform so that it isn't always reading at the same phase angle on the wave. This can be achieved by allowing for a less precise delay device to be used between sets of sample pairs, thus consecutive sets of sample pairs may not fall at the same phase angle of the modulated power wave. An example of this can be visualized by looking at FIG. 17*e*. For example, the tolerance of the delay device (creating $\Delta t_1$) is ±0.05%, and the tolerance of the sleep device (creating $\Delta t_3$) is ±2.0%. In this example the delay tolerance keeps the sample pair at substantially the same phase angle for each reading while the sleep tolerance allows consecutive sets of sample pairs to "float" over different phases of the wave. As seen in FIG. 17*e*, $\Delta t_2$ is illustrative of the case where the period of the modulated power, or light, is half the delay period. If, for example the sleep time is 6.0 seconds then a 2% tolerance encompasses approximately ±10 cycles. Note that the delay time between the reference and actual measurement is not allowed to change significantly.

The above discussion and figures are not intended to limit the use of the electronic noise correction means to only the particle sensor of FIG. 4. It is to be understood that the electronic noise correction means set forth above is applicable on any type of sensor. In fact, once implemented it may allow for cost savings to be realized by reducing and, or, eliminating other mechanical and, or, electrical components previously dedicated to controlling or suppressing noise.

Optionally, an obscuration, or ionization type sensor, any combination of or sub combination thereof, may be added to any of the previously described particle sensors to facilitate a variable alarm threshold, as taught in commonly assigned application Ser. No. 09/844,229, entitled "COMPACT PARTICLE SENSOR", filed Apr. 27, 2001, or U.S. Pat. No. 6,225,910 entitled "SMOKE DETECTOR". The entire disclosures of which are hereby incorporated by reference. Also, as discussed in the previously incorporated applications the optical path length may be increased by using reflective elements.

Additionally or optionally, it may be desirable to design the smoke chamber such that the internal volume acts as a resonant cavity for the sounder. The internal volume can be calculated according to the Helmholtz formula. A somewhat similar example can be found in WO 2005/020174, entitled "A COMPACT SMOKE ALARM".

Preferably, a "smokeless" method of producing a "calibrated" product is employed. Not having to introduce smoke chambers into the production line is desirable. The assembled sensors in accordance with the embodiments preferably result in performance repeatability from sensor to sensor. Preferably, only particle sensor samples for quality control need to be exposed to smoke. Labor savings in production is one advantage of various embodiments.

Combining smokeless production with the preferred "modular" snap together particle sensor results in a low cost and, or, highly accurate particle sensor. Manufacturing methods in accordance with the present embodiments exploit either of, or both of, these features.

Many modifications and variations of the present embodiments are possible in light of the above teachings. Thus, it is to be understood that, within the scope of the appended claims, the embodiments may be practiced otherwise than as specifically described above. All sensors within the doctrine of equivalents should be considered to form a part of this specification.

What is claimed is:

1. A particle sensor, comprising:

a light source, an optical transducer and a controller; said controller in communication with said light source and said optical transducer, said controller is configured to reject substantially all signals except those contributed by said light source, wherein said controller is further configured to analyze a first output of said optical transducer taken at a first time while said light source is off.

2. A particle sensor as in claim 1 wherein said controller is further configured to analyze a second output of said optical transducer taken at a second time while said light source is on.

3. A particle sensor as in claim 2 wherein the particle sensor is configured to accept modulated power, said controller is further configured to delay said second output by a specific time delay.

4. A particle sensor as in claim 3 wherein said specific time delay is substantially a positive non-zero integer multiple of an input power source period.

5. A particle sensor as in claim 4 wherein said specific time delay is substantially equal to 1 period of an input power source.

6. A particle sensor as in claim 1 further comprising a chimney, an aesthetic cover, a circuit board, and a smoke cage at least partially defined by at least a portion of said chimney, at least a portion of said printed circuit board and at least a portion of said aesthetic cover.

7. A particle sensor as in claim 6 further comprising an alarm threshold.

8. A particle sensor as in claim 6 having a signal to noise ratio of 4:1 or greater.

9. A particle sensor configured to be mounted to a substantially planar surface, comprising:

an aesthetic cover, a chimney and at least one additional component, wherein at least a portion of said aesthetic cover, at least a portion of said chimney, and at least a portion of said at least one additional component at least partially defines a smoke cage, wherein airflow through said smoke cage flows substantially perpendicular to the substantially planar mounting surface; and a light source, an optical transducer, and a controller in communication with said light source and said optical transducer, wherein the controller is configured to analyze a first output of said optical transducer taken at a first time while said light source is off.

10. A particle sensor as in claim 9 further comprising an alarm threshold.

11. A particle sensor as in claim 9 wherein said chimney comprises an optics block.

12. A particle sensor as in claim 11 wherein said chimney is constructed from a first portion and a second portion.

13. A particle sensor as in claim 12 wherein said first portion and second portion are configured to removably snap together.

14. A particle sensor as in claim 12 wherein said first portion and second portion are permanently attached to each other.

15. A particle sensor as in claim 9 wherein said smoke cage further comprises at least one finished surface.

16. A particle sensor as in claim 15 wherein said at least one finished surface comprises a low luster surface.

17. A particle sensor as in claim 16 wherein said at least one finished surface is substantially black.

18. A particle sensor as in claim 9 having an associated signal to noise ratio of 4:1 or greater.

19. A particle sensor as in claim 18 having an associated signal to noise ratio of 5:1 or greater.

20. A particle sensor as in claim 9 further configured such that a least sensitive particle sensor orientation with respect to airflow has an associated sensitivity of at least about 75%.

21. A particle sensor as in claim 9 further configured such that a least sensitive particle sensor orientation with respect to airflow has an associated sensitivity of at least about 90%.

22. A particle sensor as in claim 9 wherein said at least one additional component is a printed circuit board having an area configured to allow airflow therethrough.

23. A particle sensor as in claim 22 further comprising an alarm threshold.

24. A particle sensor as in claim 22 wherein said chimney comprises an optics block.

25. A particle sensor as in claim 24 wherein said chimney is constructed from a first portion and a second portion.

26. A particle sensor as in claim 25 wherein said first portion and second portion are configured to removably snap together.

27. A particle sensor as in claim 25 wherein said first portion and second portion are permanently attached to each other.

28. A particle sensor as in claim 22 wherein said smoke cage further comprises at least one finished surface.

29. A particle sensor as in claim 28 wherein said at least one finished surface comprises a low luster surface.

30. A particle sensor as in claim 29 wherein said at least one finished surface is substantially black.

31. A particle sensor as in claim 22 having an associated signal to noise ratio of 4:1 or greater.

32. A particle sensor as in claim 31 having an associated signal to noise ratio of 5:1 or greater.

33. A particle sensor as in claim 22 further configured such that a least sensitive particle sensor orientation with respect to airflow has an associated sensitivity of at least about 75%.

34. A particle sensor as in claim 22 further configured such that a least sensitive particle sensor orientation with respect to airflow has an associated sensitivity of at least about 90%.

35. A particle sensor as in claim 9, further comprising a light source wherein the primary optical axis of light emitted from said light source is substantially parallel to the planar mounting surface.

36. A particle sensor as in claim 35 further comprising an alarm threshold.

37. A particle sensor as in claim 35 wherein said chimney comprises an optics block.

38. A particle sensor as in claim 37 wherein said chimney is constructed from a first portion and a second portion.

39. A particle sensor as in claim 38 wherein said first portion and second portion are configured to removably snap together.

40. A particle sensor as in claim 38 wherein said first portion and second portion are permanently attached to each other.

41. A particle sensor as in claim 35 wherein said smoke cage further comprises at least one finished surface.

42. A particle sensor as in claim 41 wherein said at least one finished surface comprises a low luster surface.

43. A particle sensor as in claim 42 wherein said at least one finished surface is substantially black.

44. A particle sensor as in claim 35 having an associated signal to noise ratio of 4:1 or greater.

45. A particle sensor as in claim 44 having an associated signal to noise ratio of 5:1 or greater.

46. A particle sensor as in claim 35 further configured such that a least sensitive particle sensor orientation with respect to airflow has an associated sensitivity of at least about 75%.

47. A particle sensor as in claim 35 further configured such that a least sensitive particle sensor orientation with respect to airflow has an associated sensitivity of at least about 90%.

48. A particle sensor as in claim 9 wherein said aesthetic cover further comprises a removable portion at least partially covering said chimney, said removable portion configured to be removed in a single step.

49. A particle sensor as in claim 48 further comprising an alarm threshold.

50. A particle sensor as in claim 48 wherein said chimney comprises an optics block.

51. A particle sensor as in claim 50 wherein said chimney is constructed from a first portion and a second portion.

52. A particle sensor as in claim 51 wherein said first portion and second portion are configured to removably snap together.

53. A particle sensor as in claim 51 wherein said first portion and second portion are permanently attached to each other.

54. A particle sensor as in claim 48 wherein said smoke cage further comprises at least one finished surface.

55. A particle sensor as in claim 54 wherein said at least one finished surface comprises a low luster surface.

56. A particle sensor as in claim 55 wherein said at least one finished surface is substantially black.

57. A particle sensor as in claim 48 having an associated signal to noise ratio of 4:1 or greater.

58. A particle sensor as in claim 57 having an associated signal to noise ratio of 5:1 or greater.

59. A particle sensor as in claim 48 further configured such that a least sensitive particle sensor orientation with respect to airflow has an associated sensitivity of at least about 75%.

60. A particle sensor as in claim 48 further configured such that a least sensitive particle sensor orientation with respect to airflow has an associated sensitivity of at least about 90%.

61. A particle sensor, comprising;

an aesthetic cover having a perimeter, a printed circuit board, a smoke cage, at least two thermal sensors, wherein said thermal sensors are positioned near the perimeter of the aesthetic cover and spaced about 120 degrees apart from each other, and a light source, an optical transducer, and a controller in communication with said light source and said optical transducer, wherein the controller is configured to analyze a first output of said optical transducer taken at a first time while said light source is off.

62. A particle sensor as in claim 61 wherein said aesthetic cover is configured to separate the thermal sensors from the area inside the aesthetic cover.

63. A particle sensor as in claim 61 further comprising an alarm threshold.

64. A particle sensor as in claim 63 having a signal to noise ratio of 4:1 or greater.

65. A particle sensor as in claim 61 further comprising a chimney constructed from a first portion and a second portion.

66. A particle sensor as in claim 61 configured such that a least sensitive particle sensor orientation with respect to airflow has an associated sensitivity of at least about 75%.

67. A particle sensor as in claim 9 wherein said controller is further configured to analyze a second output of said optical transducer taken at a second time while said light source is on.

68. A particle sensor as in claim 67 wherein the particle sensor is configured to accept modulated power, said controller is further configured to delay said second output by a specific time delay.

69. A particle sensor as in claim 68 wherein said specific time delay is substantially a positive non-zero integer multiple of an input power source period.

70. A particle sensor as in claim 69 wherein said specific time delay is substantially equal to 1 period of an input power source.

71. A particle sensor as in claim 9 wherein said controller is further configured to reject substantially all signals except those contributed by said light source.

72. A particle sensor as in claim 61 wherein said controller is further configured to analyze a second output of said optical transducer taken at a second time while said light source is on.

73. A particle sensor as in claim 72 wherein said specific time delay is substantially a positive non-zero integer multiple of an input power source period.

74. A particle sensor as in claim 73 wherein said specific time delay is substantially a positive non-zero integer multiple of an input power source period.

75. A particle sensor as in claim 74 wherein said specific time delay is substantially equal to 1 period of an input power source.

76. A particle sensor as in claim 61 wherein said controller is further configured to reject substantially all signals except those contributed by said light source.

* * * * *

UNITED STATES PATENT AND TRADEMARK OFFICE

CERTIFICATE OF CORRECTION

PATENT NO. : 7,616,126 B2
APPLICATION NO. : 11/488315
DATED : November 10, 2009
INVENTOR(S) : Kadwell et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 320 days.

Signed and Sealed this

Nineteenth Day of October, 2010

David J. Kappos

David J. Kappos
*Director of the United States Patent and Trademark Office*